US012022909B2

(12) United States Patent
Davis et al.

(10) Patent No.: US 12,022,909 B2
(45) **Date of Patent: *Jul. 2, 2024**

(54) POLYOLEFIN-BASED RESINS, SOLE STRUCTURES, AND ARTICLES OF FOOTWEAR AND SPORTING EQUIPMENT FORMED THEREFROM

(71) Applicant: NIKE, Inc., Beaverton, OR (US)

(72) Inventors: Carmen Davis, Beaverton, OR (US); Isaac Farr, Beaverton, OR (US); Devon Frazier, Beaverton, OR (US); Jeremy D. Walker, Portland, OR (US); Zachary C. Wright, Beaverton, OR (US)

(73) Assignee: NIKE, INC., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/819,333

(22) Filed: Aug. 12, 2022

(65) Prior Publication Data

US 2023/0094966 A1 Mar. 30, 2023

Related U.S. Application Data

(60) Provisional application No. 63/238,376, filed on Aug. 30, 2021.

(51) Int. Cl.
*A43B 13/22* (2006.01)

(52) U.S. Cl.
CPC ..... *A43B 13/22* (2013.01)

(58) Field of Classification Search
CPC ..... A43B 13/22; A43B 13/04; A43B 13/12; A43B 5/02; A43C 15/16
See application file for complete search history.

(56) References Cited

U.S. PATENT DOCUMENTS

| | | | |
|---|---|---|---|
| 1,963,577 | A | 6/1934 | Cuozzo |
| 3,190,016 | A | 6/1965 | Hansjosten |
| 3,824,716 | A | 7/1974 | Di Paolo |
| 3,851,411 | A | 12/1974 | Crosbie et al. |
| 4,120,477 | A | 10/1978 | Justamante |

(Continued)

FOREIGN PATENT DOCUMENTS

| | | | |
|---|---|---|---|
| BE | 549506 | A | 12/1959 |
| CN | 1259967 | A | 7/2000 |

(Continued)

OTHER PUBLICATIONS

International Search Report and Written Opinion for PCT/US2022/072223, mailed Aug. 22, 2022.

(Continued)

*Primary Examiner* — Bao-Thieu L Nguyen

(74) *Attorney, Agent, or Firm* — THOMAS | HORSTEMEYER, LLP

(57) ABSTRACT

Resin compositions composed of a polyolefin copolymer, a polymeric resin modifier, and a thermoplastic vulcanizate (TPV) are provided herein. A variety of sole structures for footwear, including plates, are provided including the polyolefin-based resin compositions described herein. Articles of footwear formed therefrom are also provided. Methods of making the polyolefin-based resin compositions, plates, sole structures, and articles of footwear and sporting equipment are also provided.

12 Claims, 17 Drawing Sheets

(56) References Cited

U.S. PATENT DOCUMENTS 4,228,600 A * 10/1980 Krug ..... B32B 27/065 428/319.7
4,434,518 A 3/1984 Watanabe
4,542,598 A 9/1985 Misevich et al.
5,025,573 A 6/1991 Giese et al.
5,118,753 A 6/1992 Hikasa et al.
5,300,365 A 4/1994 Ogale
5,538,804 A 7/1996 Ogale
5,784,809 A 7/1998 McDonald
5,820,719 A 10/1998 Strickland et al.
6,008,286 A 12/1999 Groves
6,308,439 B1 10/2001 Ellis, III
6,497,058 B2 12/2002 Dietrich et al.
6,584,705 B2 7/2003 Lain
6,625,906 B2 9/2003 Mayer et al.
6,948,264 B1 9/2005 Lyden
6,973,746 B2 12/2005 Auger et al.
7,010,867 B2 3/2006 Brown
7,585,796 B2 9/2009 Suzuki et al.
7,619,038 B2 11/2009 Mehta et al.
7,712,231 B2 5/2010 Umezawa et al.
7,823,297 B2 11/2010 Polegato Moretti
7,832,117 B2 11/2010 Auger et al.
7,886,460 B2 2/2011 Teteriatnikov et al.
8,079,159 B1 12/2011 Rosa
8,138,269 B2 3/2012 Kiss et al.
8,171,656 B2 5/2012 Salminen et al.
8,263,707 B2 9/2012 Datta et al.
8,327,560 B2 12/2012 Berend
8,394,892 B2 3/2013 Bokhari et al.
8,470,449 B2 6/2013 Hoya et al.
8,505,216 B2 8/2013 Sokolowski et al.
8,533,977 B2 9/2013 Hide et al.
8,541,502 B2 9/2013 Martinez et al.
8,671,590 B2 3/2014 Rasmussen et al.
8,713,819 B2 5/2014 Auger et al.
8,716,400 B2 5/2014 Carnahan et al.
8,776,397 B2 7/2014 Borel et al.
8,802,774 B2 8/2014 Carnahan et al.
8,822,599 B2 9/2014 Li Pi Shan et al.
8,921,484 B2 12/2014 Liang et al.
9,003,679 B2 4/2015 Baucom et al.
9,167,867 B2 10/2015 Fahmi et al.
9,210,967 B2 12/2015 Gerber
9,289,029 B2 3/2016 Miette
9,468,251 B2 10/2016 Auger
9,480,301 B2 11/2016 Cavaliere et al.
9,486,033 B2 11/2016 Polegato Moretti
9,661,896 B2 5/2017 Elliott et al.
9,775,402 B2 10/2017 Nonogawa et al.
9,833,038 B2 12/2017 Foxen et al.
9,888,741 B2 2/2018 Diard et al.
9,981,437 B2 5/2018 Campos, II et al.
9,982,122 B2 5/2018 Li et al.
10,182,617 B2 1/2019 Craig
10,350,851 B2 7/2019 Salmini et al.
10,548,367 B2 2/2020 Kenens et al.
10,660,403 B2 5/2020 Weidl
10,662,322 B2 5/2020 Inoue
10,932,522 B2 3/2021 Kurcinka et al.
10,966,484 B2 4/2021 Merlo
11,044,963 B2 6/2021 Love et al.
11,116,276 B2 9/2021 Su et al.
11,213,091 B2 * 1/2022 Constantinou ..... A43B 13/122
11,272,758 B2 3/2022 Farr et al.
11,503,875 B2 * 11/2022 Farr ..... A43B 13/12
11,696,620 B2 * 7/2023 Farr ..... A43B 23/025 36/78
2001/0007177 A1 7/2001 Brown et al.
2002/0028875 A1 3/2002 Anderle et al.
2003/0131499 A1 7/2003 Silverman
2004/0087751 A1 5/2004 Tau et al.
2004/0166752 A1 8/2004 Taghavi
2004/0168348 A1 9/2004 Strickland
2006/0199906 A1 9/2006 Walton et al.
2008/0249232 A1 10/2008 Datta et al.
2010/0192421 A1 8/2010 Kerns et al.
2011/0061264 A1 3/2011 Solymosi et al.
2012/0198728 A1 8/2012 Farrelly
2013/0255103 A1 10/2013 Dua et al.
2014/0250727 A1 9/2014 Vandernoot et al.
2015/0068066 A1 3/2015 Ludemann et al.
2015/0143720 A1 5/2015 Avar
2015/0351492 A1 12/2015 Dombrow et al.
2016/0128433 A1 5/2016 Downing et al.
2016/0174655 A1 6/2016 Schiller et al.
2016/0219978 A1 8/2016 Elder et al.
2016/0242499 A1 8/2016 Droege et al.
2016/0295935 A1 10/2016 Foster et al.
2016/0295971 A1 10/2016 Arnese et al.
2017/0181498 A1 6/2017 Whelan et al.
2017/0273399 A1 9/2017 Nishi
2018/0116337 A1 5/2018 Montross et al.
2018/0125151 A1 5/2018 Möhlmann et al.
2018/0153254 A1 6/2018 Fusco et al.
2018/0327580 A1 11/2018 Minowa et al.
2019/0016079 A1 1/2019 Tanabe et al.
2019/0029361 A1 1/2019 Gopalan et al.
2019/0031870 A1 1/2019 Grestenberger et al.
2019/0045880 A1 2/2019 Li et al.
2019/0098946 A1 4/2019 Bee et al.
2019/0116926 A1 * 4/2019 Constantinou ..... A43B 13/189
2019/0116927 A1 * 4/2019 Constantinou ..... B29D 35/142
2019/0223547 A1 * 7/2019 Farr ..... C08K 5/06
2019/0225784 A1 * 7/2019 Farr ..... C08L 23/14
2019/0335852 A1 * 11/2019 Constantinou ..... A43C 15/168
2019/0343220 A1 * 11/2019 Farr ..... B32B 27/32
2019/0343221 A1 * 11/2019 Farr ..... A43B 23/0245
2019/0380434 A1 12/2019 Luh
2020/0275738 A1 9/2020 Rhenter
2021/0015210 A1 * 1/2021 Farr ..... A43B 15/00
2021/0022445 A1 * 1/2021 Dua ..... D06N 3/0088
2021/0085025 A1 3/2021 Geis et al.
2021/0214536 A1 7/2021 Tateishi
2021/0235812 A1 8/2021 Bartel et al.
2022/0142295 A1 5/2022 Laverty
2022/0402236 A1 * 12/2022 Dua ..... B32B 5/024

FOREIGN PATENT DOCUMENTS

CN 1531883 A 9/2004
CN 1537484 A 10/2004
CN 1796448 A 7/2006
CN 101389469 A 3/2009
CN 101466784 A 6/2009
CN 104824901 A 8/2015
CN 105415818 A 3/2016
CN 206525647 U 9/2017
DE 1865048 U 1/1963
DE 2709546 A1 9/1978
EP 0962459 A1 12/1999
EP 1504688 A1 2/2005
EP 1591031 A1 11/2005
EP 1820821 A1 8/2007
EP 2471858 A1 7/2012
EP 3005897 A1 4/2016
EP 3168261 A1 5/2017
EP 3168361 A1 5/2017
EP 3179877 A2 6/2017
EP 3199586 A1 8/2017
EP 3245889 A1 11/2017
EP 3315040 A2 5/2018
EP 3427603 A1 1/2019
EP 2471859 A1 7/2021
FR 1109855 A 2/1956
FR 2775875 A1 9/1999
FR 2898252 A1 9/2007
GB 1062411 A 3/1967
GB 2425706 A 11/2006
JP 8-113681 A 5/1996
JP 2000210102 A 8/2000
JP 2005278989 A 10/2005
KR 20170053782 A 5/2017
NL 272430 A 12/1960

(56) References Cited

FOREIGN PATENT DOCUMENTS

| | | | |
|---|---|---|---|
| WO | 98/39385 | A1 | 9/1998 |
| WO | 0001528 | A1 | 1/2000 |
| WO | 2003005845 | A1 | 1/2003 |
| WO | 2006065648 | A1 | 6/2006 |
| WO | 2007120147 | A1 | 10/2007 |
| WO | 2017082358 | A1 | 5/2017 |
| WO | 2017104452 | A1 | 6/2017 |
| WO | 2017115840 | A1 | 7/2017 |
| WO | 2017141200 | A1 | 8/2017 |

OTHER PUBLICATIONS

"Waterborne Adhesives and Sealants," Apr. 17, 2017, Polymer Properties Database available at https://web.archive.org/web/20170417122206/https://polymerdatabase.com/Adhesives/WB%20Adhesives.html. (Year: 2017).
"Present Situation and Development of Thermoplastic Elastomers", LEI Xiaoping, et al., Fiber Composites, No. 2.
Derwent Abstract for RO 93151 A, Dec. 1987, 1 page.
International Preliminary Report on Patentability for PCT/US2019/015016, mailed Feb. 19, 2020.
International Preliminary Report on Patentability for PCT/US2019/015021, mailed Jul. 7, 2020.
International Preliminary Report on Patentability for PCT/US2019/031389, mailed Apr. 3, 2020.
International Preliminary Report on Patentability for PCT/US2019/031392, mailed Aug. 27, 2020.
International Search Report and Written Opinion for PCT/US2019/015016 mailed Jul. 29, 2019.
International Search Report and Written Opinion for PCT/US2019/015021, mailed Jun. 5, 2019.
International Search Report and Written Opinion for PCT/US2019/031389, mailed Sep. 6, 2019.
International Search Report and Written Opinion for PCT/US2019/031392, mailed Sep. 6, 2019.
Written Opinion for PCT/US2019/015016, mailed Nov. 20, 2019.
Written Opinion for PCT/US2019/015021, mailed Jan. 8, 2020.
Written Opinion for PCT/US2019/015021, mailed Mar. 26, 2020.
Written Opinion for PCT/US2019/015021, mailed May 11, 2020.
Written Opinion for PCT/US2019/031392, mailed Apr. 1, 2020.
International Preliminary Report on Patentability for PCT/US2022/072223, mailed Dec. 12, 2022.
International Search Report and Written Opinion for PCT/US2022/074879, mailed Nov. 28, 2022.
International Preliminary Report on Patentability for PCT/US2022/074879, mailed Mar. 30, 2023.

* cited by examiner

POLYOLEFIN-BASED RESINS, SOLE STRUCTURES, AND ARTICLES OF FOOTWEAR AND SPORTING EQUIPMENT FORMED THEREFROM

CROSS REFERENCE TO RELATED APPLICATIONS

This application claims the benefit of U.S. Provisional Application No. 63/238,376, filed on Aug. 30, 2021, which is incorporated herein by reference in its entirety.

TECHNICAL FIELD

The present disclosure generally relates to polyolefin-based resin compositions, sole structures such as plates including the polyolefin-based resins compositions, and articles of footwear or sporting equipment including these polyolefin-based resin compositions.

BACKGROUND

The design and manufacture of footwear and sporting equipment involves a variety of factors from the aesthetic aspects, to the comfort and feel, to the performance and durability. While design and fashion may be rapidly changing, the demand for increasing performance in the footwear and sporting equipment market is unchanging. In addition, the market has shifted to demand lower-cost and recyclable materials still capable of meeting increasing performance demands. However, the materials used to produce the footwear should have certain properties in order to enhance the durability of the footwear. To balance these demands, designers of footwear and sporting equipment employ a variety of materials and designs for the various components.

BRIEF DESCRIPTION OF THE DRAWINGS

Further aspects of the present disclosure will be readily appreciated upon review of the detailed description, described below, when taken in conjunction with the accompanying drawings.

FIG. 1A is a lateral side perspective view of the exemplary article of athletic footwear. FIG. 1B is a lateral side elevational view of the exemplary article of athletic footwear. FIG. 1C is a medial side elevational view of the exemplary article of athletic footwear. FIG. 1D is a top view of the exemplary article of athletic footwear. FIG. 1E is a front view of the exemplary article of athletic footwear. FIG. 1F is a rear view of the exemplary article of athletic footwear. FIG. 1G is an exploded perspective view of the exemplary article of athletic footwear. FIG. 1H is a sectional view along 1-1 of the exemplary article of athletic footwear.

FIG. 2A is a lateral side elevational view of the exemplary article of athletic footwear. FIG. 2B is an exploded perspective view of the second exemplary article of athletic footwear. FIG. 2C is a sectional view along 2-2 of the second exemplary article of athletic footwear.

FIG. 4A is a lateral side elevational view of the exemplary article of athletic footwear. FIG. 4B is an exploded perspective view of the second exemplary article of athletic footwear. FIG. 4C is a sectional view along 4-4 of the second exemplary article of athletic footwear.

FIG. 5A is a lateral side elevational view of the fifth exemplary article of athletic footwear. FIG. 5B is an exploded perspective view of the fifth exemplary article of athletic footwear.

DETAILED DESCRIPTION

Figure 1A:
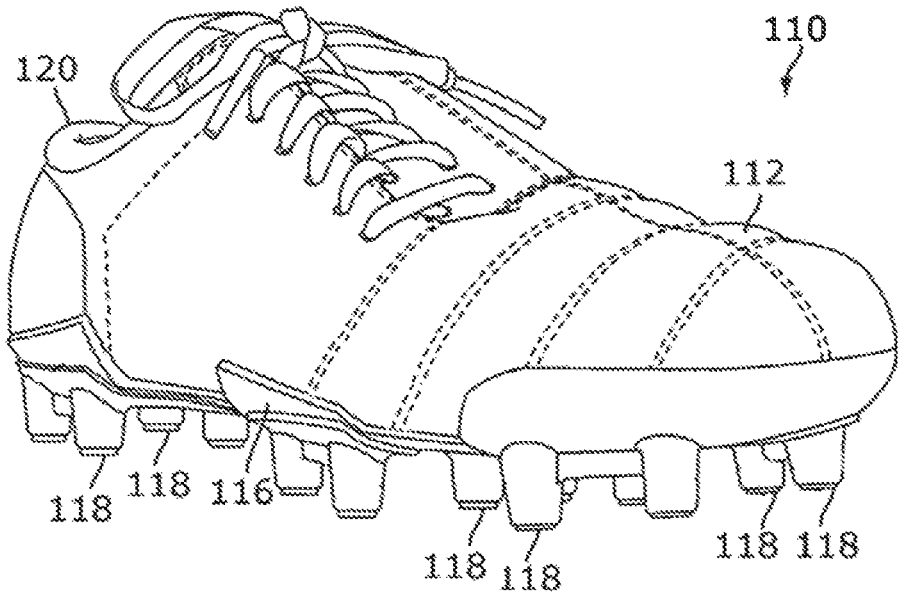
FIGS. 1A-1H depict an exemplary article of athletic footwear.

State of the art specialty polymers for footwear and sporting equipment include polymers such as polyurethane and polyamide polymers, but there remains a need for lower-cost alternatives to these performance polymers, especially lower-cost alternatives that are recyclable and readily processable.

Alternatives such as polyolefins, while cost-effective, have traditionally suffered from poor mechanical properties and poor surfaces and surface energies for bonding. New designs and materials are needed. While other polyolefin-based resins which resist stress-whitening and cracking under cold conditions have been developed, these resins have been found to be susceptible to scratching and fracturing, which can lead to unacceptable levels of "chunking," in which the edges of the resin fracture when impacted, and bits of the resin fall off during repeated impacts. When these polyolefin-based resins have been used to form plates for global football boots, it resulted in bits of the plates falling off, optionally from the toe region, during game play. This loss of material from these plates may reduce their overall durability and lifetime, and also may negatively affected their appearance.

There remains a need for improved polyolefin-based resin compositions for making components of footwear and sporting equipment which are more resistant to scratching, fracturing, "chunking," and abrasion, while also exhibiting sufficiently low levels of stress whitening or cracking when flexed under cold conditions, in order for them to be capable of withstanding the stresses required for use in footwear and other athletic equipment applications.

It has been found that by combining a thermoplastic vulcanizate (TPV) with a polyolefin copolymer and a polymeric resin modifier, the resulting polyolefin-based resin composition is more durable and resistant to cracking and fracturing than the polyolefin-based resin composition without the TPV present. These more durable polyolefin-based resin compositions are more resistant to "chunking" when exposed to the types of stresses encountered in use by articles of footwear and other athletic equipment. A relatively small amount of the TPV may be included in the polyolefin-based resin composition, such as at least 5 percent by weight, or at least 10 percent by weight, or at least 15 percent by weight, or at least 20 percent by weight, based on a total weight of the polyolefin-based resin composition. In one aspect, the disclosure provides polyolefin-based resin compositions including a polyolefin copolymer, a polymeric resin modifier, and a TPV. The polyolefin copolymer may comprise a propylene-ethylene copolymer, optionally a random propylene-ethylene copolymer. The polymeric resin modifier may also comprise a propylene copolymer, optionally a propylene-ethylene copolymer including isotactic propylene units. The TPV may comprise a crosslinked elastomer phase dispersed in a thermoplastic phase comprising a polyolefin, optionally a crosslinked propylene-based elastomer such as EPDM rubber dispersed in a thermoplastic phase comprising polypropylene.

The polyolefin-based resin compositions comprising a polyolefin copolymer and a TPV as described herein have improved mechanical properties making them optionally suitable for use in components for footwear and sporting equipment. Specifically, these polyolefin-based resin compositions exhibit improved resistance to "chunking," as well as resistance to stress whitening or cracking when flexed under cold conditions, to the levels needed for use in footwear and sporting equipment. The present disclosure provides a variety of sole structures. As used herein, a sole structure is understood to refer to the portion of an article of footwear which is configured to be positioned under the foot of a wearer, including a component which may be used alone or in combination with other components to form an underfoot system. One example of a sole structure is a plate for an article of footwear. Examples of components include cushioning structures, heel clips, traction elements, toe bumpers, and the like. The present disclosure describes polyolefin-based resin compositions for use in sole structures, such as plates, cushioning structures, heel clips, traction elements and toe bumpers for articles of footwear which include these polyolefin-based resin compositions, as well as articles of footwear including sole structures, including plates, comprising the polyolefin-based resin compositions described herein. The present disclosure also provides for methods of making these polyolefin-based resin compositions, for making sole structures, and for making articles of footwear, including methods for extruding or injection molding polyolefin-based resin composition to form the sole structures, optionally methods of manufacturing articles of footwear by injection molding the polyolefin-based resin composition directly onto an upper for an article of footwear. The present also describes articles of sporting equipment comprising these polyolefin-based resin compositions, and methods of making such articles of sporting equipment.

In some aspects, this disclosure provides a sole structure for an article of footwear. The sole structure may include or be a plate containing a polyolefin-based resin composition comprising a polyolefin copolymer and a TPV as described herein, the sole structure (e.g., plate) having a first side and a second side, wherein the first side is configured to be ground-facing when the sole structure is a component of an article of footwear. The ground-facing side of the sole structure (e.g., plate) may be configured to be ground-contacting. The sole structure (e.g., plate) may include a plurality of ground-contacting traction elements on the ground-facing side. The plurality of traction elements may comprise the polyolefin-based resin composition. All of the plurality of traction elements of an individual sole structure or plate, or only a portion of the plurality of traction elements of the sole structure or plate, may include a first region of the traction element molded from the polyolefin-based resin composition (such as a stud shaft), and second region of the traction element molded from a second resin composition (such as a stud tip molded from a second resin composition). The second resin composition of the traction element, such as a second resin composition forming the tip portion of the traction element, may comprise a thermoplastic elastomer or a TPV or both, optionally a polyolefin-based thermoplastic elastomer or a polyolefin-based TPV. Use of a polyolefin-based composition for the second resin composition can increase the level of compatibility between the second resin composition and the polyolefin-based resin composition of the majority of the sole structure or plate, thereby increasing the bond strength between the two resin compositions, optionally when the two resin compositions are thermally bonded to each other. In order to further improve the resistance of the toe region of the sole structure or plate to scratching, fracturing, or chunking, the sole structure or plate may further comprise a toe bumper, including a toe bumper secured to a peripheral edge of the sole structure. The resin composition of the toe bumper may be a polyolefin-based resin composition as described herein, and may comprise the same polyolefin copolymer, or the same TPV, or both, as the polyolefin-based resin composition of the majority of the sole structure or plate. The resin composition of the toe bumper may be a second resin composition as described herein. The resin composition of the toe bumper may be softer, or more elastic, or both softer and more elastic, as compared to the polyolefin-based resin composition of the majority of the sole structure or plate, to further protect the toe portion of the sole structure or plate from scratching, fracturing, and chunking. A textile may be disposed on one or both of the first side and the second side of the sole structure or plate, to improve the bonding between the components of the article of footwear (e.g., the upper, the chassis, the traction elements, etc.), or for decorative purposes, or for both. The sole structure or plate may further include a chassis configured to be on the first side of the sole structure or plate. The chassis can wrap around the sole structure or plate and engage or be attached to an upper when the sole structure or plate is a component of an article of footwear, for example the chassis may attach to the upper at the bite line, or may attach to the upper above the bite line. In some aspects, the sole structures or plates do not include a textile, e.g. the sole structure or plate may comprise or consist of the sole structure or plate, the plurality of traction elements, and optionally a chassis as described above and detailed more fully below.

In various aspects, this disclosure also provides articles of footwear including a sole structure described herein, as well as methods of making the articles of footwear.

Before the present disclosure is described in greater detail, it is to be understood that this disclosure is not limited to particular aspects described, and as such may, of course, vary. Other systems, methods, features, and advantages of polyolefin-based resin compositions and articles and components thereof will be or become apparent to one with skill in the art upon examination of the following drawings and detailed description. It is intended that all such additional systems, methods, features, and advantages be included within this description, be within the scope of the present disclosure, and be protected by the accompanying claims. It is also to be understood that the terminology used herein is for the purpose of describing particular aspects only, and is not intended to be limiting. The skilled artisan will recognize many variants and adaptations of the aspects described herein. These variants and adaptations are intended to be included in the teachings of this disclosure and to be encompassed by the claims herein.

ASPECTS

The following list of exemplary aspects supports and is supported by the disclosure provided herein.

In accordance with Aspect 1, the present disclosure is directed to a polyolefin-based resin composition comprising: a polyolefin copolymer, a polymeric resin modifier, and a thermoplastic vulcanizate (TPV).

In accordance with Aspect 2, the present disclosure is directed to the polyolefin-based resin composition according to Aspect 1, wherein the polyolefin copolymer is a random copolymer.

In accordance with Aspect 3, the present disclosure is directed to the polyolefin-based resin composition according to any one of Aspects 1 or 2, wherein the polyolefin copolymer comprises a plurality of repeat units, with each of the plurality of repeat units individually derived from an alkene monomer having about 1 to about 6 carbon atoms.

In accordance with Aspect 4, the present disclosure is directed to the polyolefin-based resin composition according to any one of Aspects 1-3, wherein the polyolefin copolymer comprises a plurality of repeat units, with each of the plurality of repeat units individually derived from a monomer selected from the group consisting of ethylene, propylene, 4-methyl-1-pentene, 1-butene, and a combination thereof.

In accordance with Aspect 5, the present disclosure is directed to the polyolefin-based resin composition according to any one of Aspects 1-4, wherein the polyolefin copolymer comprises a plurality of repeat units each individually selected from Formula 1A-1D Formula 1A

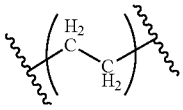

Formula 1B

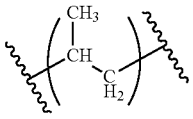

Formula 1C

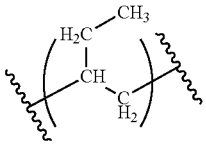

Formula 1D

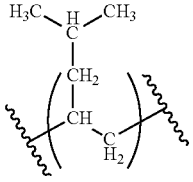

In accordance with Aspect 6, the present disclosure is directed to the polyolefin-based resin composition according to any one of Aspects 1-5, wherein the polyolefin copolymer comprises a plurality of repeat units each individually having a structure according to Formula 2

Formula 2

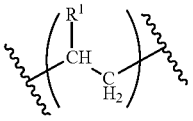

where $R^1$ is a hydrogen or a substituted or unsubstituted, linear or branched, $C_1$-$C_{12}$ alkyl or heteroalkyl.

In accordance with Aspect 7, the present disclosure is directed to the polyolefin-based resin composition according to any one of Aspects 1-6, wherein all the polymers in the polyolefin-based resin composition consist essentially of polyolefin copolymers.

In accordance with Aspect 8, the present disclosure is directed to the polyolefin-based resin composition according to any one of Aspects 1-7, wherein the polyolefin copolymer is a random copolymer of a first plurality of repeat units and a second plurality of repeat units, and wherein each repeat unit in the first plurality of repeat units is derived from ethylene and the each repeat unit in the second plurality of repeat units is derived from a second olefin.

In accordance with Aspect 9, the present disclosure is directed to the polyolefin-based resin composition according to any one of Aspects 1-8, wherein the second olefin is selected from the group consisting of propylene, 4-methyl-1-pentene, 1-butene, and other linear or branched terminal alkenes having about 3 to 12 carbon atoms.

In accordance with Aspect 10, the present disclosure is directed to the polyolefin-based resin composition according to any one of Aspects 1-9, wherein each of the repeat units in the first plurality of repeat units has a structure according to Formula 1A, and wherein each of the repeat units in the second plurality of repeat units has a structure selected from Formula 1B-1D Formula 1A

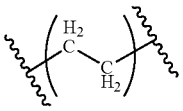

Formula 1B

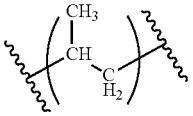

Formula 1C

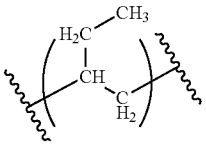

Formula 1D

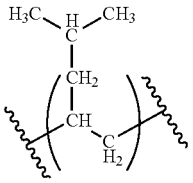

In accordance with Aspect 11, the present disclosure is directed to the polyolefin-based resin composition according to any one of Aspects 1-10, wherein each of the repeat units in the first plurality of repeat units has a structure according to Formula 1A, and wherein each of the repeat units in the second plurality of repeat units has a structure according to Formula 2

Formula 1A

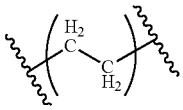

Formula 2

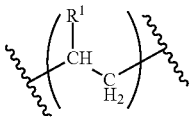

where $R^1$ is a hydrogen or a substituted or unsubstituted, linear or branched, $C_2$-$C_{12}$ alkyl or heteroalkyl.

In accordance with Aspect 12, the present disclosure is directed to the polyolefin-based resin composition according to any one of Aspects 1-11, wherein the polyolefin copolymer comprises about 80 percent to about 99 percent, about 85 percent to about 99 percent, about 90 percent to about 99 percent, or about 95 percent to about 99 percent polyolefin repeat units by weight based upon a total weight of the polyolefin copolymer.

In accordance with Aspect 13, the present disclosure is directed to the polyolefin-based resin composition according to any one of Aspects 1-12, wherein the polyolefin copolymer comprises about 1 percent to about 5 percent, about 1 percent to about 3 percent, about 2 percent to about 3 percent, or about 2 percent to about 5 percent ethylene by weight based upon a total weight of the polyolefin copolymer.

In accordance with Aspect 14, the present disclosure is directed to the polyolefin-based resin composition according to any one of Aspects 1-13, wherein the polyolefin copolymer is substantially free of polyurethanes.

In accordance with Aspect 15, the present disclosure is directed to the polyolefin-based resin composition according to any one of Aspects 1-14, wherein polymer chains of the polyolefin copolymer are substantially free of urethane repeat units.

In accordance with Aspect 16, the present disclosure is directed to the polyolefin-based resin composition according to any one of Aspects 1-15, wherein the polyolefin-based resin composition is substantially free of polymer chains including urethane repeat units.

In accordance with Aspect 17, the present disclosure is directed to the polyolefin-based resin composition according to any one of Aspects 1-16, wherein the polyolefin copolymer is substantially free of polyamide.

In accordance with Aspect 18, the present disclosure is directed to the polyolefin-based resin composition according to any one of Aspects 1-17, wherein polymer chains of the polyolefin copolymer are substantially free of amide repeat units.

In accordance with Aspect 19, the present disclosure is directed to the polyolefin-based resin composition according to any one of Aspects 1-18, wherein the polyolefin-based resin composition is substantially free of polymer chains including amide repeat units.

In accordance with Aspect 20, the present disclosure is directed to the polyolefin-based resin composition according to any one of Aspects 1-19, wherein the polyolefin copolymer comprises or consists essentially of a polypropylene copolymer.

In accordance with Aspect 21, the present disclosure is directed to the polyolefin-based resin composition according to any one of Aspects 1-20, wherein the polyolefin copolymer comprises or consists essentially of a polypropylene random copolymer.

In accordance with Aspect 22, the present disclosure is directed to the polyolefin-based resin composition according to any one of Aspects 1-21, wherein the polypropylene copolymer is a random copolymer of ethylene and propylene.

In accordance with Aspect 23, the present disclosure is directed to the polyolefin-based resin composition according to any one of Aspects 1-22, wherein the polypropylene copolymer comprises about 80 percent to about 99 percent, about 85 percent to about 99 percent, about 90 percent to about 99 percent, or about 95 percent to about 99 percent polypropylene repeat units by weight based upon a total weight of the polypropylene copolymer.

In accordance with Aspect 24, the present disclosure is directed to the polyolefin-based resin composition according to any one of Aspects 1-23, wherein the polypropylene copolymer comprises about 1 percent to about 5 percent, about 1 percent to about 3 percent, about 2 percent to about 3 percent, or about 2 percent to about 5 percent ethylene by weight based upon a total weight of the polypropylene copolymer.

In accordance with Aspect 25, the present disclosure is directed to the polyolefin-based resin composition according to any one of Aspects 1-24, wherein the polypropylene copolymer is a random copolymer comprising about 2 percent to about 3 percent of a first plurality of repeat units by weight and about 80 percent to about 99 percent by weight of a second plurality of repeat units based upon a total weight of the polypropylene copolymer; wherein each of the repeat units in the first plurality of repeat units has a structure according to Formula 1A and each of the repeat units in the second plurality of repeat units has a structure according to Formula 1B Formula 1A

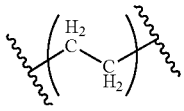

Formula 1B

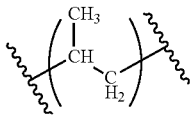

In accordance with Aspect 26, the present disclosure is directed to the polyolefin-based resin composition according to any one of Aspects 1-25, wherein the polypropylene copolymer is substantially free of polyurethane.

In accordance with Aspect 27, the present disclosure is directed to the polyolefin-based resin composition according to any one of Aspects 1-26, wherein polymer chains of the polypropylene copolymer are substantially free of urethane repeat units.

In accordance with Aspect 28, the present disclosure is directed to the polyolefin-based resin composition according to any one of Aspects 1-27, wherein the polyolefin-based resin composition is substantially free of polymer chains including urethane repeat units.

In accordance with Aspect 29, the present disclosure is directed to the polyolefin-based resin composition according to any one of Aspects 1-28, wherein the polypropylene copolymer is substantially free of polyamide.

In accordance with Aspect 30, the present disclosure is directed to the polyolefin-based resin composition according to any one of Aspects 1-29, wherein the amount of the a polyolefin copolymer is about 50 percent to about 90 percent, about 50 percent to about 85 percent, about 50 percent to about 80 percent, about 55 percent to about 80 percent, about 55 percent to about 75 percent, or about 60 percent to about 80 percent by weight based upon a total weight of the polyolefin-based resin composition.

In accordance with Aspect 31, the present disclosure is directed to the polyolefin-based resin composition according to any one of Aspects 1-30, wherein the polymeric resin modifier comprises about 10 percent to about 15 percent ethylene repeat units by weight based upon a total weight of the polymeric resin modifier.

In accordance with Aspect 32, the present disclosure is directed to the polyolefin-based resin composition according to any one of Aspects 1-31, wherein the polymeric resin modifier comprises about 10 percent to about 15 percent repeat units according to Formula 1A by weight based upon a total weight of the polymeric resin modifier Formula 1A

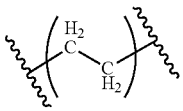

In accordance with Aspect 33, the present disclosure is directed to the polyolefin-based resin composition according to any one of Aspects 1-32, wherein the polyolefin-based resin composition has a total ethylene repeat unit content of about 3 percent to about 7 percent by weight based upon a total weight of the polyolefin-based resin composition.

In accordance with Aspect 34, the present disclosure is directed to the polyolefin-based resin composition according to any one of Aspects 1-33, wherein the polymeric resin modifier has an ethylene repeat unit content of about 10 percent to about 15 percent by weight based upon a total weight of the polymeric resin modifier.

In accordance with Aspect 35, the present disclosure is directed to the polyolefin-based resin composition according to any one of Aspects 1-34, wherein the polymeric resin modifier is a copolymer comprising isotactic repeat units derived from an olefin.

In accordance with Aspect 36, the present disclosure is directed to the polyolefin-based resin composition according to any one of Aspects 1-35, wherein the polymeric resin modifier is a copolymer comprising repeat units according to Formula 1B, and wherein the repeat units according to Formula 1B are arranged in an isotactic stereochemical configuration Formula 1B

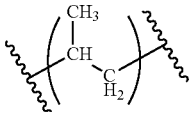

In accordance with Aspect 37, the present disclosure is directed to the polyolefin-based resin composition according to any one of Aspects 1-36, wherein the polymeric resin modifier is a copolymer comprising isotactic propylene repeat units and ethylene repeat units.

In accordance with Aspect 38, the present disclosure is directed to the polyolefin-based resin composition according to any one of Aspects 1-37, wherein the polymeric resin modifier is a copolymer comprising a first plurality of repeat units and a second plurality of repeat units; wherein each of the repeat units in the first plurality of repeat units has a structure according to Formula 1A and each of the repeat units in the second plurality of repeat units has a structure according to Formula 1B, and wherein the repeat units in the second plurality of repeat units are arranged in an isotactic stereochemical configuration Formula 1A

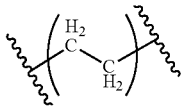

Formula 1B

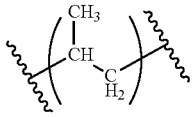

In accordance with Aspect 39, the present disclosure is directed to the polyolefin-based resin composition according to any one of Aspects 1-38, wherein the polymeric resin modifier is a metallocene catalyzed polymer.

In accordance with Aspect 40, the present disclosure is directed to the polyolefin-based resin composition according to any one of Aspects 1-39, wherein an otherwise same polyolefin-based resin composition except without the polymeric resin modifier does not pass the cold Ross flex test using the Material Sampling Procedure.

In accordance with Aspect 41, the present disclosure is directed to the polyolefin-based resin composition according to any one of Aspects 1-40, wherein the polymeric resin modifier comprises about 25 percent or less, about 20 percent or less, about 15 percent or less, about 10 percent or less, or about 5 percent or less of the polyolefin-based resin composition by weight, based upon a total weight of the polyolefin-based resin composition.

In accordance with Aspect 42, the present disclosure is directed to the polyolefin-based resin composition according to any one of Aspects 1-41, wherein the polymeric resin modifier is about 5 percent to about 25 percent, about 5 percent to about 20 percent, about 5 percent to about 15 percent, about 5 percent to about 10 percent, about 10 percent to about 15 percent, about 10 percent to about 20 percent, about 10 percent to about 25 percent, or about 10 percent to about 30 percent by weight based upon a total weight of the polyolefin-based resin composition.

In accordance with Aspect 43, the present disclosure is directed to the polyolefin-based resin composition according to any one of Aspects 1-42, wherein the TPV comprises a crosslinked elastomer dispersed in a thermoplastic phase.

In accordance with Aspect 44, the present disclosure is directed to the polyolefin-based resin composition according to any one of Aspects 1-43, wherein the TPV comprises a EPDM rubber dispersed in a thermoplastic phase, optionally wherein the thermoplastic phase comprises polypropylene.

In accordance with Aspect 45, the present disclosure is directed to the polyolefin-based resin composition according to any one of Aspects 1-44, wherein the thermoplastic phase of the TPV includes a thermoplastic polyolefin, optionally wherein the thermoplastic polyolefin comprises or consists essentially of a thermoplastic polypropylene homopolymer, a thermoplastic polypropylene copolymer, or a mixture of both a thermoplastic polypropylene homopolymer and a thermoplastic polypropylene copolymer.

In accordance with Aspect 46, the present disclosure is directed to the polyolefin-based resin composition according to any one of Aspects 1-45, wherein the crosslinked elastomer of the TPV includes a cured polyolefin rubber.

In accordance with Aspect 47, the present disclosure is directed to the polyolefin-based resin composition according to any one of Aspects 1-46, wherein the TPV is substantially free of hygroscopic fillers.

In accordance with Aspect 48, the present disclosure is directed to the polyolefin-based resin composition according to any one of Aspects 1-47, wherein the TPV is substantially free of fillers.

In accordance with Aspect 49, the present disclosure is directed to the polyolefin-based resin composition according to any one of Aspects 1-48, wherein the TPV is substantially free of pigments.

In accordance with Aspect 50, the present disclosure is directed to the polyolefin-based resin composition according to any one of Aspects 1-49, wherein the TPV comprises one or more fillers.

In accordance with Aspect 51, the present disclosure is directed to the polyolefin-based resin composition according to any one of Aspects 1-50, wherein the TPV comprises one or more pigments.

In accordance with Aspect 52, the present disclosure is directed to the polyolefin-based resin composition according to any one of Aspects 1-51, wherein the TPV is about 5 percent to about 30 percent, about 10 percent to about 30 percent, about 15 percent to about 30 percent, or about 15 percent to about 25 percent by weight of the polyolefin-based resin composition based upon a total weight of the polyolefin-based resin composition.

In accordance with Aspect 53, the present disclosure is directed to the polyolefin-based resin composition according to any one of Aspects 1-52, wherein the polyolefin-based resin composition further comprises a clarifying agent.

In accordance with Aspect 54, the present disclosure is directed to the polyolefin-based resin composition according to any one of Aspects 1-53, wherein the clarifying agent is about 0.5 percent by weight to about 5 percent by weight or about 1.5 percent by weight to about 2.5 percent by weight of the polyolefin-based resin composition based upon a total weight of the polyolefin-based resin composition.

In accordance with Aspect 55, the present disclosure is directed to the polyolefin-based resin composition according to any one of Aspects 1-54, wherein the clarifying agent is selected from the group consisting of a substituted or unsubstituted dibenzylidene sorbitol, 1,3-O-2,4-bis(3,4-dimethylbenzylidene) sorbitol, 1,2,3-trideoxy-4,6:5,7-bis-O-[(4-propylphenyl)methylene], and a derivative thereof.

In accordance with Aspect 56, the present disclosure is directed to the polyolefin-based resin composition according to any one of Aspects 1-55, wherein the clarifying agent comprises an acetal compound that is the condensation product of a polyhydric alcohol and an aromatic aldehyde.

In accordance with Aspect 57, the present disclosure is directed to the polyolefin-based resin composition according to any one of Aspects 1-56, wherein the polyhydric alcohol is selected from the group consisting of acyclic polyols such as xylitol and sorbitol and acyclic deoxy polyols such as 1,2,3-trideoxynonitol or 1,2,3-trideoxynon-1-enitol.

In accordance with Aspect 58, the present disclosure is directed to the polyolefin-based resin composition according to any one of Aspects 1-57, wherein the aromatic aldehyde is selected from the group consisting of benzaldehyde and substituted benzaldehydes.

In accordance with Aspect 59, the present disclosure is directed to the polyolefin-based resin composition according to any one of Aspects 1-58, wherein the polyolefin-based resin composition has a Notched Izod Strength of about 400 Joules per meter to about 800 Joules per meter, about 500 Joules per meter to about 800 Joules per meter, about 550 Joules per meter to about 800 Joules per meter, about 550 Joules per meter to about 750 Joules per meter, or about 550 Joules per meter to about 700 Joules per meter as determined by ASTM D246 at 23 degrees Celsius.

In accordance with Aspect 60, the present disclosure is directed to the polyolefin-based resin composition according to any one of Aspects 1-59, wherein the polyolefin-based resin composition has a Flex Modulus 1 percent Secant of about 400 millipascals to about 800 millipascals, about 500 millipascals to about 800 millipascals, about 550 millipascals to about 800 millipascals, about 550 millipascals to about 750 millipascals, or about 550 millipascals to about 700 millipascals as determined by ASTM D790.

In accordance with Aspect 61, the present disclosure is directed to the polyolefin-based resin composition according to any one of Aspects 1-60, wherein the polyolefin-based resin composition has a melt flow index of about 10 grams per 10 minutes to about 30 grams per 10 minutes, about 15 grams per 10 minutes to about 30 grams per 10 minutes, about 20 grams per 10 minutes to about 30 grams per 10 minutes, or about 15 grams per 10 minutes to about 25 grams per 10 minutes as determined by ASTM D1238 at 230 degrees Celsius using a 2.16 kilogram weight.

In accordance with Aspect 62, the present disclosure is directed to the polyolefin-based resin composition according to any one of Aspects 1-60, wherein the polyolefin-based resin composition comprises the polymeric resin modifier and has a percent crystallization that is at least 4 percentage points less than a percent crystallization of the otherwise same polyolefin-based resin composition except without the polymeric resin modifier when measured according to the DSC Test using the Material Sampling Procedure.

In accordance with Aspect 63, the present disclosure is directed to the polyolefin-based resin composition according to any one of Aspects 1-62, wherein the polyolefin-based resin composition has a percent crystallization of about 35 percent, about 30 percent, about 25 percent, or less when measured according to the Differential Scanning calorimeter (DSC) Test to Determine Percent Crystallinity using the Material Sampling Procedure.

In accordance with Aspect 64, the present disclosure is directed to the polyolefin-based resin composition according to any one of Aspects 1-63, wherein the abrasion loss of the polyolefin-based resin composition is within about 20 percent of an abrasion loss of the otherwise same polyolefin-based resin composition except without the resin modifier as determined by ASTM D 5963-97a using the Material Sampling Procedure.

In accordance with Aspect 65, the present disclosure is directed to the polyolefin-based resin composition according to any one of Aspects 1-64, wherein the polyolefin-based resin composition has an abrasion loss of a about 0.05 cubic centimeters ($cm^3$) to about 0.1 cubic centimeters ($cm^3$), about 0.07 cubic centimeters ($cm^3$) to about 0.1 cubic centimeters ($cm^3$), about 0.08 cubic centimeters ($cm^3$) to about 0.1 cubic centimeters ($cm^3$), or about 0.08 cubic centimeters ($cm^3$) to about 0.11 cubic centimeters ($cm^3$) as determined by ASTM D 5963-97a using the Material Sampling Procedure.

In accordance with Aspect 66, the present disclosure is directed to the polyolefin-based resin composition according to any one of Aspects 1-65, wherein the effective amount of the polymeric resin modifier is an amount effective to allow the polyolefin-based resin composition to pass a flex test as determined by the Cold Ross Flex Test using the Plaque Sampling Procedure.

In accordance with Aspect 67, the present disclosure is directed to the polyolefin-based resin composition according to any one of Aspects 1-66, wherein the effective amount of the polymeric resin modifier is an amount effective to allow the polyolefin-based resin composition to pass a flex test pursuant to the Cold Ross Flex Test using the Plaque Sampling Procedure without a significant change in an abrasion loss as compared to an abrasion loss of a second polyolefin-based resin composition identical to the polyolefin-based resin composition except without the polymeric resin modifier as determined by ASTM D 5963-97a using the Material Sampling Procedure.

In accordance with Aspect 68, the present disclosure is directed to the polyolefin-based resin composition according to any one of Aspects 1-67, wherein the polyolefin-based resin composition is a thermoplastic polyolefin-based resin composition comprising a thermoplastic polyolefin copolymer, a thermoplastic polymeric resin modifier, and a TPV.

In accordance with Aspect 69, the present disclosure is directed to the thermoplastic polyolefin-based resin composition according to Aspect 68, wherein the thermoplastic polyolefin copolymer is or includes an olefin copolymer elastomer.

In accordance with Aspect 70, the present disclosure is directed to a sole structure for an article of footwear, the sole structure comprising: the polyolefin-based resin composition in any one of Aspects 1-69, the sole structure having a first side and a second side, wherein the first side is configured to be ground-facing when the plate is a component of an article of footwear; optionally wherein the sole structure comprises a plate or is a plate.

In accordance with Aspect 71, the present disclosure is directed to the sole structure according to Aspect 70, wherein the sole structure is configured to extend from a medial side to a lateral side of the article of footwear when the sole structure is the component of the article of footwear.

In accordance with Aspect 72, the present disclosure is directed to the sole structure according to Aspect 70 or 71, wherein a length of the sole structure is configured to extend through a metatarsal region to a midfoot region of the article of footwear when the sole structure is the component of the article of footwear.

In accordance with Aspect 73, the present disclosure is directed to the sole structure according to any one of Aspects 70-72, wherein a length of the sole structure is configured to extend through a midfoot region to a heel region of the article of footwear when the sole structure is the component of the article of footwear.

In accordance with Aspect 74, the present disclosure is directed to the sole structure according to any one of Aspects 70-73, wherein a length of the sole structure is configured to extend from a toe region to a heel region of the article of footwear when the sole structure is the component of the article of footwear.

In accordance with Aspect 75, the present disclosure is directed to the sole structure according to any one of Aspects 70-74, wherein the sole structure is or comprises a plate, and the plate is configured to extend from a medial side to a lateral side of the article of footwear when the sole structure is the component of the article of footwear.

In accordance with Aspect 76, the present disclosure is directed to the sole structure according to any one of Aspects 70-75, wherein the sole structure is or comprises a plate, and a length of the plate is configured to extend through a metatarsal region to a midfoot region of the article of footwear when the sole structure is the component of the article of footwear.

In accordance with Aspect 77, the present disclosure is directed to the sole structure according to any one of Aspects 70-76, wherein the sole structure is or comprises a plate, and a length of the plate is configured to extend through a midfoot region to a heel region of the article of footwear when the sole structure is the component of the article of footwear.

In accordance with Aspect 78, the present disclosure is directed to the sole structure according to any one of Aspects 70-77, wherein the sole structure is or comprises a plate, and a length of the plate is configured to extend from a toe region to a heel region of the article of footwear when the sole structure is the component of the article of footwear.

In accordance with Aspect 79, the present disclosure is directed to the sole structure according to any one of Aspects 70-78, wherein the sole structure comprises a first plate having a length configured to extend from a toe region to a metatarsal region, and a second plate having a length configured to extend from a heel region to a midfoot region.

In accordance with Aspect 80, the present disclosure is directed to the sole structure according to any one of Aspects 70-79, wherein the sole structure further comprises a second element.

In accordance with Aspect 81, the present disclosure is directed to the sole structure according to Aspect 80, wherein the second element is chosen from a traction element, a toe bumper, a chassis, a textile, or any combination thereof..

In accordance with Aspect 82, the present disclosure is directed to the sole structure according to any one of Aspects 70-81, wherein the first side of the sole structure includes a plurality of traction elements.

In accordance with Aspect 83, the present disclosure is directed to the sole structure according to any one of Aspects 70-82, wherein one or more of the plurality of traction elements are integrally formed in the sole structure, optionally wherein the one or more of the plurality of traction elements comprise the polyolefin-based resin composition.

In accordance with Aspect 84, the present disclosure is directed to the sole structure according to any one of Aspects 70-83, wherein the first side of the sole structure comprises one or more openings configured to receive a detachable traction element.

In accordance with Aspect 85, the present disclosure is directed to the sole structure according to any one of Aspects 70-84, wherein the sole structure further comprises a toe bumper secured to the sole structure optionally wherein the toe bumper is secured to the sole structure and is configured to be secured to the upper when the sole structure is present as a component of an article of footwear.

In accordance with Aspect 86, the present disclosure is directed to the sole structure according to any one of Aspects 70-85, wherein the sole structure comprises a plurality of traction elements and a toe bumper.

In accordance with Aspect 87, the present disclosure is directed to the sole structure according to any one of Aspects 70-86, wherein the sole structure further comprises a textile disposed on the first side or the second side.

In accordance with Aspect 88, the present disclosure is directed to the sole structure according to Aspect 87, wherein the textile comprises a patterned or decorative textile; or wherein the sole structure comprises a first textile on the first side and a second textile on the second side, wherein the first textile and the second textile are different or wherein the first textile and the second textile are the same; or wherein the textile is a textile disposed on the sole structure by injection molding the polyolefin-based resin composition onto the textile, by laminating the textile onto the sole structure, by welding the textile onto the sole structure, and/or by bonding to the sole structure using an adhesive; or wherein the textile is a textile selected from a woven textile, a non-woven textile, a knit textile, a braided textile, and a combination thereof; or wherein the textile comprises one or more fibers comprising a polymer selected from the group consisting of a polyester, a polyamide, a polyolefin, a blend thereof, and a combination thereof; or wherein the textile comprises a yarn comprising the fibers; or wherein a surface roughness of the surface comprising the textile is greater than a surface roughness of the otherwise same surface except without the textile; or any combination thereof.

In accordance with Aspect 89, the present disclosure is directed to the sole structure according to any one of Aspects 70-87, wherein the sole structure comprises a chassis; optionally wherein the chassis is configured to be on the first side of the sole structure; or wherein the chassis is configured to wrap around the sole structure and to engage or be attached to an upper when the sole structure is a component of an article of footwear; or wherein the chassis is configured to attach to the upper at the bite line when the sole structure is a component of an article of footwear; or wherein the sole structure comprises both a chassis and a textile on the first side, and a bond strength of the first side to the chassis is greater than a bond strength of the otherwise same sole structure to the otherwise same chassis using the otherwise same bonding procedure except without the textile; or wherein the chassis includes a plurality of traction elements on a side of the chassis that is configured to be ground facing when the sole structure is a component of an article of footwear, optionally wherein one or more of the plurality of traction elements are integrally formed in the chassis; or wherein the chassis includes one or more openings configured to receive a detachable traction element on a side of the chassis that is configured to be ground facing when the sole structure is a component of an article of footwear.

In accordance with Aspect 90, the present disclosure is directed to the sole structure according to any one of Aspects 70-89, wherein the sole structure comprises a second resin composition, wherein the second resin composition comprises one or more polymer, optionally wherein the one or more polymer of the second resin composition includes a polyolefin.

In accordance with Aspect 91, the present disclosure is directed to the sole structure according to Aspect 90, wherein the sole structure comprises a second element, and the second element comprises the second resin composition.

In accordance with Aspect 92, the present disclosure is directed to the sole structure according to Aspect 90 or 91, wherein the sole structure comprises a first region including the polyolefin-based resin composition and a second region including the second resin composition, optionally wherein the first region is bonded to the second region.

In accordance with Aspect 93, the present disclosure is directed to the sole structure according to Aspect 90 or 91, wherein the polyolefin-based resin composition is an injection molded polyolefin-based resin composition, and the second resin composition is an injection molded second resin composition.

In accordance with Aspect 94, the present disclosure is directed to the sole structure according to any one of Aspects 90-93, wherein the second resin composition comprises a polyolefin.

In accordance with Aspect 95, the present disclosure is directed to the sole structure according to any one of Aspects 90-94, wherein the second resin composition is a thermoplastic second resin composition comprising a thermoplastic polymer, optionally a thermoplastic polyolefin.

In accordance with Aspect 96, the present disclosure is directed to the sole structure according to any one of Aspects 90-95, wherein the second resin composition is an elastomeric second resin composition comprising an elastomer, optionally a polyolefin elastomer.

In accordance with Aspect 97, the present disclosure is directed to the sole structure according to any one of Aspects 90-96, wherein the second resin composition is a polyolefin-based resin composition according to any one of Aspects 1-70.

In accordance with Aspect 98, the present disclosure is directed to the sole structure according to any one of Aspects 90-97, wherein second resin composition comprises a polyolefin that is different from the polyolefin copolymer of the polyolefin-based resin composition.

In accordance with Aspect 99, the present disclosure is directed to the sole structure according to Aspect 90-98, wherein the polyolefin of the second resin composition is a polyolefin chosen from polypropylene, polypropylene-polyethylene copolymers, copolymers of ethylene and higher olefins such as polyethylene-polyoctene copolymers, and blends thereof.

In accordance with Aspect 100, the present disclosure is directed to the sole structure according to any one of Aspects 90-99, wherein the second resin comprises a polyolefin elastomer.

In accordance with Aspect 101, the present disclosure is directed to the sole structure according to any one of Aspects 90-100, wherein the polyolefin of the second resin composition is chosen from a polystyrene, a polyethylene, an ethylene-α-olefin copolymer, an EPDM rubber, a polybutene, a polyisobutylene, a poly-4-methylpent-1-ene, a polyisoprene, a polybutadiene, an ethylene-methacrylic acid copolymer, mixture thereof.

In accordance with Aspect 102, the present disclosure is directed to the sole structure according to any one Aspects 90-102, wherein the second resin comprises at least 25 weight percent, at least 50 weight percent, or at least 75 weight percent of the polyolefin, or consists essentially of the polyolefin.

In accordance with Aspect 103, the present disclosure is directed to the sole structure according to any one of Aspects 90-103 wherein the second resin comprises at least 25 weight percent, at least 50 weight percent, or at least 75 weight percent of polypropylene, or consists essentially of polypropylene.

In accordance with Aspect 104, the present disclosure is directed to the sole structure according to Aspects 90-103, wherein the second resin comprises less than 20 weight percent, less than 10 weight percent, or less than 5 weight percent of the polyolefin, or is substantially free of polyolefins.

In accordance with Aspect 105, the present disclosure is directed to the sole structure according to any one of Aspects 90-104, wherein the second resin comprises less than 20 weight percent, less than 10 weight percent, or less than 5 weight percent of polypropylene, or is substantially free of polypropylene.

In accordance with Aspect 106, the present disclosure is directed to the sole structure according to any one of Aspects 90-105, wherein the second resin comprises a TPV, optionally a TPV of an EPDM rubber dispersed in a thermoplastic phase comprising polypropylene.

In accordance with Aspect 107, the present disclosure is directed to the sole structure according to any one of Aspects 90-106, wherein the second resin comprises a block copolymer comprising a polystyrene block.

In accordance with Aspect 108, the present disclosure is directed to the sole structure according to Aspect 107, wherein the block copolymer of the second resin composition comprises a copolymer of styrene and one or both of ethylene and butylene, optionally a SEBS copolymer.

In accordance with Aspect 109, the present disclosure is directed to the sole structure according to Aspect 107 or 108, wherein the second resin composition comprises a thermoplastic elastomeric styrenic copolymer.

In accordance with Aspect 110, the present disclosure is directed to the sole structure according to Aspect 109, wherein the thermoplastic elastomeric styrenic copolymer comprises a styrene butadiene styrene (SBS) block copolymer, a styrene ethylene/butylene styrene (SEBS) copolymer, a styrene acrylonitrile copolymer (SAN), or any combination thereof.

In accordance with Aspect 111, the present disclosure is directed to the sole structure according to any one of Aspects 90-110, wherein the second resin comprises a thermoplastic polyurethane (TPU).

In accordance with Aspect 112, the present disclosure is directed to the sole structure according to Aspect 111, wherein the second resin composition comprises a thermoplastic elastomeric polyester polyurethane, a thermoplastic polyether polyurethane, or any combination thereof.

In accordance with Aspect 113, the present disclosure is directed to the sole structure according to Aspect 111 or 112, wherein the thermoplastic elastomeric polyurethane comprises an aromatic polyester thermoplastic elastomeric polyurethane or an aliphatic polyester thermoplastic elastomeric polyurethane.

In accordance with Aspect 114, the present disclosure is directed to the sole structure according to any one of Aspects 90-113, wherein the polymer of the second resin composition has a melting temperature greater than about 110 degrees Celsius and less than about 190 degrees Celsius; or wherein the polymer of the second resin composition has a melting temperature greater than about 120 degrees Celsius and less than about 170 degrees Celsius, and optionally greater than about 130 degrees Celsius, and less than about 160 degrees Celsius; or wherein the polymer of the second resin composition has a glass transition temperature glass transition temperature of less than 20 degrees Celsius; or wherein the polymer of the second resin composition has a glass transition temperature glass transition temperature of from about 20 degrees Celsius to about −60 degrees Celsius; or any combination thereof.

In accordance with Aspect 115, the present disclosure is directed to the sole structure according to any one of Aspects 90-114, wherein the second resin composition has a Taber Abrasion Resistance of at least 10 milligrams, or of at least 20 milligrams, or of at least 30 milligrams, or of greater than 30 milligrams, or of from about 10 milligrams to about 40 milligrams, as determined by ASTM D3389; or wherein the second resin composition has a Durometer Hardness (Shore A) of from about 60 to about 90, from about 60 to about 90, or from about 65 to about 85, or from about 70 to about 80 as determined by ASTM D2240; or wherein the second resin composition has a specific gravity of from about 0.80 grams per cubic centimeter to about 1.30 grams per cubic centimeter, or from about 1.0 grams per cubic centimeter to about 1.2 grams per cubic centimeter as determined by ASTM D792; or any combination thereof.

In accordance with Aspect 116, the present disclosure is directed to the sole structure according to any one of Aspects 90-115, wherein the second resin composition, or the polymer of the second resin composition, has a melt flow index of about 2 grams/10 minutes to about 50 grams/10 minutes at 160 degrees Celsius using a test weight of 2.16 kilograms as determined using ASTM D1238-13; or wherein the second resin composition, or the polymer of the second resin composition, has a melt flow index greater than about 2 grams per 10 minutes at 190 degrees Celsius or 200 degrees Celsius when using a test weight of 10 kilograms as determined using ASTM D1238-13; or wherein the second resin composition, or the polymer of the second resin composition, has a modulus of about 1 megapascal to about 500 megapascals as determined using the Plaque Modulus Test; or any combination thereof.

In accordance with Aspect 117, the present disclosure is directed to the sole structure according to any one of Aspects 90-116, wherein the traction elements include a second resin composition, optionally wherein the second resin composition is an injection molded resin composition; optionally wherein the second resin composition is a polyolefin-based resin composition; optionally wherein the second resin composition comprises a SEBS copolymer or a TPU.

In accordance with Aspect 118, the present disclosure is directed to the sole structure according to any one of Aspects 70-117, wherein the first side of the sole structure comprises a hydrogel material; optionally wherein the hydrogel material comprises a polyurethane hydrogel, optionally wherein the polyurethane hydrogel is a reaction polymer of a diisocyanate with a polyol; or optionally wherein the hydrogel material comprises a polyamide hydrogel.

In accordance with Aspect 119, the present disclosure is directed to the sole structure of according any one of Aspects 70-118, wherein the hydrogel material has a water cycling weight loss from about 0 wt. percent to about 15 wt. percent as measured using the Water Cycling Test with the Component Sampling Procedure; or optionally wherein the hydrogel material has a water cycling weight loss of less than 15 wt. percent as measured using the Water Cycling Test with the Component Sampling Procedure; or optionally wherein the hydrogel material has a water cycling weight loss of less than 10 wt. percent; or optionally wherein the hydrogel material has a dry-state thickness in the range of about 0.2 mm to about 2.0 mm; or optionally the hydrogel material has a saturated-state thickness that is at least 100 percent greater than the dry-state thickness of the hydrogel material; or optionally wherein the saturated-state thickness of the hydrogel material is at least 200 percent greater than the dry-state thickness of the hydrogel material.

In accordance with Aspect 120, the present disclosure is directed to the sole structure of according to any one of Aspects 70-119, wherein the sole structure has a ground facing side, and the hydrogel material is affixed to the ground facing side of the sole structure.

In accordance with Aspect 121, the present disclosure is directed to the sole structure of according to any one of Aspects 70-120, wherein the sole structure or the chassis comprises a hydrogel material; optionally wherein the sole structure or the chassis comprises a textile, the textile is on the ground facing side of the sole structure, and the textile comprises the hydrogel material; optionally wherein the sole structure further includes an adhesive, a primer, or a tie layer located between the ground facing side and the hydrogel material.

In accordance with Aspect 122, the present disclosure is directed to an article of footwear comprising an upper and a sole structure according to any one of Aspects 70-121.

In accordance with Aspect 123, the present disclosure is directed to the article of footwear according to any one of Aspects 122, wherein the article includes a bond between the sole structure and the upper, and wherein the bond between the sole structure and the upper forms a bite line between the sole structure and the upper.

In accordance with Aspect 124, the present disclosure is directed to the article of footwear according to Aspect 122 or 123, wherein the article further comprises a toe bumper, optionally wherein the toe bumper straddles the bite line at least in the forefoot portion of the upper.

In accordance with Aspect 125, the present disclosure is directed to the article of footwear according to any one of Aspects 122-124, wherein the article of footwear further comprises a toe bumper, and the toe bumper is bonded to the upper, to the sole structure, or to both the upper and the sole structure.

In accordance with Aspect 126, the present disclosure is directed to the article of footwear according to any one of Aspects 122-125, wherein the article of footwear further comprises a toe bumper comprising a second resin composition, wherein the second resin composition is an elastomeric second resin composition, optionally a thermoplastic elastomeric second resin composition.

In accordance with Aspect 127, the present disclosure is directed to the article of footwear according to any one of Aspects 122-126, wherein the second resin composition comprises one or more styrene copolymers, optionally wherein the one or more styrene copolymers comprises a SBS copolymer or a SEBS copolymer.

In accordance with Aspect 128, the present disclosure is directed to the article of footwear according to any one of Aspects 122-127, wherein the second resin composition is a thermoplastic elastomeric second resin composition, and wherein the thermoplastic elastomeric second resin composition is thermally bonded to the polyolefin-based resin composition of the sole structure, or to the upper, or to both the polyolefin-based resin composition of the sole structure and the upper.

In accordance with Aspect 129, the present disclosure is directed to a method of making a polyolefin-based resin composition, the method comprising:

blending a polyolefin copolymer, a polymeric resin modifier, a TPV, and optionally blending any additives to form a blended polyolefin-based resin composition, wherein the polyolefin-based resin composition is a polyolefin-based resin composition according to any one of Aspects 1-69.

In accordance with Aspect 130, the present disclosure is directed to the method of making the polyolefin-based resin composition according to Aspect 129, further comprising extruding and pelletizing the blended polyolefin-based resin composition.

In accordance with Aspect 130, the present disclosure is directed to a blended or pelletized thermoplastic polyolefin-based resin composition manufactured according to Aspect 129 or 130.

In accordance with Aspect 131, the present disclosure is directed to a method of making a sole structure, the method comprising:

extruding or injecting a polyolefin-based resin composition into a mold cavity configured to mold a sole structure for an article of footwear;

solidifying the extruded or injected polyolefin-based resin composition in the mold cavity to form a solidified sole structure; and removing the solidified sole structure from the mold cavity;

wherein the polyolefin-based resin composition is a polyolefin-based resin composition according to any one of Aspects 1-69.

In accordance with Aspect 132, the present disclosure is directed to the method of making the sole structure according to Aspect 131, wherein the solidifying comprising curing the polyolefin-based resin composition using actinic radiation to form a thermoset sole structure.

In accordance with Aspect 133, the present disclosure is directed to the method of making the sole structure according to Aspect 131, wherein the solidifying comprising decreasing a temperature of molten or softened polyolefin-based resin composition to form a solidified thermoplastic sole structure.

In accordance with Aspect 134, the present disclosure is directed to a sole structure manufactured according to any one of Aspects 131-134.

In accordance with Aspect 135, the present disclosure is directed to an article of footwear comprising a sole structure manufactured according to any one of Aspects 131-134.

In accordance with Aspect 136, the present disclosure is directed to a method of making an article of footwear, the method comprising:

bonding an upper for an article of footwear to a sole structure according to any one of Aspects 70 to 121.

In accordance with Aspect 137, the present disclosure is directed to the method according to Aspect 135, wherein the bonding comprises thermally bonding the upper to the polyolefin-based resin composition of the sole structure, optionally by extruding or injecting molten polyolefin-based resin composition onto the upper.

In accordance with Aspect 138, the present disclosure is directed to an article of sporting equipment comprising a polyolefin-based resin composition according to any one of Aspects 1-69.

In accordance with Aspect 139, the present disclosure is directed to a method of making an article of sporting equipment or a component of an article of sporting equipment, the method comprising:

extruding or injecting a polyolefin-based resin composition into a mold cavity configured to mold the article of sporting equipment or the component of an article of sporting equipment;

solidifying the extruded or injected polyolefin-based resin composition in the mold cavity to form a solidified article of sporting equipment or a solidified component of an article of sporting equipment; and removing the solidified article of sporting equipment or the solidified component of the article of sporting equipment from the mold cavity;

wherein the polyolefin-based resin composition is a polyolefin-based resin composition according to any one of Aspects 1-69.

In accordance with Aspect 140, the present disclosure is directed to the method of making the article of sporting equipment or component of an article of sporting equipment according to Aspect 139, wherein the solidifying comprising curing the polyolefin-based resin composition using actinic radiation to form a thermoset article of sporting equipment or a thermoset component of an article of sporting equipment.

In accordance with Aspect 141, the present disclosure is directed to the method of making the article of sporting equipment or component of an article of sporting equipment according to Aspect 139, wherein the solidifying comprising decreasing a temperature of molten or softened polyolefin-based resin composition to form a solidified thermoplastic article of sporting equipment or a solidified thermoplastic component of an article of sporting equipment.

In accordance with Aspect 142, the present disclosure is directed to an article of sporting equipment or a component of an article of sporting equipment manufactured according to any one of Aspects 138-141.

In accordance with Aspect 143, the present disclosure is directed to an article of sporting equipment comprising a component of an article of sporting equipment manufactured according to any one of Aspects 138-141.

In accordance with Aspect 144, the present disclosure is directed to a method of making an article of sporting equipment, the method comprising:

bonding a first component for an article of sporting equipment to a second component for an article of sporting equipment, wherein the first component of sporting equipment comprises a polyolefin-based resin composition according to any one of Aspects 1 to 69.

In accordance with Aspect 145, the present disclosure is directed to the method according to Aspect 144, wherein the bonding comprises thermally bonding the polyolefin-based resin composition of the first component of sporting equipment to the second component of sporting equipment, optionally by extruding or injecting molten polyolefin-based resin composition onto the second component of sporting equipment.

Sole Structures and Articles of Footwear Made Therefrom

In some aspects, the present disclosure is directed to sole structures including a plate containing a polyolefin-based resin composition comprising a polyolefin copolymer, a polymeric resin modifier, and a TPV. The present disclosure also provides articles of footwear including the sole structures. As discussed below, the sole structures or plates containing the polyolefin-based resin compositions desirably exhibit high levels of mechanical strength and yet flexural durability.

In some aspects, forming a strong bond between a surface of the polyolefin-based resin composition and a surface of a second element or component comprising a second resin composition, (e.g. bonding a surface of a plate comprising the polyolefin-based resin composition to a polyurethane-based or polyester-based upper) may create challenges. Therefore, in some aspects, the sole structures include a textile disposed on one or more surfaces comprising the polyolefin-based resin composition. Not wishing to be bound by any particular theory, it is believed that including the textile disposed on one or more surfaces of the polyolefin-based resin composition may lead to improved bonding between the polyolefin-based resin composition and the second resin composition, optionally when the second resin composition is not polyolefin-based (i.e., the second resin composition may be free of polyolefins). In one example, using a textile comprising fibers or yarns formed of a polymeric material having a different surface energy as compared to the surface energy of the polyolefin-based resin composition, such as a polyurethane-based material or a polyester-based material or a polyamide-based material which are more polar than the polyolefin-based resin composition, may facilitate bonding, for example, between an upper which comprises a polymeric material having a surface energy which is closer to the surface energy of the textile than to the surface energy of the polyolefin-based resin composition of the plate, thereby increasing the strength of a bond between the plate and the upper as compared to bonding the plate to the upper without the textile. Using a textile may also provide a textured surface having a greater surface area, providing greater opportunity to form mechanical bonds between the upper and the plate, thereby increasing the strength of a bond between the plate and the upper as compared to using a plate without the textile. As an additional benefit, the textile may be used to provide a decorative or stylistic surface.

Figure 1B:
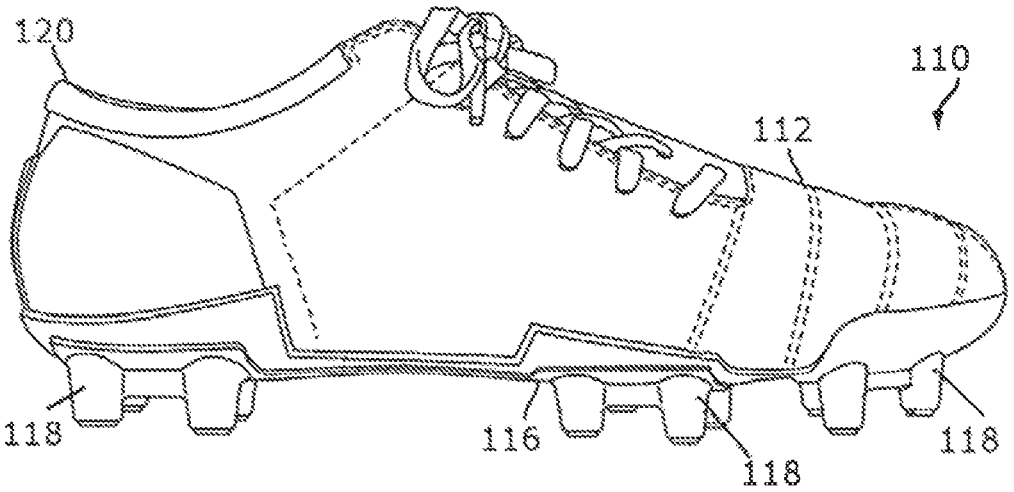
Figure 1C:
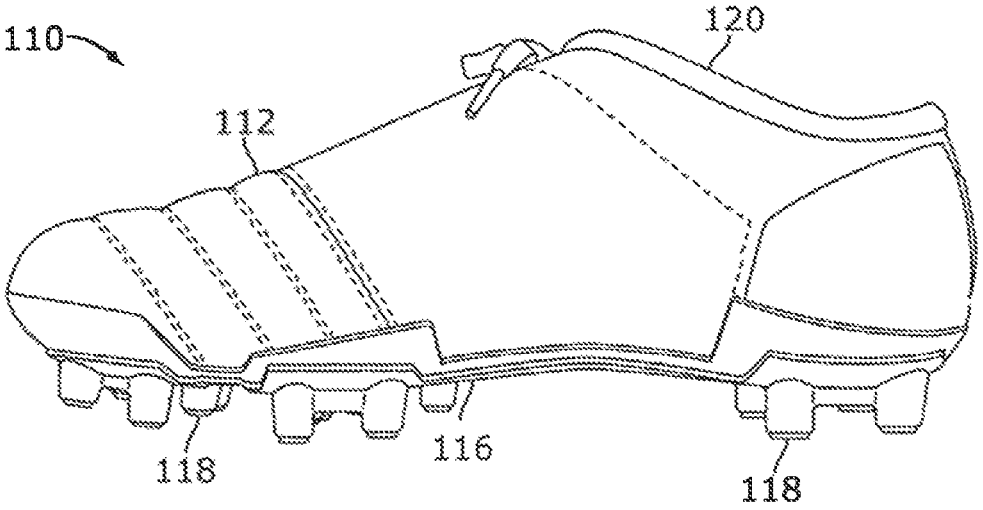
Figure 1D:
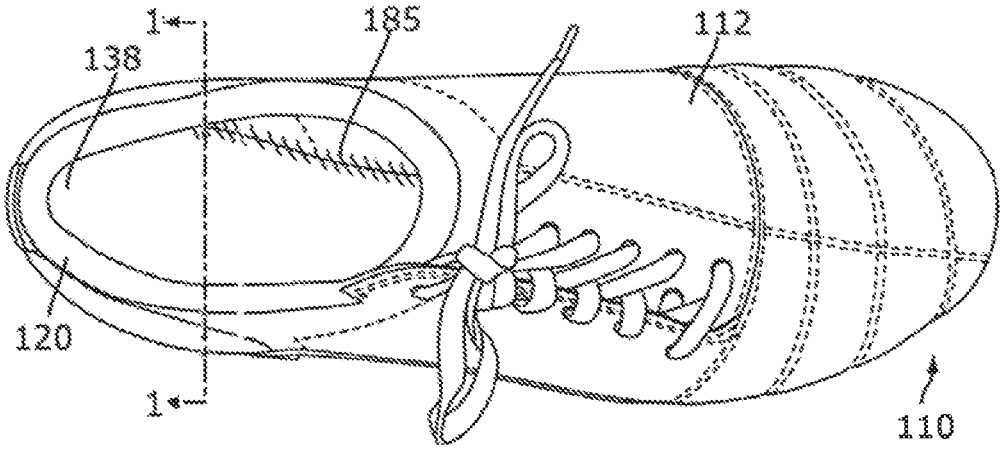
Figure 1E:
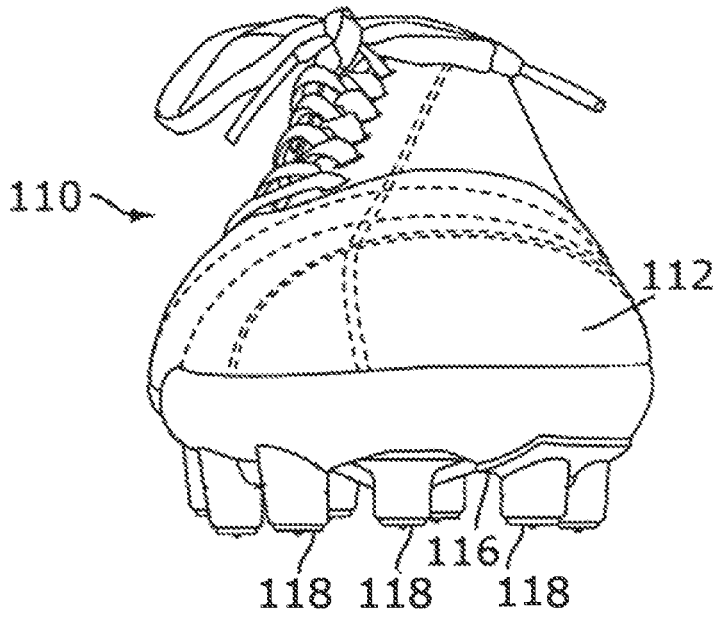
Figure 1F:
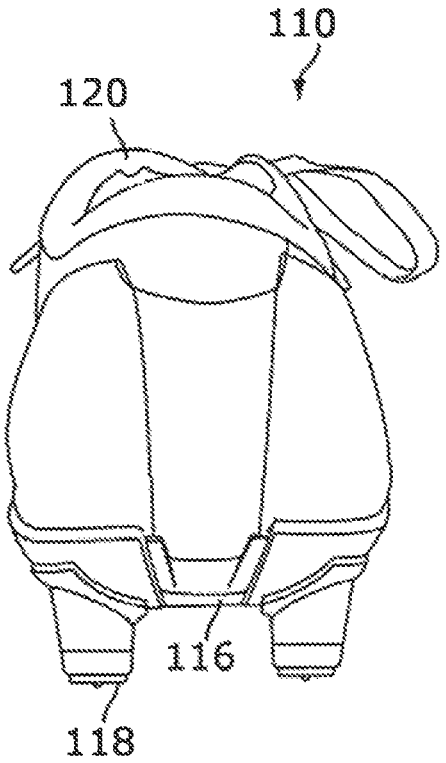

FIG. 1A is a lateral side perspective view of an exemplary cleated article of athletic footwear 110, for example a soccer/futbol boot. As seen in FIG. 1A, the article of footwear 110 includes an upper 112 and a sole structure 113, which includes a plate 116 and a textile 114 disposed on the upper side 152 of the plate. The textile 114 is located between the plate 116 and the upper 112. The plate 116 includes multiple traction elements 118. When worn, traction elements 118 provide traction to a wearer so as to enhance stability. One or more of the traction elements 118 can be integrally formed with the plate, as illustrated in FIG. 1A, or can be removable. Optionally, one or more of the traction elements 118 can include a traction element tip (e.g., a stud tip) (not pictured) configured to be ground-contacting. The traction element tip can be integrally formed with the traction element 118. Optionally, the traction element tip can be formed of a different material (e.g., a metal, or a second resin composition comprising the same TPV as in the polyolefin-based resin composition of the plate, or a second resin composition comprising different polymers than the polyolefin-based resin composition of the sole structure) than the rest of the traction element 118. FIG. 1B is a lateral side elevational view of article of footwear 110. When the article of footwear 110 is worn, the lateral side of the article 110 is generally oriented on the side facing away from the centerline of the wearer's body. FIG. 1C is a medial side elevational view of the article of footwear 110. When the article of footwear 110 is worn, the medial side generally faces toward the centerline of the wearer's body. FIG. 1D is a top view of the article of footwear 110 (with no sock liner in place) and without a lasting board or other board-like member 115, and further shows upper 112. Upper 112 includes a padded collar 120. Alternatively or in addition, the upper can include a region configured to extend up to or over a wearer's ankle (not illustrated). In at least one aspect, upper 112 is tongueless, with the upper wrapping from the medial side of the wearer's foot, over the top of the foot, and under the lateral side portion of the upper, as illustrated in FIG. 1D. Alternatively, the article of footwear can include a tongue (not illustrated). As illustrated in FIG. 1A-1G, the laces of the article of footwear 110 optionally can be located on the lateral side of the article. In other examples, the article of footwear may have a slip-on design or may include a closure system other than laces (not illustrated). FIG. 1E and FIG. 1F are, respectively, front and rear elevational views of the article of footwear 110.

Figure 1G:
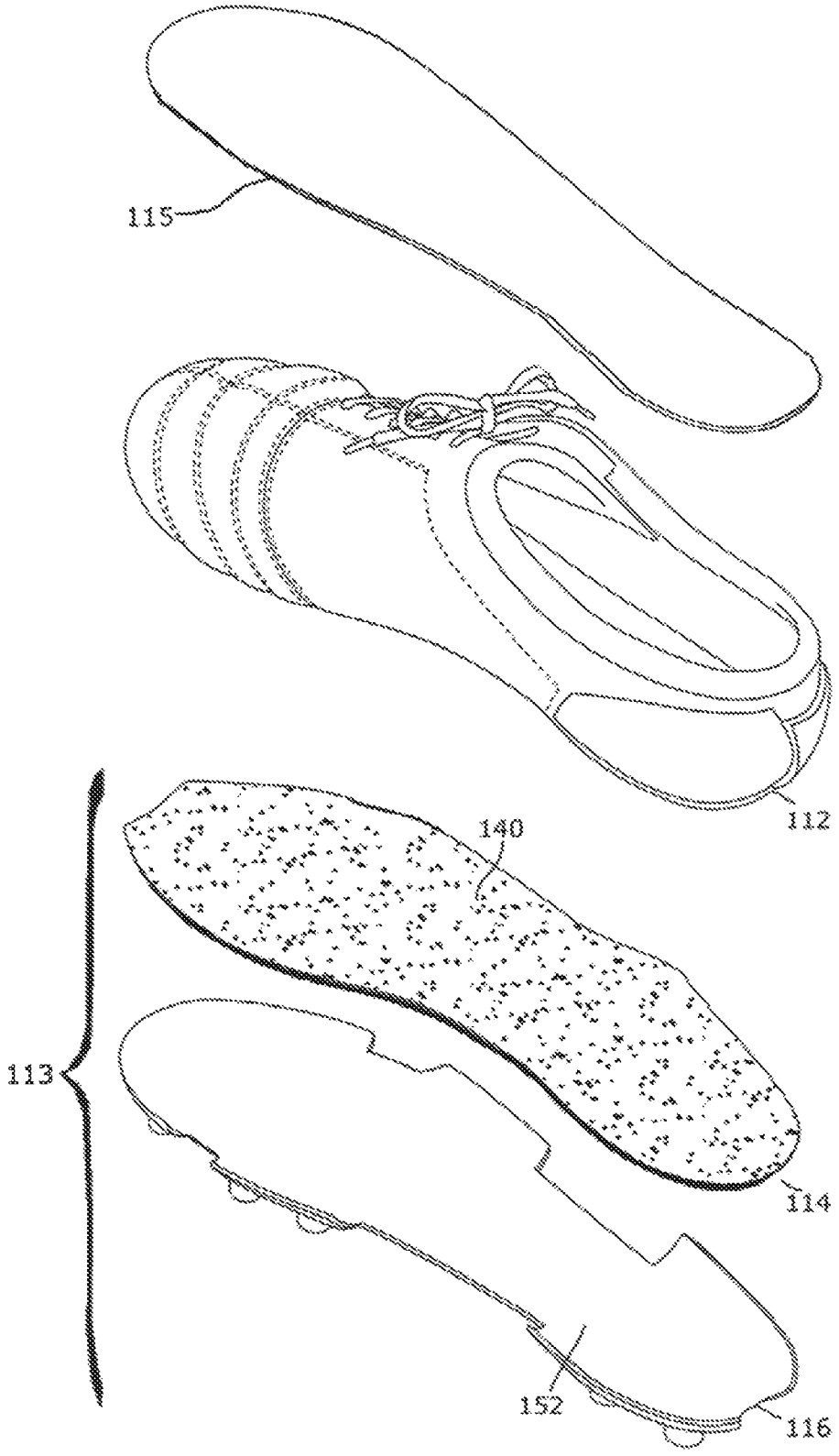
Figure 1H:
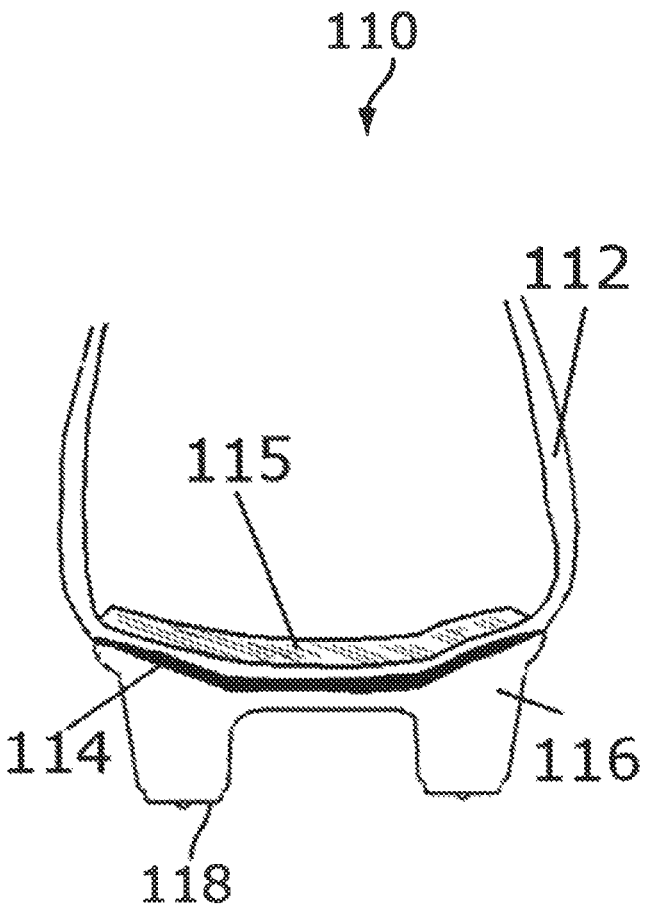

FIG. 1G is an exploded perspective view of the article of footwear 110 showing upper 112, plate 116, and textile 114. As seen in FIG. 1D, upper 112 includes a strobel 138. As illustrated in FIG. 1D, the strobel 138 is roughly the shape of a wearer's foot, and closes the bottom of the upper 112, and is stitched to other components to form the upper 112 along the periphery of the strobel 138 with stitching 185. A lasting board or other board-like member 115 can be located above or below the strobel 138. In some aspects, a lasting board or other board-like member can replace the strobel. The lasting board or other board-like member 115 can extend substantially the entire length of the plate, or can be present in a portion of the length of the plate, such as, for example, in the toe region 130, or in the midfoot region, or in the heel region. However, due to the rigidity and strength of the polyolefin-based resin compositions described herein, it is typically not necessary to include a lasting board or other board-like member, so the article of footwear may be free of a lasting board. Upper 112 including strobel 138 is bonded to the upper surface 140 of the textile 114 (FIGS. 1G-1H). The lower surface 142 of the textile 114 may be bonded to the upper surface 152 of the plate 116 by thermal bonding (e.g., melting and/or softening the different resin compositions so that the polymers present in the different resin compositions become entangled with each other across an interface between the different resin compositions), by injection molding the polyolefin-based resin composition of the plate directly onto the textile, or using an adhesive. The lower surface 142 of the textile 114 may be thermally bonded to the upper surface 152 of the plate 116 by melding polymers in the textile 114 and the polymeric resin of the plate 116, or by applying an adhesive. Alternatively or in addition, upper 112 including strobel 138 may be thermally bonded to the upper surface 140 of the textile 114 by melding polymers of the upper 112 or strobel 138 with the polymers of the plate 116, or by applying an adhesive, such as a water-borne adhesive conventionally used in footwear manufacturing. In any of these examples, the bonding between the components may include mechanical bonding, adhesive bonding, thermal bonding, or any combination thereof.

In at least one aspect, plate 116 and textile 114 are first bonded before upper 112 and/or strobel 138 is bonded to textile 114. In some aspects, the article of footwear 110 can include a removable sock liner (not pictured). As is known in the art, a sock liner conforms to and lines the inner bottom surface of a shoe and is the component contacted by the sole (or socked sole) of a wearer's foot.

Figure 2A:
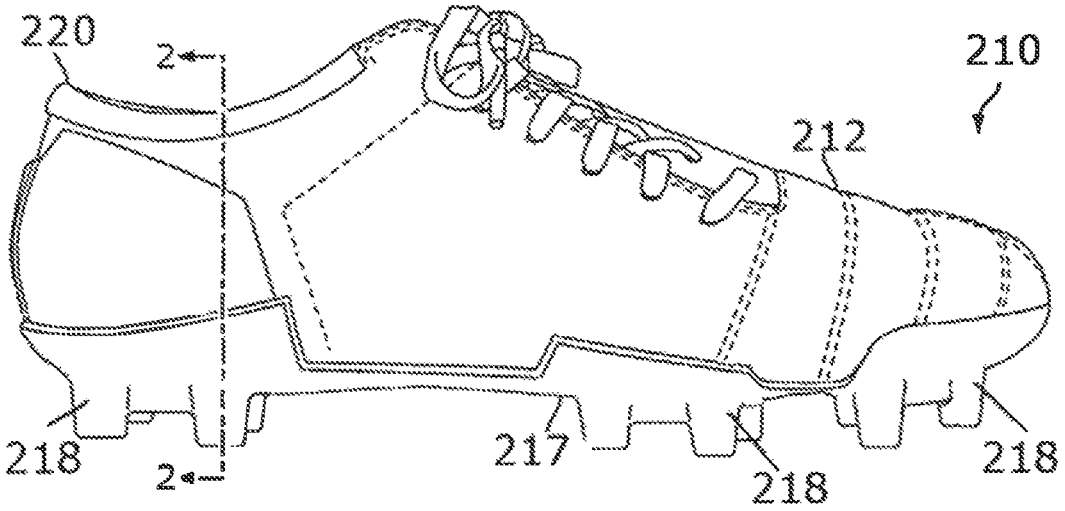
FIGS. 2A-2C depict a second exemplary article of athletic footwear.
Figure 2B:
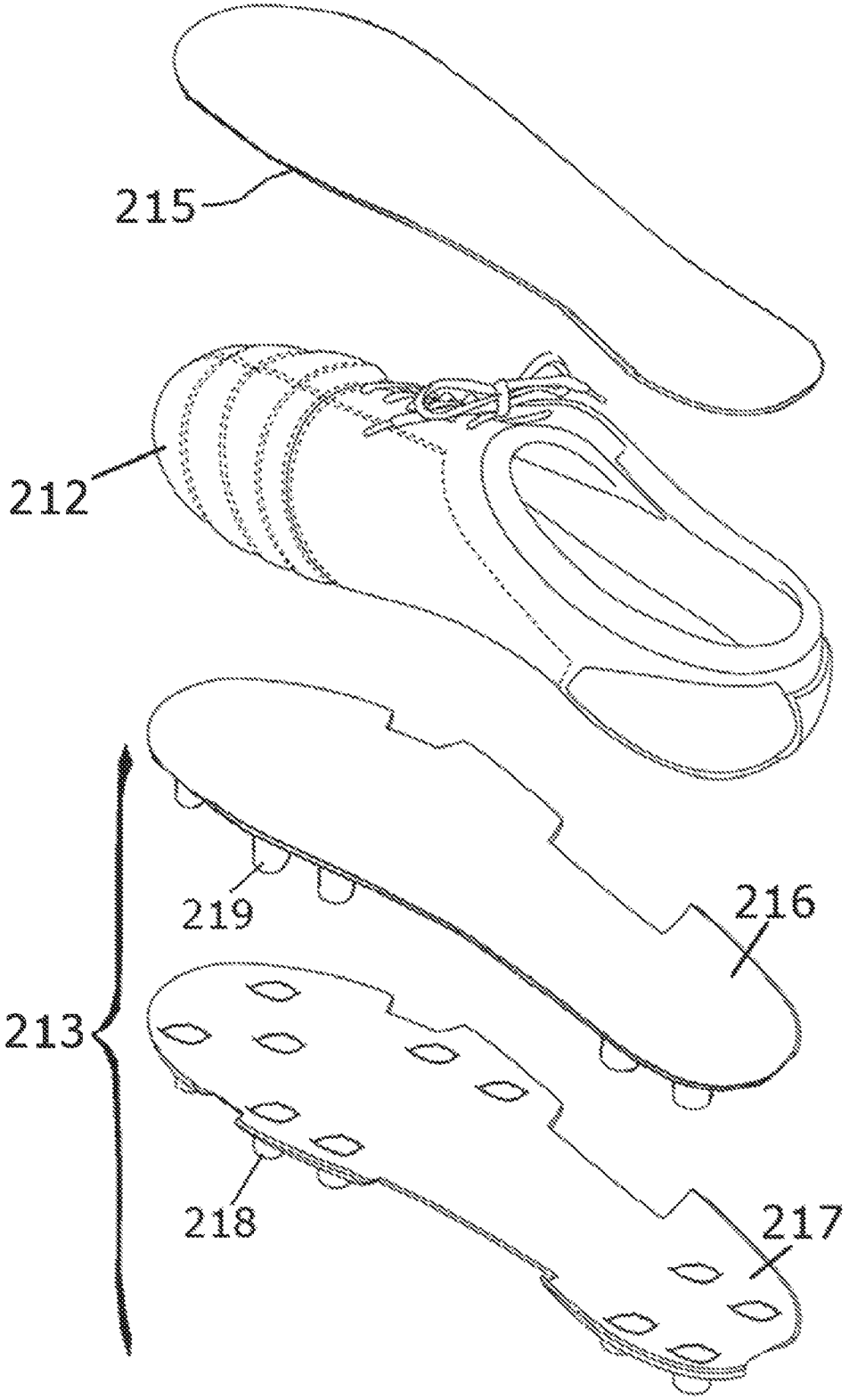
Figure 2C:
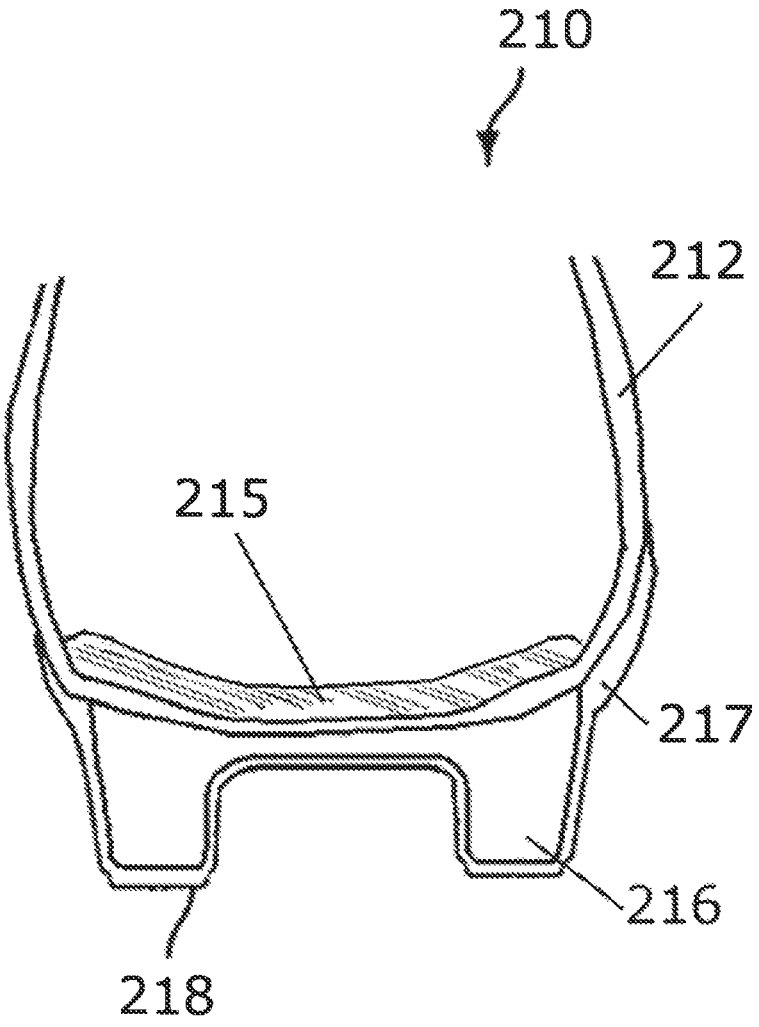

FIGS. 2A-2C depict a second exemplary article of athletic footwear. FIG. 2A is a lateral side elevational view of the exemplary article of athletic footwear. FIG. 2B is an exploded perspective view of the second exemplary article of athletic footwear. FIG. 2C is a sectional view along 2-2 of the second exemplary article of athletic footwear. FIG. 2A is a lateral side elevational view of an exemplary article of footwear 210 that does not have a textile. The article of footwear 210 includes an upper 212 and a sole structure 213 having a plate 216 and a chassis 217. The chassis 217 includes multiple traction elements 218. The traction elements 218 can be formed entirely from the chassis 217 material or, as pictured in FIG. 2B, the traction elements 118 can have a corresponding inner traction element 219 that is formed in the plate 216 and encased by the chassis 217. Optionally, one or more of the traction elements 218 can include a traction element tip (e.g., a stud tip) (not pictured) configured to be ground-contacting. The article of footwear 210 optionally may include a lasting board member 215 which may extend substantially the entire length of the plate 216.

Figure 3:
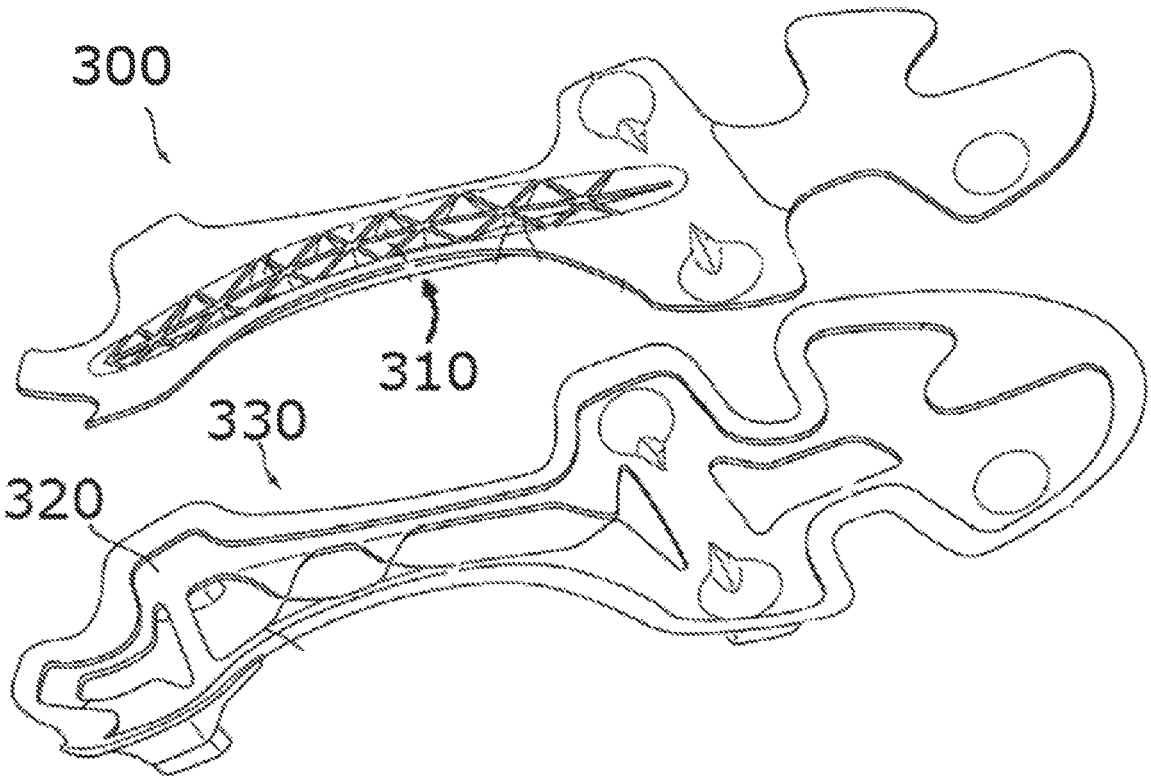
FIG. 3 depicts an exploded view of a third exemplary sole structure having a chassis and a rigid plate providing rigidity without adding substantial amounts of extra material, and therefore maintaining a low weight.

The sole structure may include a plate to provide rigidity, strength, and/or support without substantially adding weight. For example, some exemplary sole structure aspects may include a plate having certain features that provide resistance to vertical bending, lateral bending, and/or torsion. As depicted in FIG. 3, the plate 300 can include a reinforcing rib 310 longitudinally along the plate. The reinforcing rib can include a hollow structure, and thus, may provide rigidity without adding substantial amounts of extra material, and therefore maintains a low weight. The plate 300 can sit within a chassis 330, for example with a recess 320 in the chassis 330.

Figure 4A:
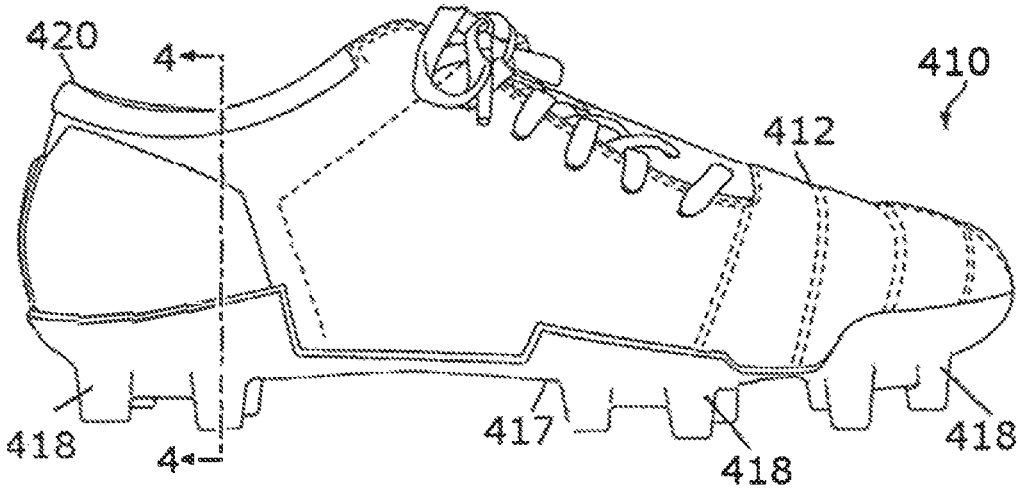
FIGS. 4A-4C depict a fourth exemplary article of athletic footwear.
Figure 4B:
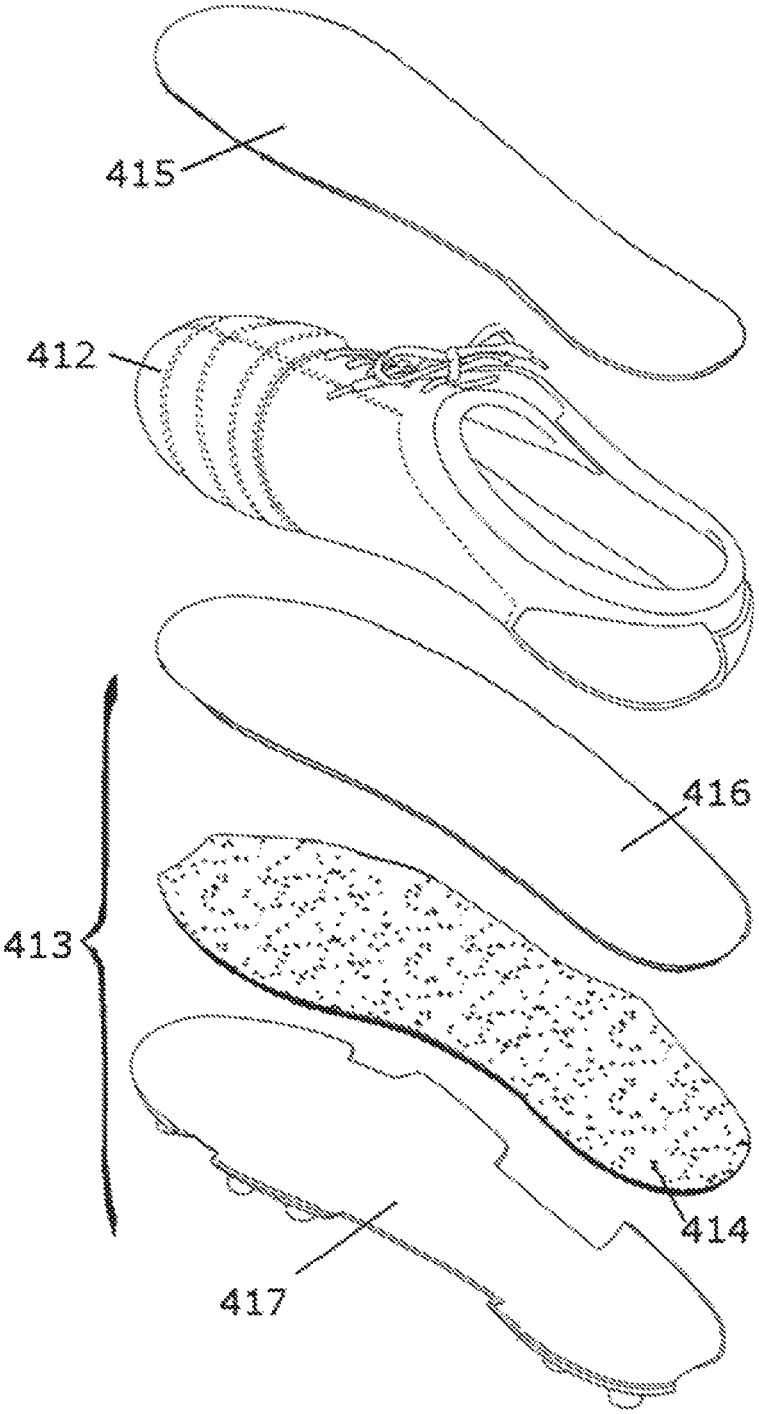
Figure 4C:
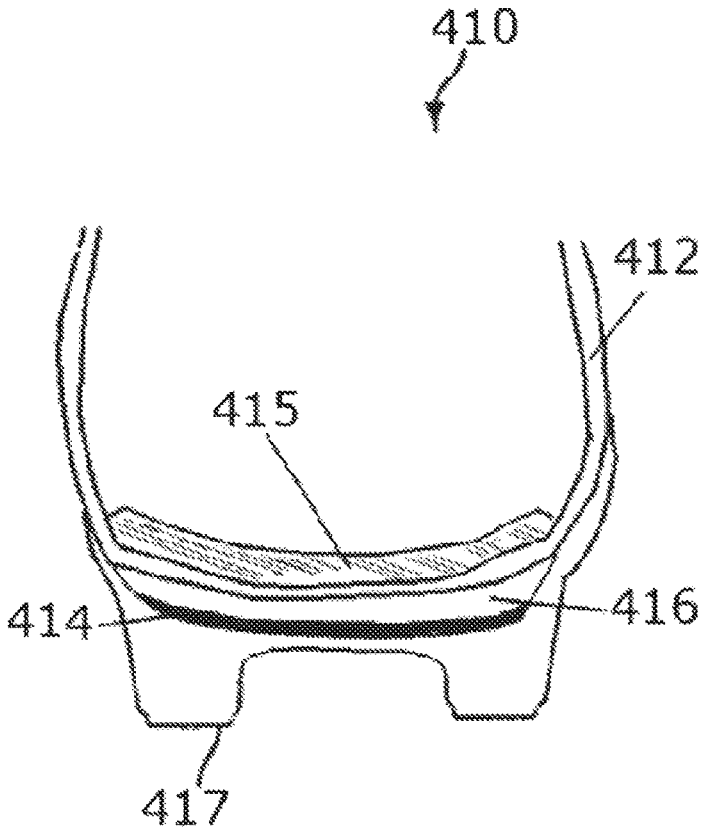

In some aspects, when the sole structure includes a plate and a chassis configured to wrap around the plate and to engage or be attached to an upper when the sole structure is a component of an article of footwear, the sole structure also includes one or more textiles. For example, a textile can be between the plate and the upper and can provide for improved bonding between the plate and the upper. A textile can also be positioned between the plate and the chassis. In aspects where the textile is between the plate and the chassis, the textile can provide for improved adhesion between the plate and the chassis and/or the textile can be a decorative or ornamental textile. In some aspects, the sole structure can include a decorative textile on the exterior or ground facing surface of the chassis. For example, as depicted in FIGS. 4A-4C, the article of footwear 410 includes an upper 412 and a sole structure 413 having a plate 416 and a chassis 417. The chassis 417 includes multiple traction elements 418. The traction elements 418 can be formed entirely from the chassis 417 material as pictured. Optionally, one or more of the traction elements 418 can include a traction element tip (e.g., stud tip) (not pictured) configured to be ground-contacting. A textile 414 is positioned between the plate 416 and the chassis 417. The article of footwear 410 can include a lasting board member 415 which can extend substantially the entire length of the plate 416.

Figure 5A:
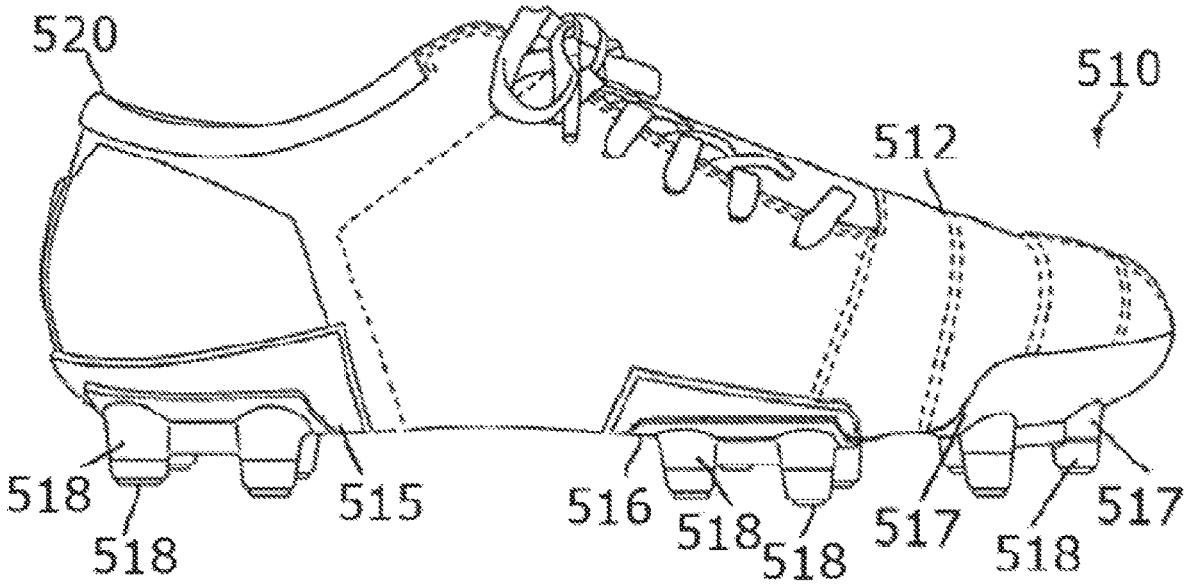
FIGS. 5A-5B depict a fifth exemplary article of athletic footwear.
Figure 5B:
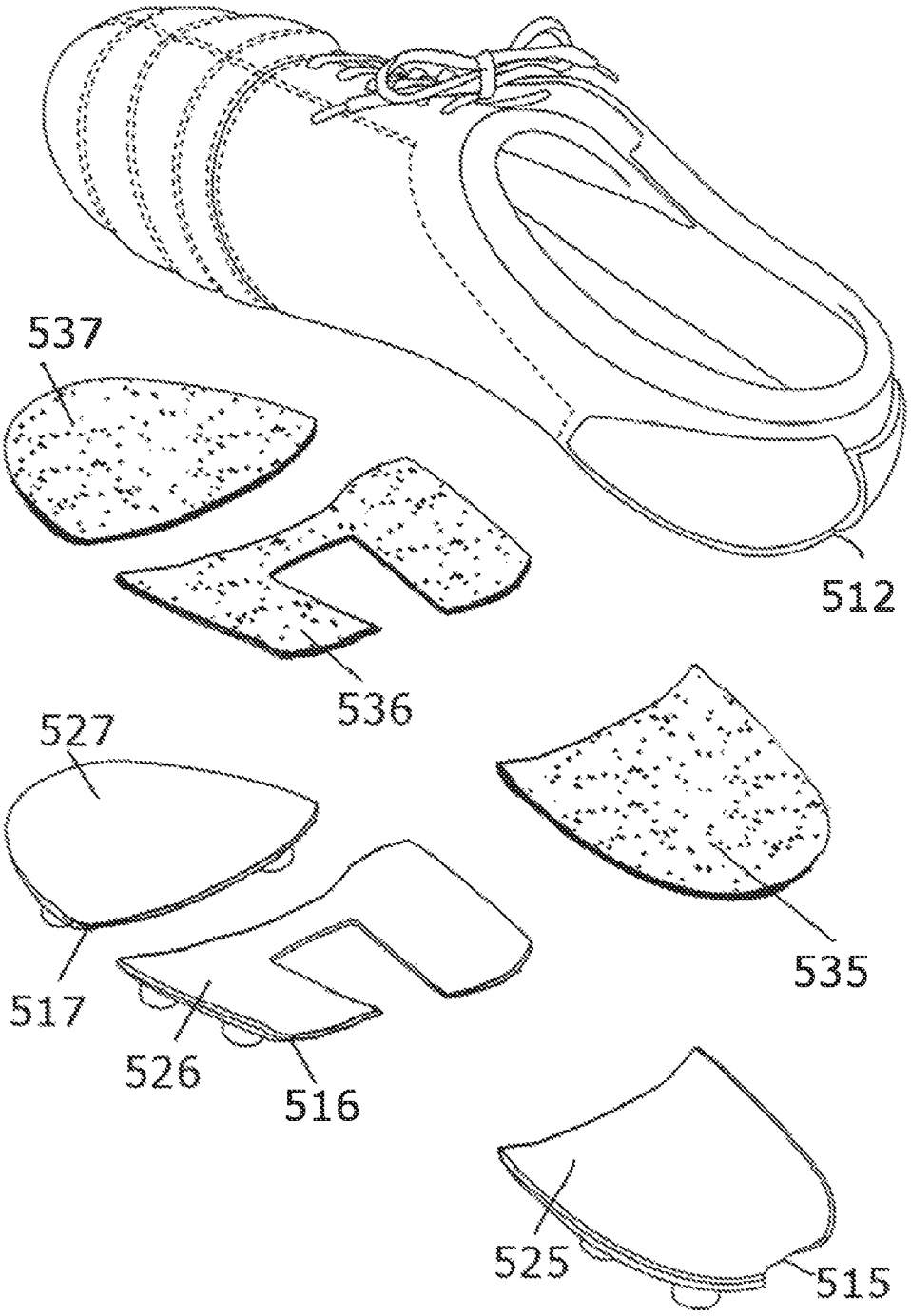

FIG. 5A is a lateral side elevational view of an exemplary article of footwear 510 including separate heel plate 515, midfoot plate 516, and toe plate 517. The article of footwear 510 includes an upper 512 and a heel plate 515, midfoot plate 516, and toe plate 517. Each of the heel plate 515, midfoot plate 516, and toe plate 517 include multiple traction elements 518. When worn, traction elements 518 provide traction to a wearer so as to enhance stability. One or more of the traction elements 518 can be integrally formed with the heel plate 515, midfoot plate 516, and/or toe plate 517, as illustrated in FIG. 5A, or can be removable. FIG. 5B is an exploded perspective view of the article of footwear 510 showing upper 512, heel plate 515, midfoot plate 516, and toe plate 517. In this aspect, the upper surface 525 of the heel plate 515 can include a heel textile 535. The upper surface 527 of the toe plate 517 can include a toe textile 537. Likewise, the upper surface 526 of the midfoot plate 516 includes a midfoot textile 536. The textiles can provide for improved bonding between upper 512, heel plate 515, midfoot plate 516, and toe plate 517.

This disclosure provides a variety of sole structures including a polyolefin-based plate, i.e. including a plate containing a polyolefin-based resin composition comprising a polyolefin copolymer, a polymeric resin modifier, and a TPV as disclosed herein. The plate may comprise or consist of a polyolefin-based resin composition, for example any of the polyolefin-based resin compositions described herein. The sole structures, including plates, may also include a layer of a hydrogel material on an external surface in order to reduce the retention of mud or dirt on the external surface of the sole structure. The hydrogel material may be extruded onto and/or embedded in a textile secured to a side of the sole structure. The hydrogel material may be an elastomeric material containing a cured rubber and a hydrogel material, wherein in the elastomeric material, the hydrogel material is distributed throughout the cured rubber, and at least a portion of the hydrogel material present in the elastomeric material is physically entrapped by the cured rubber. The elastomeric materials can provide for anti-clog properties, reducing the retention of mud or dirt on the ground-facing surface of the plate, optionally mud or dirt which may become lodged adjacent to the shafts of ground-contacting traction elements.

The sole structure may include a second element (e.g., one or more second element, including a plurality of second elements) on a surface of the plate, such as a textile element, a plurality of traction elements, a chassis, a toe bumper, or any combination thereof. The second element may comprise or consist of a polyolefin-based resin composition as disclosed herein. The polyolefin-based resin composition of the second element may comprise or consist of the same polyolefin-based resin composition as the majority of the plate based on the total weight of the plate, or may comprise or consist of a second resin composition as described herein. The second resin composition of the second element may be a polyolefin-based resin composition as described herein but one which differs in the types or concentration of polymers present in the polyolefin-based resin composition of the majority of the sole structure. The second resin composition may comprise a TPV, optionally the same TPV as is present in the polyolefin-based resin composition of the plate, or may comprise a thermoplastic polymer, including a thermoplastic elastomer, optionally the same thermoplastic polymer present in the TPV or in the polyolefin copolymer of the polyolefin-based resin composition of the plate. Use of the same or similar compounds in the second resin composition of the second element may increase the compatibility of the polyolefin-based resin composition of the sole structure with the second resin composition of the second element, thereby increasing the bond strength when the two compositions are bonded to each other, optionally when the two compositions are thermally bonded to each other. Alternatively, the second resin composition of the second element may be free of polyolefins.

The polyolefin-based resin compositions of the present disclosure, or the second resin compositions of the present disclosure, or both, may comprise one or more elastomeric polymers (i.e., elastomers). An "elastomer" may be defined as a material having an elongation at break greater than 400 percent as determined using ASTM D-412-98 at 25 degrees Celsius.

The sole structure may optionally include a textile on one or more surfaces of the plate. For instance, when the plate has a first side and a second side, the first side can be configured to be ground-facing when the plate is a component of an article of footwear and the second side can be configured to be upward facing. In some aspects, the textile is on one or both of the first side and the second side. The textile can provide for improved bonding between the plate and other components of the sole structure, e.g. between the plate and a chassis. The textile can also provide for improved bonding between the plate and the upper when the sole structure is a component of an article of footwear. In some aspects, the textile is a patterned or decorative textile.

The sole structure may optionally include a chassis. In some aspects, the chassis is in combination with one or more textiles in the sole structure, while in some aspects the sole structure includes a chassis and no textile. The chassis can be configured to be on the first side or ground facing side of the plate. In some aspects, the chassis is configured to wrap around the plate and to engage or be attached to an upper when the sole structure is a component of an article of footwear. The chassis can attach to the upper at the bite line.

In some aspects, the second element comprises a plurality of traction elements. The sole structure may include a plurality of traction elements on its ground-facing side. When the sole structure is a plate, the ground-facing side of the plate may include a plurality of traction elements configured to be ground-contacting during wear. All of the traction elements present on the ground facing surface may comprise the same polyolefin-based resin composition as the majority of the sole structure or plate based on its weight. The sole structure or plate may include one or more traction element integrally formed with it (e.g., the one or more integrally formed traction element is molded at the same time as and is connected to other regions of the sole structure or plate), and may consist of the same polyolefin-based resin composition as the other regions of the sole structure or plate. Alternatively or additionally, a region of one or more of the plurality of traction elements may comprise a second resin composition as described herein, such as a stud tip comprising a tip resin composition, while a region of the traction element, such as a shaft region, may consist of the polyolefin-based resin composition of the majority of the sole structure or plate, e.g., a polyolefin-based resin composition as disclosed herein. A sole structure or plate may comprise a first plurality of traction elements integrally formed with it which consist of the polyolefin-based resin composition, and further comprise a second plurality of traction elements, each of the second plurality of traction elements comprising a shaft region consisting of the polyolefin-based resin composition, and a tip region consisting of a second resin composition.

In some aspects, the traction elements are made from the same or nearly the same polyolefin-based resin composition as the plate. In other aspects, the traction elements are made from a second resin composition that is different from the polyolefin-based resin composition of the sole structure or plate. In some aspects, the sole structure includes a chassis and the chassis is made from the second resin composition. The second resin composition may be an elastomeric composition comprising an elastomer, such as a polyolefin elastomer. The second resin composition may be a thermoplastic composition comprising a thermoplastic polymer. The polymer of the second resin composition may include a polystyrene; a polyolefin homopolymer or copolymer such as a polyethylene, an ethylene-α-olefin copolymer, an EPDM rubber, a polybutene, a polyisobutylene, a poly-4-methylpent-1-ene, a polyisoprene, a polybutadiene, an ethylene-methacrylic acid copolymer, or a blend or mixture thereof. In some aspects, the second resin composition includes up to about 20 percent by weight, up to about 10 percent by weight, or less than about 5 percent by weight of a polyolefin based on a total weight of the second resin composition. The second resin can include up to about 20 percent by weight, up to about 10 percent by weight, or less than about 5 percent by weight of polypropylene based on a total weight of the second resin composition. The second resin may comprise at least about 20 percent by weight of a polyolefin, optionally at least about 20 percent by weight of polypropylene, based on a total weight of the second resin composition. The second resin composition can include a TPV, including a TPV of EPDM rubber dispersed in a thermoplastic phase comprising polypropylene. The second resin composition can include a block copolymer comprising a polystyrene block. The block copolymer can be, for example. a copolymer of styrene and one or both of ethylene and butylene, such as an SBS or an SEBS copolymer. In general, the second resin composition may include any polymer that is compatible with the polyolefin-based resin composition of the sole structure, and that has the appropriate durability and mechanical properties.

In particular, the polymer of the second resin composition (e.g. a polystyrene, a polyethylene, an ethylene-α-olefin copolymer, an EPDM rubber, a polybutene, a polyisobutylene, a poly-4-methylpent-1-ene, a polyisoprene, a polybutadiene, an ethylene-methacrylic acid copolymer, or a blend or mixture thereof), as these polymers have been found to bond well to the polyolefin-based resin compositions of the present disclosure.

Additionally, second resin compositions comprising an EPDM rubber dispersed in a thermoplastic phase comprising polypropylene, or containing a block copolymer having a polystyrene block, have been found to be optionally useful in ground-contacting portions of traction elements such as stud tips, as these second resin compositions both bond well to the polyolefin-based resin compositions of the present disclosure, and can provide an even higher level of abrasion-resistance than the polyolefin-based resin compositions of the present disclosure, which may be desired in the ground-contacting portions of traction elements.

The sole structure, including a plate, may further comprise a toe bumper, such as a toe bumper secured to a perimeter of the plate in the toe region. The use of a toe bumper can further protect the toe region of the plate from scratching, fracturing and/or chunking. The composition of the toe bumper may be softer, or more elastic, or both softer and more elastic, as compared to the polyolefin-based resin composition of the plate. The toe bumper may be integrally formed with the plate, or may be a separately formed element, such as a rand. The composition of the toe bumper may comprise the same polyolefin copolymer, or the same TPV, or both, as the polyolefin-based resin composition of the plate. When the toe bumper composition comprises the same polyolefin copolymer and the same TPV as the polyolefin-based resin composition of the plate, the weight percent of the polyolefin copolymer, or of the TPV, or of both the polyolefin copolymer and the TPV differ from their weight percentages in the polyolefin-based resin composition of the sole structure or plate.

In some aspects, the sole structures include a toe bumper secured on the toe portion of the sole structure. In one aspect, the toe bumper straddles the biteline at least in the forefoot portion of the upper. In another aspect, the toe bumper is bonded to the upper, to the plate, or to both the upper and the plate.

Figure 6:
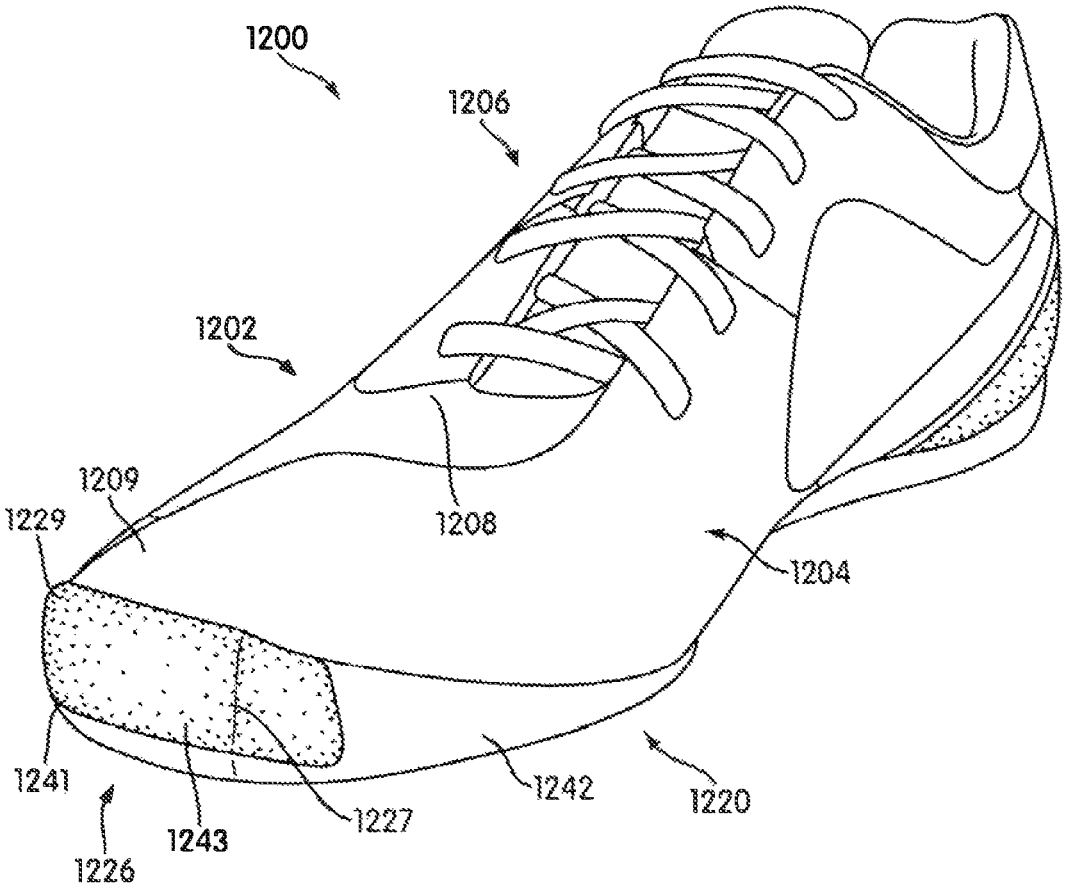
FIG. 6 is an isometric view of an article of footwear described herein with a toe bumper.
Figure 7:
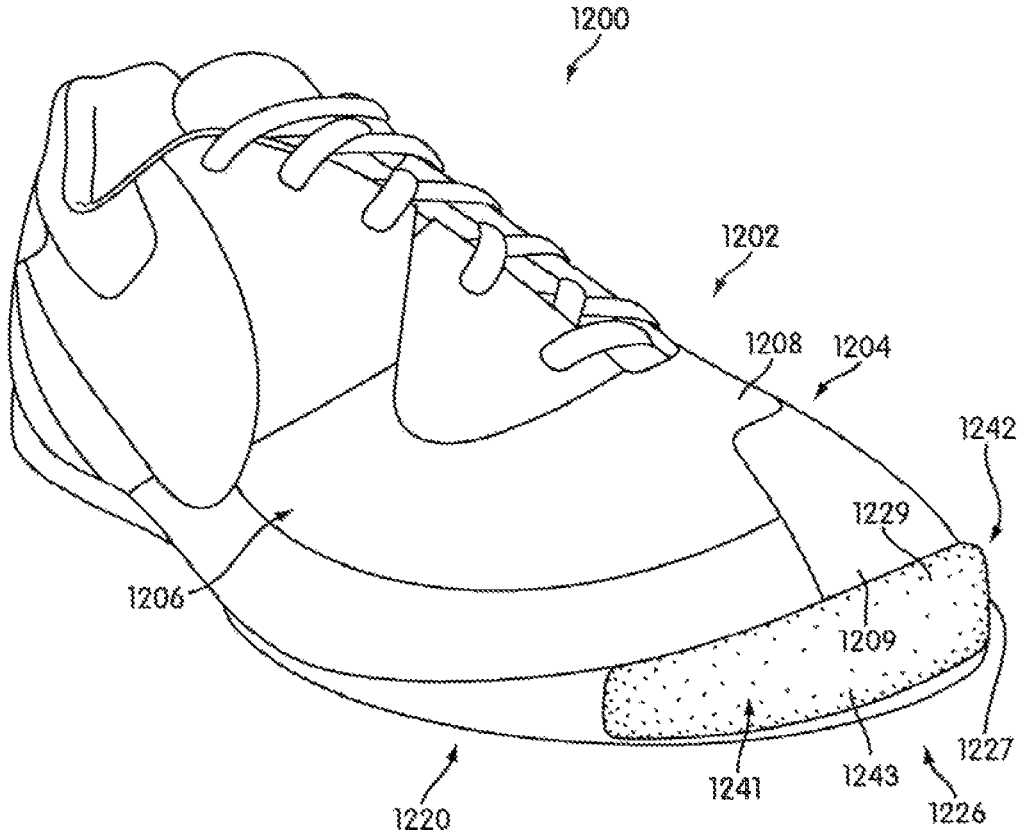
FIG. 7 is an isometric view of an article of footwear described herein with a toe bumper.
Figure 8:
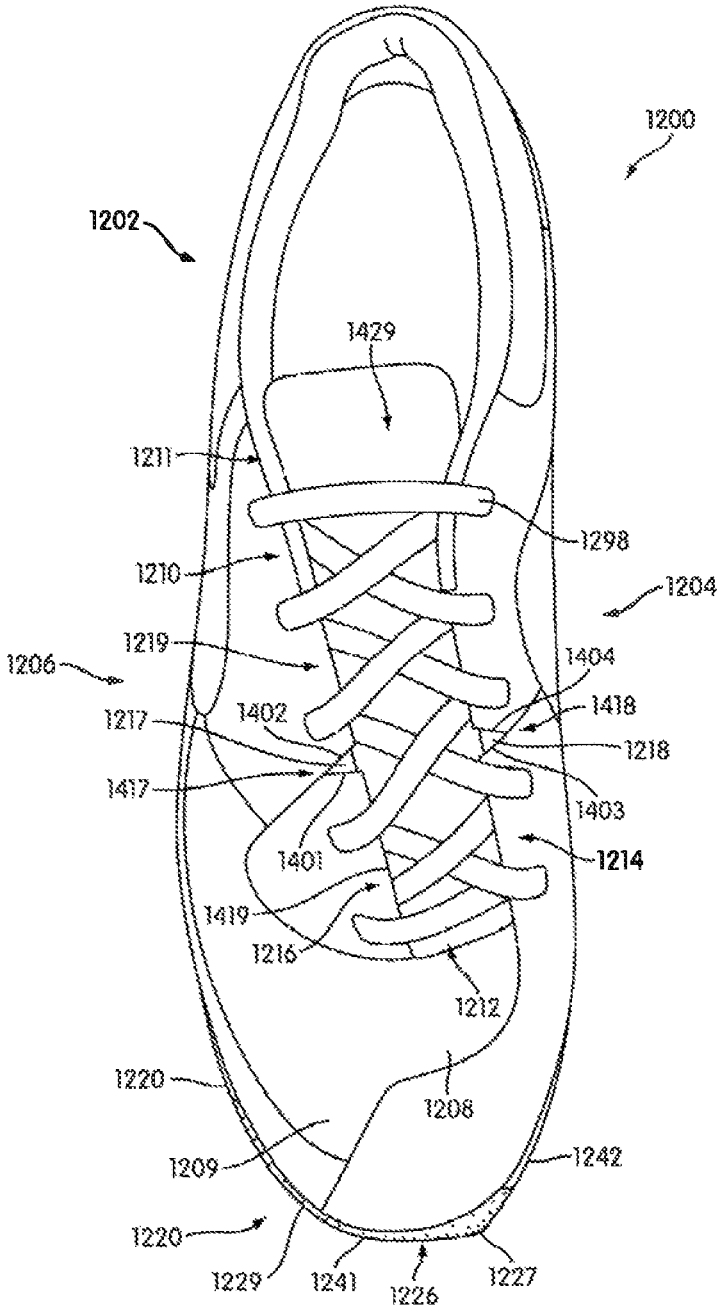
FIG. 8 is a top view of an article of footwear described herein with a toe bumper.

FIGS. 6-8 illustrate an exemplary article of footwear 1200 including provisions for contacting a ball at a toe portion of article 1200. In this aspect, article of footwear 1200 includes upper 1202 and sole structure 1220. Generally, upper 1202 can be any type of upper with any design, shape, size and/or color. In this case, upper 1202 includes medial portion 1204 and lateral portion 1206. In addition, upper 1202 includes intermediate portion 1208 disposed between medial portion 1204 and lateral portion 1206. Also, upper 1202 includes toe portion 1209.

Sole structure 1220 includes front portion 1226. In particular, front portion 1226 may extend upward from a bottom surface of sole structure 1220. This configuration may dispose front portion 1226 adjacent to toe portion 1209 of upper 1202. With this configuration, front portion 1226 can contact a ball during striking or passing.

The front portion 1226 of sole structure 1220 may include toe bumper 1229. Generally, toe bumper 1229 may be disposed adjacent to toe portion 1209 of upper 1202. Furthermore, toe bumper 1229 may extend from lateral portion 1206 to medial portion 1204 of toe portion 1209. In one aspect, toe bumper 1229 may be configured with a shape that increases the surface area of front portion 1226 to assist in contacting a ball during passing or striking.

Generally, a toe bumper can be configured with any shape to increase the surface area of a front portion and/or toe portion of an article. In some aspects, a toe bumper may be configured with a generally symmetric shape. In other words, a toe bumper may cover a medial portion and a lateral portion of an article in a substantially similar manner. For example, a toe bumper may be configured with a curved shape that generally follows the contours of a toe portion of an article. In other aspects, a toe bumper can be configured with an asymmetrical shape. In some cases, a toe bumper may be configured with an asymmetrical shape that provides more surface area on a medial portion than a lateral portion of an article. In other cases, a toe bumper can include an asymmetrical shape with more surface area on a lateral portion than a medial portion of an article. In a preferred embodiment, a toe bumper is configured with an asymmetrical shape that includes a protrusion.

In one aspect, toe bumper 1229 includes protrusion 1227 that extends outward slightly from toe portion 1209 with a generally convex shape, as illustrated in FIG. 8. Generally, protrusion 1227 may be disposed on any portion of toe bumper 1229. In some aspects, protrusion 1227 may be disposed on medial portion 1204 of toe portion 1209. In other aspects, protrusion 1227 may be disposed on lateral portion 1206 of toe portion 1209. In still other aspects, protrusion 1227 may be disposed in the middle of toe portion 1209. In one aspect, protrusion 1227 may be disposed adjacent to toe portion 1209 in approximately the location of a big toe of a foot inserted in article 1200. As seen in FIG. 8, the location of protrusion 1227 provides toe bumper 1229 with an asymmetrical shape.

In one aspect, toe bumper 1229 includes standard curved portion 1241 and flattened curved portion 1242 that are separated by protrusion 1227. Standard curved portion 1241 may be associated with lateral portion 1206 and intermediate portion 1208 of upper 1202. Similarly, flattened curved portion 1242 can be associated with medial portion 1204.

In one aspect, standard curved portion 1241 and flattened curved portion 1242 may be associated with different types of curvature. In particular, flattened curved portion 1242 includes a generally flat shape that may be associated with less surface area than a curved shape. Furthermore, standard curved portion 1241 is configured with a curved shape that is configured to follow the contour of toe portion 1209. This asymmetrical arrangement of toe bumper 1229 can provide a greater surface area for standard curved portion 1241 associated with lateral portion 1206. This arrangement can be optionally helpful for indoor soccer players using lateral portion 1206 of toe portion 1209 to make short and medium distance passes in a "give and go" passing situation. By creating more surface area, standard curved portion 1241 can provide better accuracy for a player passing a ball with lateral portion 1206 of toe portion 1209.

In other aspects, the toe bumper can be made of a or second resin composition as disclosed herein. The toe bumper may be made of a material that is generally stiffer than the polyolefin-based resin composition of the sole structure. The toe bumper may be made of a softer material than the polyolefin-based resin composition of the sole structure. Toe bumper may be made of a stiffer material than the polyolefin-based resin composition of the sole structure in order to increase support for toe portion during contact with a ball.

In other aspects, the second resin composition of the toe bumper comprises one or more thermoplastic elastomers. The one or more thermoplastic elastomers may include a thermoplastic copolyester elastomer, a thermoplastic polyether block amide elastomer, a thermoplastic polyurethane elastomer, a polyolefin based-copolymer elastomer, a thermoplastic styrenic copolymer elastomer, a thermoplastic ionomer elastomer, or any combination thereof. The second resin composition of the toe bumper may comprise a thermoplastic elastomeric styrenic copolymer. The thermoplastic elastomeric styrenic copolymer of the second resin composition may include a styrene butadiene styrene (SBS) block copolymer, a styrene ethylene/butylene styrene (SEBS) resin, a styrene acrylonitrile (SAN) resin, or any combination thereof. The polyolefin-based resin composition of the sole structure may comprises a thermoplastic elastomeric polyester polyurethane, a thermoplastic polyether polyurethane, or any combination thereof. In some aspects, the thermoplastic elastomeric polyester polyurethane can be an aromatic polyester polyurethane, an aliphatic polyester polyurethane, or a combination thereof.

In certain aspects, the thermoplastic elastomer is a thermoplastic elastomeric styrenic copolymer. Examples of these copolymers include, but are not limited to, styrene butadiene styrene (SBS) block copolymer, a styrene ethylene/butylene styrene (SEBS) resin, a polyacetal resin (POM) a styrene acrylonitrile resin (SAN), or a blend, alloy, or compound thereof. Exemplary commercially available thermoplastic elastomeric styrenic copolymers include MONOPRENE IN5074, SP066070, and SP16975 (Teknor Apex, Pawtucket, RI., USA), which are styrene ethylene butylene styrene (SEBS) resins. In some aspects, blends, alloys, and compounds should be melt compatible or can be compatibilized with additives, oils, or grafted chemical moieties in order to achieve miscibility. In other aspects, the polyolefin-based resin composition or the second resin composition is free of compatibilizing additives, oils, or grafted chemical moieties.

In one aspect, the thermoplastic elastomeric styrenic copolymer includes at least one block as illustrated below in Formula A:

(Formula A)

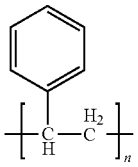

In another aspect, the thermoplastic elastomeric styrenic copolymer can be a SBS block copolymer comprising a first polystyrene block (block m of Formula B), a polybutadiene block (block o of Formula B), and a second polystyrene block (block p of Formula B), wherein the SBS block copolymer has the general structure shown in Formula B below:

(Formula B)

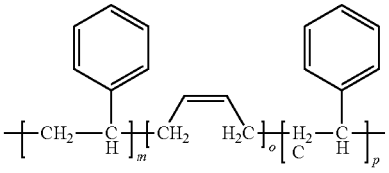

In another aspect, the thermoplastic elastomeric styrenic copolymer can be a SEBS block copolymer comprising a first polystyrene block (block x of Formula C), a polyolefin block (block y of Formula C), wherein the polyolefin block comprises alternating polyethylene blocks (block v of Formula C) and polybutylene blocks (block w of Formula C), and a second polystyrene block (block z of Formula C) as seen in Formula C below.

(Formula C)

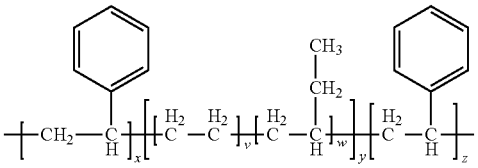

In one aspect, SEBS polymers have a density from about 0.88 grams per cubic centimeter to about 0.92 grams per cubic centimeter. In a further aspect, SEBS polymers can be as much as 15 to 25 percent less dense than cross-linked rubbers, cross-linked polyurethanes, and thermoplastic polyurethane materials. In a further aspect, a less dense coating composition offers weight savings and per part cost savings for the same material of volume employed while achieving similar performance.

In one aspect, the second resin composition, including the second resin composition of the toe bumper or of a traction element, can be associated with different coefficients of friction. In some cases, the second resin composition can have a greater coefficient of friction than the sole structure. In other words, the second resin composition can be stickier than the polyolefin-based resin composition of the sole structure. In other aspects, the second resin composition can have a lower coefficient of friction than the polyolefin-based resin composition of the sole structure. In other words, the second resin composition can be slicker than the polyolefin-based resin composition of the sole structure. In one aspect, the second resin composition has a greater coefficient of friction than the polyolefin-based resin composition of the sole structure in order to facilitate contact with a ball.

In some aspects, the toe bumper may include additional provisions to increase traction between the article of footwear and a ball in order to increase the accuracy of kicks and passes. Referring to FIGS. 6-7, toe bumper 1229 includes textured surface 1243. Textured surface 1243 can be configured in any manner. In some aspects, textured surface 1243 may include one or more divots. In other aspects, textured surface 1243 can include one or more bumps. In this aspect, textured surface 1243 comprises small bumps that bulge outward from toe bumper 1229. In particular, these small bumps may be substantially evenly spaced over the entirety of toe bumper 1229. Textured surface 1243 assists a player in contacting a ball by providing a high coefficient of friction with the ball.

Generally, the toe bumper may be associated with the sole structure in any manner. In some aspects, the toe bumper may be integrally formed with the sole structure. In other aspects, the toe bumper may be attached to the sole structure through any manner known in the art including, but not limited to adhesives and stitching. In this aspect, the toe bumper is attached to front portion through stitching.

In another aspect, the toe bumper material comprises a thermoplastic elastomeric material, and wherein the thermoplastic elastomeric material is thermally bonded to the plate forming the sole structure, or to the upper, or to both the plate and the upper.

Resin Compositions

A variety of resin compositions, including polyolefin-based resin compositions, are described herein. The polyolefin-based resin compositions have the durability and resistance to fracturing, chunking, and cracking suitable for use in the articles and components described herein. As described herein, a polyolefin-based resin composition includes a polyolefin copolymer (e.g., one or more polyolefin copolymer, a polymeric resin modifier (e.g., one or more polymeric resin modifier), and a thermoplastic vulcanizate (TPV) (e.g., one or more TPV).

The polyolefin-based resin compositions may include a single type of a polyolefin copolymer, or may include two or more of a variety of polyolefin copolymers. The copolymer or copolymers can be alternating copolymers or random copolymers or block copolymers or graft copolymers. In some aspects, the copolymers are random copolymers. In some aspects, the copolymer includes a plurality of repeat units, with each of the plurality of repeat units individually derived from an alkene monomer having about 1 to about 6 carbon atoms. In other aspects, the copolymer includes a plurality of repeat units, with each of the plurality of repeat units individually derived from a monomer selected from the group consisting of ethylene, propylene, 4-methyl-1-pentene, 1-butene, 1-octene, and a combination thereof. In some aspects, the polyolefin copolymer includes a plurality of repeat units each individually selected from Formula 1A-1D. In some aspects, the polyolefin copolymer includes a first plurality of repeat units having a structure according to Formula 1A, and a second plurality of repeat units having a structure selected from Formula 1B-1D.

Formula 1A

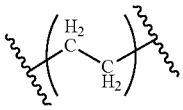

Formula 1B

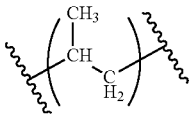

Formula 1C

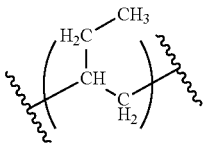

-continued

Formula 1D

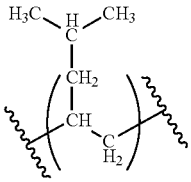

In some aspects, the polyolefin copolymer includes a plurality of repeat units each individually having a structure according to Formula 2

Formula 2

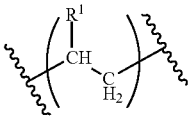

where $R^1$ is a hydrogen or a substituted or unsubstituted, linear or branched, $C_1$-$C_{12}$ alkyl. $C_1$-$C_6$ alkyl, $C_1$-$C_3$ alkyl, $C_1$-$C_{12}$ heteroalkyl, $C_1$-$C_6$ heteroalkyl, or $C_1$-$C_3$ heteroalkyl. In some aspects, each of the repeat units in the first plurality of repeat units has a structure according to Formula 1A above, and each of the repeat units in the second plurality of repeat units has a structure according to Formula 2 above.

In some aspects, the polyolefin copolymer is a random copolymer of a first plurality of repeat units and a second plurality of repeat units, and each repeat unit in the first plurality of repeat units is derived from ethylene and the each repeat unit in the second plurality of repeat units is derived from a second olefin. In some aspects, the second olefin is an alkene monomer having about 1 to about 6 carbon atoms. In other aspects, the second olefin includes propylene, 4-methyl-1-pentene, 1-butene, or other linear or branched terminal alkenes having about 3 to 12 carbon atoms. In some aspects, the polyolefin copolymer contains about 80 percent to about 99 percent, about 85 percent to about 99 percent, about 90 percent to about 99 percent, or about 95 percent to about 99 percent polyolefin repeat units by weight based upon a total weight of the polyolefin copolymer. In some aspects, the polyolefin copolymer consists essentially of polyolefin repeat units. In some aspects, polymers in the polyolefin-based resin composition may consist essentially of polyolefin polymers, meaning that all the polymers present in the polyolefin-based resin composition are polyolefin polymers (i.e., all the polymers are polyolefin homopolymers or polyolefin copolymers). Polymers in the polyolefin-based resin composition may consist essentially of polyolefin copolymers, meaning that all the polymers present in the polyolefin-based resin composition are polyolefin copolymers.

The polyolefin copolymer can include ethylene, i.e. can include repeat units derived from ethylene such as those in Formula 1A. In some aspects, the polyolefin copolymer includes about 1 percent to about 5 percent, about 1 percent to about 3 percent, about 2 percent to about 3 percent, or about 2 percent to about 5 percent ethylene by weight based upon a total weight of the polyolefin copolymer.

The polyolefin-based resin compositions can be made without the need for polyurethanes and/or without the need for polyamides. For example, in some aspects the polyolefin copolymer is substantially free of polyurethanes. In some aspects, the polymer chains of the polyolefin copolymer are substantially free of urethane repeat units. In some aspects, the polyolefin-based resin composition is substantially free of polymer chains including urethane repeat units. In some aspects, the polyolefin copolymer is substantially free of polyamide. In some aspects, the polymer chains of the polyolefin copolymer are substantially free of amide repeat units. In some aspects, the polyolefin-based resin composition is substantially free of polymer chains including amide repeat units.

In some aspects, the polyolefin copolymer includes polypropylene or is a polypropylene copolymer. In some aspects, the polymeric component of the polyolefin-based resin composition (i.e., the portion of the polyolefin-based resin composition that is formed by all of the polymers present in the composition) consists essentially of polypropylene copolymers. In some aspects the polyolefin-based resin composition is provided including a polypropylene copolymer, and an effective amount of a polymeric resin modifier, wherein the polyolefin-based resin composition has an abrasion loss as described above, and wherein the effective amount of the polymeric resin modifier is an amount effective to allow the polyolefin-based resin composition to pass a flex test pursuant to the Cold Ross Flex Test using the Plaque Sampling Procedure. In some aspects, the effective amount of the polymeric resin modifier is an amount effective to allow the polyolefin-based resin composition to pass a flex test pursuant to the Cold Ross Flex Test using the Plaque Sampling Procedure without a significant change in an abrasion loss as compared to an abrasion loss of a second polyolefin-based resin composition identical to the polyolefin-based resin composition (i.e., a comparator resin composition) except without the polymeric resin modifier when measured pursuant to ASTM D 5963-97a using the Material Sampling Procedure.

The polypropylene copolymer can include a random copolymer, e.g. a random copolymer of ethylene and propylene. The polypropylene copolymer can include about 80 percent to about 99 percent, about 85 percent to about 99 percent, about 90 percent to about 99 percent, or about 95 percent to about 99 percent propylene repeat units by weight based upon a total weight of the polypropylene copolymer. In some aspects, the polypropylene copolymer includes about 1 percent to about 5 percent, about 1 percent to about 3 percent, about 2 percent to about 3 percent, or about 2 percent to about 5 percent ethylene by weight based upon a total weight of the polypropylene copolymer. In some aspects, the polypropylene copolymer is a random copolymer including about 2 percent to about 3 percent of a first plurality of repeat units by weight and about 80 percent to about 99 percent by weight of a second plurality of repeat units based upon a total weight of the polypropylene copolymer; wherein each of the repeat units in the first plurality of repeat units has a structure according to Formula 1A above and each of the repeat units in the second plurality of repeat units has a structure according to Formula 1B above.

In one aspect, the polypropylene copolymer is a random copolymer of propylene with about 2.2 percent by weight (wt percent) ethylene is commercially available under the tradename "PP9054" from ExxonMobil Chemical Company, Houston, Tex. It has a MFR (ASTM-1238D, 2.16 kilograms, 230 degrees Celsius.) of about 12 grams/10 minutes and a density of 0.90 grams/cubic centimeter ($g/cm^3$).

In one aspect, the polypropylene copolymer is a random copolymer of propylene with about 2.8 percent by weight (wt percent) ethylene and is commercially available under the tradename "PP9074" from ExxonMobil Chemical Company, Houston, Tex. It has a MFR (ASTM-1238D, 2.16 kilograms, 230 degrees Celsius.) of about 24 grams/10 minutes and a density of 0.90 grams/cubic centimeter ($g/cm^3$).

In one aspect, an effective amount of the resin modifier is present in the polyolefin-based resin composition in order to provide improved flexural durability while maintaining a suitable abrasion resistance. For example, in some aspects the effective amount of the polymeric resin modifier is an amount effective to allow the polyolefin-based resin composition to pass a flex test pursuant to the Cold Ross Flex Test using the Plaque Sampling Procedure. At the same time, the polyolefin-based resin composition can still have a suitable abrasion loss when measured pursuant to ASTM D 5963-97a using the Material Sampling Procedure. In some aspects, the otherwise same polyolefin-based resin composition (i.e., a comparator resin composition) except without the polymeric resin modifier does not pass the cold Ross flex test using the Material Sampling Procedure.

The polymeric resin modifier can provide improved flexural strength, toughness, creep resistance, or flexural durability without a significant loss in the abrasion resistance. In some aspects, a polyolefin-based resin composition is provided including a polyolefin copolymer, a TPV, and an effective amount of a polymeric resin modifier, wherein the effective amount of the polymeric resin modifier is an amount effective to allow the polyolefin-based resin composition to pass a flex test pursuant to the Cold Ross Flex Test using the Plaque Sampling Procedure without a significant change in an abrasion loss as compared to an abrasion loss of a second polyolefin-based resin composition identical to the polyolefin-based resin composition except without the polymeric resin modifier when measured pursuant to ASTM D 5963-97a using the Material Sampling Procedure. In other words, in some aspects, the effective amount of the polymeric resin modifier is an amount which is sufficient to produce a polyolefin-based resin composition that does not stress whiten or crack during 150,000 flex cycles of the Cold Ross Flex test, while the abrasion resistance of the polyolefin-based resin composition has not been significantly degraded and thus is not significantly different than the abrasion resistance of a comparator polyolefin-based resin composition which is otherwise identical to the polyolefin-based resin composition except that it is free of the polymeric resin modifier.

In some aspects, the effective amount of the polymeric resin modifier is about 5 percent to about 30 percent, about 5 percent to about 25 percent, about 5 percent to about 20 percent, about 5 percent to about 15 percent, about 5 percent to about 10 percent, about 10 percent to about 15 percent, about 10 percent to about 20 percent, about 10 percent to about 25 percent, or about 10 percent to about 30 percent by weight based upon a total weight of the polyolefin-based resin composition. In some aspects, the effective amount of the polymeric resin modifier is about 20 percent, about 15 percent, about 10 percent, about 5 percent, or less by weight based upon a total weight of the polyolefin-based resin composition.

The polymeric resin modifier can include a variety of exemplary resin modifiers described herein. In some aspects, the polymeric resin modifier is a metallocene catalyzed copolymer primarily composed of isotactic propylene repeat units with about 11 percent by weight to about 15 percent by weight of ethylene repeat units based on a total weight of metallocene catalyzed copolymer randomly distributed along the copolymer. In some aspects, the polymeric resin modifier includes about 10 percent to about 15 percent ethylene repeat units by weight based upon a total weight of the polymeric resin modifier. In some aspects, the polymeric resin modifier includes about 10 percent to about 15 percent repeat units according to Formula 1A above by weight based upon a total weight of the polymeric resin modifier. In some aspects, the polymeric resin modifier is a copolymer of repeat units according to Formula 1B above, and the repeat units according to Formula 1B are arranged in an isotactic stereochemical configuration.

In some aspects, the polymeric resin modifier is a copolymer containing isotactic propylene repeat units and ethylene repeat units. In some aspects, the polymeric resin modifier is a copolymer including a first plurality of repeat units and a second plurality of repeat units; wherein each of the repeat units in the first plurality of repeat units has a structure according to Formula 1A above and each of the repeat units in the second plurality of repeat units has a structure according to Formula 1B above, and wherein the repeat units in the second plurality of repeat units are arranged in an isotactic stereochemical configuration.

In one aspect, the polymeric resin modifier is a copolymer primarily composed of isotactic propylene repeat units with about 15 percent by weight (wt percent) of ethylene repeat units randomly distributed along the copolymer. It is a metallocene catalyzed copolymer available under the tradename "VISTAMAXX 6202" from ExxonMobil Chemical Company, Houston, Tex. and has an MFR (ASTM-1238D, 2.16 kilograms, 230 degrees Celsius.) of about 20 grams/10 minutes, a density of 0.862 grams/cubic centimeter (g/cm$^3$), and a Durometer Hardness of about 64 (Shore A).

In one aspect, the polymeric resin modifier is a copolymer primarily composed of isotactic propylene repeat units with about 11 percent by weight (wt percent) of ethylene repeat units randomly distributed along the copolymer. It is a metallocene catalyzed copolymer available from ExxonMobil Chemical Company and has an MFR (ASTM-1238D, 2.16 kilograms, 230 degrees Celsius.) of about 8 grams/10 minutes, a density of 0.873 grams/cubic centimeter (g/cm$^3$), and a Durometer Hardness of about 27 (Shore D).

In one aspect, the polymeric resin modifier is a copolymer primarily composed of isotactic propylene repeat units with about 13 percent by weight of ethylene repeat units randomly distributed along the copolymer. It is a metallocene catalyzed copolymer available from ExxonMobil Chemical Company and has an MFR (ASTM-1238D, 2.16 kilograms, 230 degrees Celsius.) of about 45 grams/10 minutes, a density of 0.865 grams/cubic centimeter (g/cm$^3$), and a Durometer Hardness of about 71 (Shore A).

The thermoplastic vulcanizate (TPV) includes an at least partially crosslinked (e.g., vulcanized), elastomer (e.g., rubber) phase dispersed within a thermoplastic phase. In the TPV, the elastomer phase may include finely dispersed crosslinked elastomer particles in a continuous thermoplastic phase. An advantage of TPVs is that they can have properties of the two main components, elastomer (e.g., rubber) and the thermoplastic. In particular, TPVs can have elastomeric properties provided by the elastomer phase and processability provided by the thermoplastic phase, which make it possible to use processes which soften or melt the thermoplastic phase of the TPV, such as thermoforming, extrusion, and injection molding. In general, the TPV comprises a crosslinked elastomer (e.g., a cured rubber, optionally a cured polyolefin rubber) dispersed in a thermoplastic phase (e.g., a thermoplastic phase comprising one or more thermoplastic polyolefins). The TPV may be free or substantially free of one or more of: hygroscopic fillers, fillers, and pigments, or the TPV may include one or more of hygroscopic fillers, fillers, and pigments.

In some aspects, when the thermoplastic phase of the TPV includes a thermoplastic polyolefin, the type of polyolefin homopolymers or copolymers present in the thermoplastic polyolefin phase of the TPV (e.g., ethylene polymers, ethylene copolymers, propylene polymers, propylene copolymers) include at least one of the same type of polyolefin homopolymers or copolymers present in the resin composition, e.g., the same polyolefin copolymer, or the same polyolefin homopolymer or copolymer present in the polymeric resin modifier. For example, the thermoplastic polyolefin phase of the TPV and the polyolefin-based resin composition may each separately comprise one or more propylene homopolymers or copolymers. In some such aspects, the shared polyolefin homopolymers or copolymers of the same type may include monomeric units having the same chemical structures. For example, the thermoplastic polyolefin phase of the TPV and the polyolefin-based resin composition may each separately comprise propylene homopolymers, or may each separately comprise polypropylene, or may each separately comprise 1-butene copolymers.

Alternatively, in other aspects, when the thermoplastic phase of the TPV includes a thermoplastic polyolefin, the type of polyolefin homopolymers or copolymers present in the thermoplastic polyolefin resin phase of the TPV (e.g., ethylene polymers, ethylene copolymers, propylene polymers, propylene copolymers) differ from the types of polyolefin homopolymers or copolymers present in the polyolefin-based resin composition of the plate. For example, the thermoplastic polyolefin resin phase of the TPV may comprise one or more propylene homopolymers or copolymers, while the polyolefin-based resin composition is substantially free of propylene homopolymers or copolymers. In some such aspects, the thermoplastic polyolefin resin phase of the TPV may comprise a propylene homopolymer, while the polyolefin-based resin composition of the sole structure comprises a propylene copolymer, including a propylene-ethylene copolymer.

The TPV may have a specific gravity of about 0.8 grams per cubic centimeter to about 1.2 grams per cubic centimeter, about 0.8 grams per cubic centimeter to about 1.0 grams per cubic centimeter, about 0.9 grams per cubic centimeter to about 1.0 grams per cubic centimeter, or about 0.9 grams per cubic centimeter to about 1.0 grams per cubic centimeter as determined by ASTM D792.

The TPV may have a Shore D Hardness (15 seconds at 23 degrees Celsius) of about 40 to about 60, about 40 to about 55, about 45 to about 60, about 45 to about 55, or about 50 to about 55 as determined by ISO 868.

The TPV may have an elongation at yield at 23 degrees Celsius of about 20 percent to about 40 percent, about 20 percent to about 35 percent, about 25 percent to about 40 percent, or about 25 percent to about 35 percent as determined by ASTM D638.

The TPV may comprise or consist of an EPDM rubber in a thermoplastic phase of polypropylene (PP). Depending on the ratio of EPDM rubber to PP, the physical properties such as hardness, modulus and flexibility can vary. In one aspect, the TPV is a SANTOPRENE TPV manufactured by ExxonMobil. In another aspect, the TPV is SANTOPRENE 203-50 manufactured by ExxonMobil.

The TPV may comprise about 5 percent to about 30 percent, about 10 percent to about 30 percent, about 15 percent to about 30 percent, or about 15 percent to about 25 percent of the resin composition by weight based upon a total weight of the polyolefin-based resin composition.

The polyolefin-based resin composition may further comprise a clarifying agent. The clarifying agent can allow for clear visibility of a textile through the plate. The clarifying agent can be present in any suitable amount to provide sufficient optical clarity of the final plate or sole structure. In some aspects, the clarifying agent is present in an amount from about 0.5 percent by weight to about 5 percent by weight or about 1.5 percent by weight to about 2.5 percent by weight based upon a total weight of the polyolefin-based resin composition. The clarifying agent can include those selected from the group of substituted or unsubstituted dibenzylidene sorbitol, 1,3-O-2,4-bis(3,4-dimethylbenzylidene) sorbitol, 1,2,3-trideoxy-4,6:5,7-bis-O-[(4-propylphenyl)methylene], and a derivative thereof. The clarifying agent can include an acetal compound that is the condensation product of a polyhydric alcohol and an aromatic aldehyde. The polyhydric alcohol can include those selected from the group consisting of acyclic polyols such as xylitol and sorbitol and acyclic deoxy polyols such as 1,2,3-trideoxynonitol or 1,2,3-trideoxynon-1-enitol. The aromatic aldehyde can include those selected from the group consisting of benzaldehyde and substituted benzaldehydes.

The clarifying agent may be present in an amount from about 0.5 percent by weight to about 5 percent by weight or about 1.5 percent by weight to about 2.5 percent by weight based upon a total weight of the polyolefin-based resin composition.

The polyolefin-based resin composition may have a Notched Izod Strength of about 400 Joules per meter to about 800 Joules per meter, about 500 Joules per meter to about 800 Joules per meter, about 550 Joules per meter to about 800 Joules per meter, about 550 Joules per meter to about 750 Joules per meter, or about 550 Joules per meter to about 700 Joules per meter as determined by ASTM D246 at 23 degrees Celsius.

The polyolefin-based resin composition may have a Flex Modulus 1 percent Secant of about 400 millipascals to about 800 millipascals, about 500 millipascals to about 800 millipascals, about 550 millipascals to about 800 millipascals, about 550 millipascals to about 750 millipascals, or about 550 millipascals to about 700 millipascals as determined by ASTM D790.

The polyolefin-based resin composition may have a melt flow index of about 10 grams per 10 minutes to about 30 grams per 10 minutes, about 15 grams per 10 minutes to about 30 grams per 10 minutes, about 20 grams per 10 minutes to about 30 grams per 10 minutes, or about 15 grams per 10 minutes to about 25 grams per 10 minutes as determined by ASTM D1238 at 230 degrees Celsius using a 2.16 kilogram weight.

The polyolefin-based resin composition may have a percent crystallinity that is at least 4 percentage points less than a percent crystallinity of the otherwise same resin composition except without the polymeric resin modifier when measured according to the DSC Test using the Material Sampling Procedure.

The abrasion loss of the polyolefin-based resin composition may be within about 20 percent of an abrasion loss of the otherwise same polyolefin-based resin composition except without the resin modifier as determined by ASTM D 5963-97a using the Material Sampling Procedure.

The polyolefin-based resin composition may have an abrasion loss of about 0.05 cubic centimeters ($cm^3$) to about 0.1 cubic centimeters ($cm^3$), about 0.07 cubic centimeters ($cm^3$) to about 0.1 cubic centimeters ($cm^3$), about 0.08 cubic centimeters ($cm^3$) to about 0.1 cubic centimeters ($cm^3$), or about 0.08 cubic centimeters ($cm^3$) to about 0.11 cubic centimeters ($cm^3$) pursuant to ASTM D 5963-97a using the Material Sampling Procedure. In some aspects, the polyolefin-based resin composition has no significant change in the abrasion loss as compared to an abrasion loss of a second polyolefin-based resin composition identical to the polyolefin-based resin composition except without the polymeric resin modifier when measured pursuant to ASTM D 5963-97a using the Material Sampling Procedure. A change is abrasion loss, as used herein, is said to not be significant when the change is about 30 percent, about 25 percent, about 20 percent, about 15 percent, about 10 percent, or less when measured pursuant to ASTM D 5963-97a using the Material Sampling Procedure.

The effective amount of the polymeric resin modifier may be an amount effective to allow the polyolefin-based resin composition to pass a flex test as determined by the Cold Ross Flex Test using the Plaque Sampling Procedure.

The effective amount of the polymeric resin modifier may be an amount effective to allow the polyolefin-based resin composition to pass a flex test pursuant to the Cold Ross Flex Test using the Plaque Sampling Procedure without a significant change in an abrasion loss as compared to an abrasion loss of a second resin composition identical to the polyolefin-based resin composition except without the polymeric resin modifier as determined by ASTM D 5963-97a using the Material Sampling Procedure.

The combination of abrasion resistance and flexural durability can be related to the overall crystallinity of the polyolefin-based resin composition. In some aspects, the polyolefin-based resin composition has a percent crystallization of about 45 percent, about 40 percent, about 35 percent, about 30 percent, about 25 percent or less when measured according to the Differential Scanning calorimeter (DSC) Test to Determine Percent Crystallinity using the Material Sampling Procedure. It has been found that adding the polymeric resin modifier to the polyolefin-based resin composition in an amount which only slightly decreases the percent crystallinity of the polyolefin-based resin composition as compared to an otherwise identical polyolefin-based resin composition except without the polymeric resin modifier can result in polyolefin-based resin compositions which are able to pass the Cold Ross Flex test while maintaining a relatively low abrasion loss. In some aspects, the polymeric resin modifier leads to a decrease in the percent crystallinity of the polyolefin-based resin composition. In some aspects, the polyolefin-based resin composition has a percent crystallization that is at least 6, at least 5, at least 4, at least 3, or at least 2 percentage points less than a percent crystallization of the otherwise same polyolefin-based resin composition except without the polymeric resin modifier when measured according to the Differential Scanning calorimeter (DSC) Test to Determine Percent Crystallinity using the Material Sampling Procedure.

The term "externally facing" as used in "externally facing layer" refers to the position the element is intended to be in when the element is present in an article during normal use. If the article is footwear, the element is positioned toward the ground during normal use by a wearer when in a standing position, and thus can contact the ground including unpaved surfaces when the footwear is used in a conventional manner, such as standing, walking, or running on an unpaved surface. In other words, even though the element may not necessarily be facing the ground during various steps of manufacturing or shipping, if the element is intended to face the ground during normal use by a wearer, the element is understood to be externally-facing or more specifically for an article of footwear, ground-facing. In some circumstances, due to the presence of elements such as traction elements, the externally facing (e.g., ground-facing) surface can be positioned toward the ground during conventional use but may not necessarily come into contact the ground. For example, on hard ground or paved surfaces, the terminal ends of traction elements on the outsole may directly contact the ground, while portions of the outsole located between the traction elements do not. As described in this example, the portions of the outsole located between the traction elements are considered to be externally facing (e.g., ground-facing) even though they may not directly contact the ground in all circumstances.

Hydrogel Materials

The article of footwear, sole structure, or article of sporting equipment may further comprise a second element or component including a hydrogel material comprising one or more polymeric hydrogels. The second resin composition may be hydrogel material, and may comprise a polyurethane hydrogel. The hydrogel material of the second resin composition may comprise a polymeric hydrogel selected from a polyamide hydrogel, a polyurea hydrogel, a polyester hydrogel, a polycarbonate hydrogel, a polyetheramide hydrogel, a hydrogel formed of addition polymers of ethylenically unsaturated monomers, copolymers thereof (e.g., co-polyesters, co-polyethers, co-polyamides, co-polyurethanes, co-polyolefins), and combinations thereof. Additional details are provided herein.

It has been found the use of a hydrogel material and articles incorporating the hydrogel material (e.g. footwear and footwear components such as traction elements) may prevent or reduce the accumulation of soil on an externally-facing surface of the article during use or wear on unpaved surfaces. As used herein, the term "soil" can include any of a variety of materials commonly present on a ground or playing surface and which might otherwise adhere to an outsole or exposed surface of an article, such as aa sole structure of a footwear article or a ground-contacting surface of an article of sporting equipment. Soil can include inorganic materials such as mud, sand, dirt, and gravel; organic matter such as grass, turf, leaves, other vegetation, and excrement; and combinations of inorganic and organic materials such as clay. Additionally, soil can include other materials such as pulverized rubber which may be present on or in an unpaved surface.

In aspects where the hydrogel material is present and swells, the swelling of the layered material may be observed as an increase in material thickness from the dry-state thickness of the layered material, through a range of intermediate-state thicknesses as additional water is absorbed, and finally to a saturated-state thickness layered material, which is an average thickness of the layered material when fully saturated with water. For example, the saturated-state thickness for the fully saturated hydrogel material can be greater than 150 percent, greater than 200 percent, greater than 250 percent, greater than 300 percent, greater than 350 percent, greater than 400 percent, or greater than 500 percent, of the dry-state thickness for the same hydrogel material, as characterized by the Swelling Capacity Test. In some aspects, the saturated-state thickness for the fully saturated hydrogel material can be about 150 percent to 500 percent, about 150 percent to 400 percent, about 150 percent to 300 percent, or about 200 percent to 300 percent of the dry-state thickness for the same hydrogel material. Examples of suitable average thicknesses for the hydrogel material in a wet state (referred to as a saturated-state thickness) can be about 0.2 millimeters to 10 millimeters, about 0.2 millimeters to 5 millimeters, about 0.2 millimeters to 2 millimeters, about 0.25 millimeters to 2 millimeters, or about 0.5 millimeters to 1 millimeter.

The hydrogel material in neat form may have an increase in thickness at 1 hour of about 35 percent to 400 percent, about 50 percent to 300 percent, or about 100 percent to 200 percent, as characterized by the Swelling Capacity Test. In some further embodiments, the hydrogel material in neat form can have an increase in thickness at 24 hours of about 45 percent to 500 percent, about 100 percent to 400 percent, or about 150 percent to 300 percent.

The hydrogel material may quickly take up water that is in contact with it. For instance, the hydrogel material can take up water from mud and wet grass, such as during a warmup period prior to a competitive match. Alternatively (or additionally), the hydrogel material can be pre-conditioned with water so that it is partially or fully saturated, such as by spraying or soaking it with water prior to use.

The hydrogel material can exhibit an overall water uptake capacity of about 25 percent to 225 percent as measured in the Water Uptake Capacity Test over a soaking time of 24 hours using the Component Sampling Procedure, as defined herein. Alternatively, the overall water uptake capacity exhibited by the hydrogel material is in the range of about 30 percent to about 200 percent; alternatively, about 50 percent to about 150 percent; alternatively, about 75 percent to about 125 percent. For the purpose of this disclosure, the term "overall water uptake capacity" is used to represent the amount of water by weight taken up by the hydrogel material as a percentage by weight of dry hydrogel material. The procedure for measuring overall water uptake capacity includes measurement of the "dry" weight of the hydrogel material, immersion of the hydrogel material in water at ambient temperature (~23 degrees Celsius) for a predetermined amount of time, followed by re-measurement of the weight of the hydrogel material when "wet". The procedure for measuring the overall weight uptake capacity according to the Water Uptake Capacity Test using the Component Sampling Procedure is described herein.

The hydrogel material may also be characterized by a water uptake rate of 10 $g/m^2/\sqrt{min}$ to 120 $g/m^2/\sqrt{min}$ as measured in the Water Uptake Rate Test using the Material Sampling Procedure. The water uptake rate is defined as the weight (in grams) of water absorbed per square meter ($m^2$) of the hydrogel material over the square root of the soaking time ($\sqrt{min}$). Alternatively, the water uptake rate ranges from about 12 $g/m^2/\sqrt{min}$ to about 100 $g/m^2/\sqrt{min}$; alternatively, from about 25 $g/m^2/\sqrt{min}$ to about 90 $g/m^2/\sqrt{min}$; alternatively, up to about 60 $g/m^2/\sqrt{min}$.

The overall water uptake capacity and the water uptake rate can be dependent upon the amount of the polymeric hydrogel that is present in the hydrogel material. The polymeric hydrogel can be characterized by a water uptake capacity of 50 percent to 2000 percent as measured according to the Water Uptake Capacity Test using the Material Sampling Procedure. In this case, the water uptake capacity of the polymeric hydrogel is determined based on the amount of water by weight taken up by the polymeric hydrogel as a percentage by weight of dry polymeric hydrogel. Alternatively, the water uptake capacity exhibited by the polymeric hydrogel is in the range of about 100 percent to about 1500 percent; alternatively, in the range of about 300 percent to about 1200 percent.

The surface of the hydrogel material exhibits hydrophilic properties. The hydrophilic properties of the hydrogel material surface may be characterized by determining the static sessile drop contact angle of the hydrogel material's surface. Accordingly, the hydrogel material's surface in a dry state may have a static sessile drop contact angle (or dry-state contact angle) of less than 105°, or less than 95°, less than 85°, as characterized by the Contact Angle Test. The Contact Angle Test can be conducted on a sample obtained in accordance with the Article Sampling Procedure or the Co-Extruded Film Sampling Procedure. In some further examples, the hydrogel material in a dry state may have a static sessile drop contact angle ranging from 60° to 100°, from 70° to 100°, or from 65° to 95°.

The surface of the hydrogel material in a wet state may have a static sessile drop contact angle (or wet-state contact angle) of less than 90°, less than 80°, less than 70°, or less than 60°. The surface in a wet state may have a static sessile drop contact angle ranging from 45° to 75°. The dry-state static sessile drop contact angle of the surface may be greater than the wet-state static sessile drop contact angle of the surface by at least 10°, at least 15°, or at least 20°, for example from 10° to 40°, from 10° to 30°, or from 10° to 20°.

The surface of the hydrogel material, including the surface of an article, may also exhibit a low coefficient of friction when the material is wet. Examples of coefficients of friction exhibited by the hydrogel material in a dry state (or dry-state coefficient of friction) are less than 1.5, for instance ranging from 0.3 to 1.3, or from 0.3 to 0.7, as characterized by the Coefficient of Friction Test. The Coefficient of Friction Test can be conducted on a sample obtained in accordance with the Article Sampling Procedure, or the Co-Extruded Film Sampling Procedure. Examples of coefficients of friction exhibited by the hydrogel material in a wet state (or wet-state coefficient of friction) include less than 0.8 or less than 0.6, for instance ranging from 0.05 to 0.6, from 0.1 to 0.6, or from 0.3 to 0.5. Furthermore, the hydrogel material may exhibit a reduction in its coefficient of friction from its dry state to its wet state, such as a reduction ranging from 15 percent to 90 percent, or from 50 percent to 80 percent. In some cases, the dry-state coefficient of friction is greater than the wet-state coefficient of friction for the hydrogel material, for example being higher by a value of at least 0.3 or 0.5, such as 0.3 to 1.2 or 0.5 to 1.

The compliance of the hydrogel material, including an article comprising the hydrogel material, may be characterized by based on the hydrogel material's storage modulus in the dry state (when equilibrated at 0 percent relative humidity (RH)), and in a partially wet state (e.g., when equilibrated at 50 percent RH or at 90 percent RH), and by reductions in its storage modulus between the dry and wet states. The hydrogel material may have a reduction in storage modulus (4E') from the dry state relative to the wet state. A reduction in storage modulus as the water concentration in the hydrogel material increases corresponds to an increase in compliance, because less stress is required for a given strain/deformation. The hydrogel material may exhibit a reduction in the storage modulus from its dry state to its wet state (50 percent RH) of more than 20 percent, more than 40 percent, more than 60 percent, more than 75 percent, more than 90 percent, or more than 99 percent, relative to the storage modulus in the dry state, and as characterized by the Storage Modulus Test with the Neat Film Sampling Process.

The total amount of water that the hydrogel material may take up depends on a variety of factors, such as its composition (e.g., its hydrophilicity), its cross-linking density, its thickness, and the like. The water uptake capacity and the water uptake rate of the hydrogel material are dependent on the size and shape of its geometry, and are typically based on the same factors. Conversely, the water uptake rate is transient and can be defined kinetically. The three primary factors for water uptake rate for hydrogel material present given part geometry include time, thickness, and the exposed surface area available for taking up water.

Even though the hydrogel material can swell as it takes up water and transitions between the different material states with corresponding thicknesses, the saturated-state thickness of the layered material preferably remains less than the length of the traction element. This selection of the layered material and its corresponding dry and saturated thicknesses ensures that the traction elements can continue to provide ground-engaging traction during use of the footwear, even when the layered material is in a fully swollen state. For example, the average clearance difference between the lengths of the traction elements and the saturated-state thickness of the layered material is desirably at least 8 millimeters. For example, the average clearance distance can be at least 9 millimeters, 10 millimeters, or more.

In addition to swelling, the compliance of the hydrogel material can also increase from being relatively stiff (i.e., dry-state) to being increasingly stretchable, compressible, and malleable (i.e., wet-state). The increased compliance accordingly can allow the hydrogel material to readily compress under an applied pressure (e.g., during a foot strike on the ground), and in some aspects, to quickly expel at least a portion of its retained water (depending on the extent of compression). While not wishing to be bound by theory, it is believed that this compressive compliance alone, water expulsion alone, or both in combination can disrupt the adhesion and/or cohesion of soil, which prevents or otherwise reduces the accumulation of soil.

In addition to quickly expelling water, in particular examples, the compressed hydrogel material is capable of quickly re-absorbing water when the compression is released (e.g., liftoff from a foot strike during normal use). As such, during use in a wet or damp environment (e.g., a muddy or wet ground), the hydrogel material can dynamically expel and repeatedly take up water over successive foot strikes, optionally from a wet surface. As such, the hydrogel material can continue to prevent soil accumulation over extended periods of time (e.g., during an entire competitive match), optionally when there is ground water available for re-uptake.

As used herein, the terms "take up," "taking up," "uptake," "uptaking," and the like refer to the drawing of a liquid (e.g., water) from an external source into the layered material, such as by absorption, adsorption, or both. Furthermore, as briefly mentioned above, the term "water" refers to an aqueous liquid that can be pure water, or can be an aqueous carrier with lesser amounts of dissolved, dispersed or otherwise suspended materials (e.g., particulates, other liquids, and the like).

As described herein, the externally facing surface of the sole structure includes the hydrogel material comprising a polymeric hydrogel The polymeric hydrogel may comprise or consist essentially of a polyurethane hydrogel.

Polymers

The resin compositions described herein comprise polymers. The polymers may include polymers of the same or different types of monomers (e.g., homopolymers and copolymers, including terpolymers). In certain aspects, the thermoplastic polymer can include different monomers randomly distributed in the polymer (e.g., a random co-polymer). The term "polymer" refers to a polymerized molecule having one or more monomer species that can be the same or different. When the monomer species are the same, the polymer can be termed homopolymer and when the monomers are different, the polymer can be referred to as a copolymer. The term "copolymer" is a polymer having two or more types of monomer species, and includes terpolymers (i.e., copolymers having three monomer species). In an aspect, the "monomer" can include different functional groups or segments, but for simplicity is generally referred to as a monomer.

For example, the polymer may be a polymer having repeating polymeric units of the same chemical structure (segments) which are relatively harder (hard segments), and repeating polymeric segments which are relatively softer (soft segments). In various aspects, the polymer has repeating hard segments and soft segments, physical crosslinks can be present within the segments or between the segments or both within and between the segments. Particular examples of hard segments include isocyanate segments. Particular examples of soft segments include an alkoxy group such as polyether segments and polyester segments. As used herein, the polymeric segment can be referred to as being a particular type of polymeric segment such as, for example, an isocyanate segment (e.g., diisocyante segment), an alkoxy polyamide segment (e.g., a polyether segment, a polyester segment), and the like. It is understood that the chemical structure of the segment is derived from the described chemical structure. For example, an isocyanate segment is a polymerized unit including an isocyanate functional group. When referring to polymeric segments of a particular chemical structure, the polymer can contain up to 10 mole percent of segments of other chemical structures. For example, as used herein, a polyether segment is understood to include up to 10 mole percent of non-polyether segments.

The polymer may be a thermoplastic polyurethane (also referred to as "TPU"). The thermoplastic polyurethane may be a thermoplastic polyurethane elastomer. The thermoplastic polyurethane may include hard and soft segments. The hard segments may comprise or consist of isocyanate segments (e.g., diisocyanate segments), and the soft segments may comprise or consist of alkoxy segments (e.g., polyether segments, or polyester segments, or a combination of polyether segments and polyester segments). The thermoplastic polyurethane may comprise or consist essentially of an thermoplastic polyurethane elastomer having repeating hard segments and repeating soft segments.

The resin compositions described herein may comprise polyamides. The polyamides may comprise a thermoplastic polyamide, or an elastomeric polyamide, or a thermoplastic polyamide elastomer. The polyamide can be a polyamide homopolymer having repeating polyamide segments of the same chemical structure. Alternatively, the polyamide can comprise a number of polyamide segments having different polyamide chemical structures (e.g., polyamide 6 segments, polyamide 11 segments, polyamide 12 segments, polyamide 66 segments, etc.). The polyamide segments having different chemical structure can be arranged randomly, or can be arranged as repeating blocks. The polyamide may be a block co-polyamide, such as a polyether block amide (PEBA) copolymer.

The polymer may comprise a polyester, including a thermoplastic polyester. The polyester may be a polybutylene terephthalate (PBT), a polytrimethylene terephthalate, a polyhexamethylene terephthalate, a poly-1,4-dimethylcyclohexane terephthalate, a polyethylene terephthalate (PET), a polyethylene isophthalate (PEI), a polyarylate (PAR), a polybutylene naphthalate (PBN), a liquid crystal polyester, or a blend or mixture of two or more of the foregoing. The polyester may be a co-polyester (i.e., a co-polymer including polyester segments and non-polyester segments). The co-polyester can be an aliphatic co-polyester (i.e., a co-polyester in which both the polyester segments and the non-polyester segments are aliphatic). Alternatively, the co-polyester may include aromatic segments. The polyester segments of the co-polyester can comprise or consist of polyglycolic acid segments, polylactic acid segments, polycaprolactone segments, polyhydroxyalkanoate segments, polyhydroxybutyrate segments, or any combination thereof. The polyester segments of the co-polyester can be arranged randomly, or can be arranged as repeating blocks.

Polyolefins

The polymers of the resin compositions described herein may comprise or consist essentially of polyolefins, including thermoplastic polyolefins, elastomeric polyolefins, and/or thermoplastic polyolefin elastomers. Exemplary polyolefins useful may include, but are not limited to, polyethylene, polypropylene, and thermoplastic polyolefin elastomers (e.g., metallocene-catalyzed block copolymers of ethylene and α-olefins having 4 to about 8 carbon atoms). The polyolefin may be a polymer selected from a polyethylene, an ethylene-α-olefin copolymer, an EPDM rubber, a polybutene, a polyisobutylene, a poly-4-methylpent-1-ene, a polyisoprene, a polybutadiene, an ethylene-methacrylic acid copolymer, and a polyolefin elastomer such as a dynamically cross-linked polymer obtained from polypropylene (PP) and an EPDM rubber, and blends or mixtures of the foregoing. Further exemplary polyolefins useful in the disclosed compositions are polymers of cycloolefins such as cyclopentene or norbornene.

It is to be understood that polyethylene, which optionally can be crosslinked, is inclusive a variety of polyethylenes, including, but not limited to, low density polyethylene (LDPE), linear low density polyethylene (LLDPE), (VLDPE) and (ULDPE), medium density polyethylene (MDPE), high density polyethylene (HDPE), high density and high molecular weight polyethylene (HDPE-HMVV), high density and ultrahigh molecular weight polyethylene (HDPE-UHMVV), and blends or mixtures of any the foregoing polyethylenes. A polyethylene can also be a polyethylene copolymer derived from monomers of monolefins and diolefins copolymerized with a vinyl, acrylic acid, methacrylic acid, ethyl acrylate, vinyl alcohol, and/or vinyl acetate. Polyolefin copolymers comprising vinyl acetate-derived units can be a high vinyl acetate content copolymer, e.g., greater than about 50 wt percent vinyl acetate-derived composition.

the thermoplastic polyolefin, as disclosed herein, may be formed through free radical, cationic, and/or anionic polymerization by methods well known to those skilled in the art (e.g., using a peroxide initiator, heat, and/or light). In a further aspect, the disclosed thermoplastic polyolefin can be prepared by radical polymerization under high pressure and at elevated temperature. Alternatively, the thermoplastic polyolefin can be prepared by catalytic polymerization using a catalyst that normally contains one or more metals from group IVb, Vb, VIb or VIII metals. The catalyst usually has one or more than one ligand, typically oxides, halides, alcoholates, esters, ethers, amines, alkyls, alkenyls and/or aryls that can be either p- or s-coordinated complexed with the group IVb, Vb, VIb or VIII metal. In various aspects, the metal complexes can be in the free form or fixed on substrates, typically on activated magnesium chloride, titanium(III) chloride, alumina, or silicon oxide. It is understood that the metal catalysts can be soluble or insoluble in the polymerization medium. The catalysts can be used by themselves in the polymerization or further activators can be used, typically a group Ia, IIa and/or IIIa metal alkyls, metal hydrides, metal alkyl halides, metal alkyl oxides or metal alkyloxanes. The activators can be modified conveniently with further ester, ether, amine, or silyl ether groups.

Suitable polyolefins can be prepared by polymerization of monomers of monolefins and diolefins as described herein. Exemplary monomers that can be used to prepare disclosed polyolefin include, but are not limited to, ethylene, propylene, 1-butene, 1-pentene, 1-hexene, 2-methyl-1-propene, 3-methyl-1-pentene, 4-methyl-1-pentene, 5-methyl-1-hexene and mixtures thereof.

Suitable ethylene-α-olefin copolymers can be obtained by copolymerization of ethylene with an α-olefin such as propylene, butene-1, hexene-1, octene-1,4-methyl-1-pentene, or the like having carbon numbers of 3 to 12.

Suitable dynamically cross-linked polymers can be obtained by cross-linking a first component such as a soft segment while at the same time physically dispersing a second component such as a hard segment by using a kneading machine such as a Banbury mixer and a biaxial extruder. The dynamically cross-linked polymers can then be ground, and the ground material can be dispersed in a thermoplastic polymer phase to form the TPV.

The polyolefin may be a mixture of polyolefins, such as a mixture of two or more polyolefins disclosed herein above. For example, a suitable mixture of polyolefins can be a mixture of polypropylene with polyisobutylene, polypropylene with polyethylene (for example PP/HDPE, PP/LDPE) or mixtures of different types of polyethylene (for example LDPE/HDPE).

The polyolefin may be a copolymer of suitable monolefin monomers or a copolymer of a suitable monolefin monomer and a vinyl monomer. Exemplary polyolefin copolymers include, but are not limited to, ethylene/propylene copolymers, linear low density polyethylene (LLDPE) and mixtures thereof with low density polyethylene (LDPE), propylene/but-1-ene copolymers, propylene/isobutylene copolymers, ethylene/but-1-ene copolymers, ethylene/hexene copolymers, ethylene/methylpentene copolymers, ethylene/heptene copolymers, ethylene/octene copolymers, propylene/butadiene copolymers, isobutylene/isoprene copolymers, ethylene/alkyl acrylate copolymers, ethylene/alkyl methacrylate copolymers, ethylene/vinyl acetate copolymers and their copolymers with carbon monoxide or ethylene/acrylic acid copolymers and their salts (ionomers) as well as terpolymers of ethylene with propylene and a diene such as hexadiene, dicyclopentadiene or ethylidene-norbornene; and mixtures of such copolymers with one another and with polymers mentioned in 1) above, for example polypropylene/ethylene-propylene copolymers, LDPE/ethylene-vinyl acetate copolymers (EVA), LDPE/ethylene-acrylic acid copolymers (EAA), LLDPE/EVA, LLDPE/EAA and alternating or random polyalkylene/carbon monoxide copolymers and mixtures thereof with other polymers, for example polyamides.

The polyolefin may be a polypropylene homopolymer, a polypropylene copolymers, a polypropylene random copolymer, a polypropylene block copolymer, a polyethylene homopolymer, a polyethylene random copolymer, a polyethylene block copolymer, a low density polyethylene (LDPE), a linear low density polyethylene (LLDPE), a medium density polyethylene, a high density polyethylene (HDPE), or blends or mixtures of one or more of the preceding polymers.

The polyolefin may be a polypropylene. The term "polypropylene," as used herein, is intended to encompass any polymeric composition comprising propylene monomers, either alone or in mixture or copolymer with other randomly selected and oriented polyolefins, dienes, or other monomers (such as ethylene, butylene, and the like). Such a term also encompasses any different configuration and arrangement of the constituent monomers (such as atactic, syndiotactic, isotactic, and the like).

The polyolefin may be a polyethylene. The term "polyethylene," as used herein, is intended to encompass any polymeric composition comprising ethylene monomers, either alone or in mixture or copolymer with other randomly selected and oriented polyolefins, dienes, or other monomers (such as propylene, butylene, and the like). Such a term also encompasses any different configuration and arrangement of the constituent monomers (such as atactic, syndiotactic, isotactic, and the like).

Methods of Making Resin Compositions

In various aspects, this disclosure also provides a method for making a resin composition, including the polyolefin-based resin compositions described herein. The method includes blending the polymeric and non-polymeric ingredients of the resin composition. When the resin composition is a polyolefin-based resin composition, the method includes blending a polyolefin copolymer, a polymeric resin modifier, and aTPV.

The resin compositions provided herein can be made by blending the polymeric and non-polymeric ingredients (e.g., the polymeric resin modifier, polyolefin copolymer, and the TPV) to form a blended resin composition. Methods of blending polymers can include film blending in a press, blending in a mixer (e.g. mixers commercially available under the tradename "HAAKE" from Thermo Fisher Scientific, Waltham, Mass.), solution blending, hot melt blending, and extruder blending. In some aspects, the polymeric ingredients (e.g., the polymeric resin modifier, polyolefin copolymer, and the TPV) are miscible such that they can be readily mixed by the screw in the injection barrel during injection molding, e.g. without the need for a separate blending step.

In one aspect, the polyolefin-based resin compositions provided herein can be made by blending an effective amount of polymeric resin modifier with the polyolefin copolymer and the TPV, wherein the effective amount is an amount effective to allow the polyolefin-based resin composition to pass a flex test pursuant to the Cold Ross Flex Test using the Plaque Sampling Procedure, where a second polyolefin-based resin composition identical to the polyolefin-based resin composition except without the isotactic polyolefin copolymer resin modifier fails the flex test pursuant to the Cold Ross Flex Test using the Plaque Sampling Procedure. The effective amount can be an amount effective to maintain an abrasion loss of the polyolefin-based resin composition within about 20 percent of an abrasion loss of the second polyolefin-based resin composition as measured pursuant to ASTM D 5963-97a using the Material Sampling Procedure. The effective amount can be the effective amount of the isotactic polyolefin copolymer resin modifier is an amount effective to decrease a percent crystallization of the polyolefin-based resin composition by at least 4 percentage points as compared to a percent crystallization of the second polyolefin-based resin composition when measured according to the Differential Scanning calorimeter (DSC) Test to Determine Percent Crystallinity using the Material Sampling Procedure.

The methods can further include extruding the blended resin composition (e.g., the blended polyolefin-based resin composition) to form an extruded resin composition. The methods of extruding the blended resin can include manufacturing long products of relatively constant cross-section (rods, sheets, pipes, films, wire insulation coating). The methods of extruding the blended resin can include conveying a softened blended resin composition through a die with an opening. The blended resin can be conveyed forward by a feeding screw and forced through the die. Heating elements, placed over the barrel, can soften and melt the blended resin. The temperature of the material can be controlled by thermocouples. The product going out of the die can be cooled by blown air or in a water bath to form the extruded resin composition. Alternatively, the product going out of the die can be pelletized with little cooling as described below.

The method can further include pelletizing the extruded resin composition (e.g., the extruded polyolefin-based resin composition) to form a pelletized resin composition. Methods of pelletizing can include melt pelletizing (hot cut) whereby the melt coming from a die is almost immediately cut into pellets that are conveyed and cooled by liquid or gas. Methods of pelletizing can include strand pelletizing (cold cut) whereby the melt coming from the die head is converted into strands (the extruded resin composition) that are cut into pellets after cooling and solidification.

The method can further include injection molding the pelletized resin composition (e.g., the pelletized polyolefin-based resin composition) to form an article. The injection molding can include the use of a non-rotating, cold plunger to force the pelletized resin through a heated cylinder wherein the resin composition is heated by heat conducted from the walls of the cylinder to the resin composition. The injection molding can include the use of a rotating screw, disposed co-axially of a heated barrel, for conveying the pelletized resin composition toward a first end of the screw and to heat the resin composition by the conduction of heat from the heated barrel to the resin composition. As the resin composition is conveyed by the screw mechanism toward the first end, the screw is translated toward the second end so as to produce a reservoir space at the first end. When sufficient melted resin composition is collected in the reservoir space, the screw mechanism can be pushed toward the first end so as to inject the material into a selected mold.

Methods of Making Components and Articles

The disclosure provides several methods for making components and articles described herein. The methods can include injection molding one or more of the resin compositions described herein, including injection molding polyolefin-based resin compositions and/or second resin compositions. The disclosure provides methods for manufacturing a component for an article of footwear or sporting equipment, by injection molding a resin composition described herein.

The methods may further include providing a component containing a polyolefin-based resin composition, and providing a second element (e.g., a second component), and affixing the component to the second element. The second element may include a plurality of traction elements, or a toe bumper. The second element may include a textile or multilayer film. The second element may include an upper. The second element may include one or both of polyolefin fibers and polyolefin yarns.

In some aspects, a second resin composition (e.g., a second resin composition comprising a polyolefin, or a second resin composition which is free of polyolefins) is present on a side or outer layer of the second element, and the method includes affixing the second resin composition and the polyolefin-based resin composition together. The second element can include a yarn, a textile, a film, or some other element. Affixing the component to the second element can include directly injecting the polyolefin-based resin composition onto the second resin composition of the second element. Affixing the component to the second element can include forming a mechanical bond between the polyolefin-based resin composition and the second element. Affixing the component to the second element can include (i) increasing a temperature of the polyolefin-based resin composition to a first temperature above a melting or softening point of the polyolefin-based resin composition, (ii) contacting the polyolefin-based resin composition and the second element while the polyolefin-based resin composition is at the first temperature, and (iii) keeping the polyolefin-based resin composition and the second element in contact with each other while decreasing the temperature of the polyolefin-based resin composition to a second temperature below the melting or softening point of the polyolefin-based resin composition, forming a bond between the polyolefin-based resin composition and the second element. Depending upon the types of polymers used and the processing conditions, this process may form a mechanical bond between the surface of the second element and polyolefin-based resin composition molded onto the surface. This process may also form thermal bonds in which the polyolefin-based resin composition and the second resin composition meld together and polymer chains from the two resin compositions become entangled at their interface.

The second element can comprise a thermoplastic material (e.g., the surface of the second element to be bonded may comprise a thermoplastic second resin composition), and affixing the component to the second element can include (i) increasing a temperature of the thermoplastic second resin composition to a first temperature above a melting or softening point of the thermoplastic second resin composition, (ii) contacting the polyolefin-based resin composition and the thermoplastic second resin composition while the thermoplastic second resin composition is at the first temperature, and (iii) keeping the polyolefin-based resin composition and the thermoplastic second resin composition in contact with each other while decreasing the temperature of the thermoplastic second resin composition to a second temperature below the melting or softening point of the thermoplastic second resin composition, forming bond between the resin composition and the second element. Depending upon the types of polymers used and the processing conditions, this process may form a mechanical bond between the surface of the polyolefin-based resin composition and the second resin composition molded onto the surface. This process may also form thermal bonds in which the polyolefin-based resin composition and the second resin composition meld together and polymer chains from the two resin compositions become entangled at their interface.

The second element can include a thermoplastic second resin composition, and affixing the component to the second element can include (i) increasing a temperature of both the polyolefin-based resin composition and the thermoplastic second resin composition to a first temperature above both a melting or softening point of the polyolefin-based resin composition and a melting or softening point of the thermoplastic second resin composition, (ii) contacting the polyolefin-based resin composition and the thermoplastic second resin composition while both the polyolefin-based resin composition and the thermoplastic second resin composition are at the first temperature, and (iii) keeping the polyolefin-based resin composition and the thermoplastic second resin composition in contact with each other while decreasing the temperature of both the polyolefin-based resin composition and the thermoplastic second resin composition to a second temperature below both the melting or softening point of the polyolefin-based resin composition and the melting or softening point of the thermoplastic second resin composition, melding at least a portion of the polyolefin-based resin material and the thermoplastic second resin composition with each other, thereby forming a thermal bond between the component and the second element.

In some aspects, the article is an article of footwear and the method included injection molding a sole structure or plate described herein. The method can include providing the sole structure, providing an upper, and affixing the sole structure and the upper to each other.

Property Analysis and Characterization Procedures

Cold Ross Flex Test

The cold Ross flex test is determined according to the following test method. The purpose of this test is to evaluate the resistance to cracking of a sample under repeated flexing to 60 degrees in a cold environment. A thermoformed plaque of the material for testing is sized to fit inside the flex tester machine. Each material is tested as five separate samples. The flex tester machine is capable of flexing samples to 60 degrees at a rate of 100±5 cycles per minute. The mandrel diameter of the machine is 10 millimeters. Suitable machines for this test are the Emerson AR-6, the Satra STM 141F, the Gotech GT-7006, and the Shin II Scientific SI-LTCO (DaeSung Scientific). The sample(s) are inserted into the machine according to the specific parameters of the flex machine used. The machine is placed in a freezer set to −6 degrees Celsius for the test. The motor is turned on to begin flexing with the flexing cycles counted until the sample cracks. Cracking of the sample means that the surface of the material is physically split. Visible creases of lines that do not actually penetrate the surface are not cracks. The sample is measured to a point where it has cracked but not yet broken in two.

Abrasion Loss Test ASTM D 5963-97a

Abrasion loss is tested on cylindrical test pieces with a diameter of 16±0.2 mm and a minimum thickness of 6 mm cut from sheets using a ASTM standard hole drill. The abrasion loss is measured using Method B of ASTM D 5963-97a on a Gotech GT-7012-D abrasion test machine. The tests are performed as 22 degrees Celsius with an abrasion path of 40 meters. The Standard Rubber #1 used in the tests has a density of 1.336 grams per cubic centimeter ($g/cm^3$). The smaller the abrasion loss volume, the better the abrasion resistance.

Differential Scanning Calorimeter (DSC) Test to Determine Percent Crystallinity

To determine percent crystallinity of a resin composition including multiple polymeric components such as a copolymer and a polymeric resin modifier, samples of each of the multiple polymeric components, such as the copolymer, the resin composition, and of a homopolymer of the main component of the copolymer (e.g., polypropylene homopolymer polypropylene), are all analyzed by differential scanning calorimetry (DSC) over the temperature range from −80 degrees Celsius to 250 degrees Celsius. A heating rate of 10 degrees Celsius per minute is used. The melting endotherm is measured for each sample during heating. Universal Analysis software (TA Instruments, New Castle, Del., USA) is used to calculate percent crystallinity based upon the melting endotherms for the various polymeric components, such as based on the homopolymer (e.g., 207 Joules per gram for 100 percent crystalline polypropylene material). Specifically, the percent crystallinity may be calculated by dividing the melting endotherm measured for the copolymer or for the resin composition by the 100 percent crystalline homopolymer melting endotherm.

Method to Determine the Vicat Softening Temperature $T_{vs}$.

The Vicat softening temperature $T_{vs}$ is be determined according to the test method detailed in ASTM D1525-09 Standard Test Method for Vicat Softening Temperature of Plastics, preferably using Load A and Rate A. Briefly, the Vicat softening temperature is the temperature at which a flat-ended needle penetrates the specimen to the depth of 1 mm under a specific load. The temperature reflects the point of softening expected when a material is used in an elevated temperature application. It is taken as the temperature at which the specimen is penetrated to a depth of 1 mm by a flat-ended needle with a 1 $mm^2$ circular or square cross-section. For the Vicat A test, a load of 10 N is used, whereas for the Vicat B test, the load is 50 N. The test involves placing a test specimen in the testing apparatus so that the penetrating needle rests on its surface at least 1 mm from the edge. A load is applied to the specimen per the requirements of the Vicat A or Vicat B test. The specimen is then lowered into an oil bath at 23 degrees Celsius. The bath is raised at a rate of 50 degrees Celsius or 120 degrees Celsius per hour until the needle penetrates 1 mm. The test specimen must be between 3 and 6.5 mm thick and at least 10 mm in width and length. No more than three layers can be stacked to achieve minimum thickness.

Method to Determine the Melting Temperature, $T_m$, and Glass Transition Temperature, $T_g$.

The melting temperature $T_m$ and glass transition temperature $T_g$ are determined using a commercially available Differential Scanning calorimeter ("DSC") in accordance with ASTM D3418-97. Briefly, a 10-15 gram sample is placed into an aluminum DSC pan and then the lead was sealed with the crimper press. The DSC is configured to scan from −100 degrees Celsius to 225 degrees Celsius with a 20 degrees Celsius/minute heating rate, hold at 225 degrees Celsius for 2 minutes, and then cool down to 25 degrees Celsius at a rate of −10 degrees Celsius/minute. The DSC curve created from this scan is then analyzed using standard techniques to determine the glass transition temperature $T_g$ and the melting temperature $T_m$.

Method to Determine the Melt Flow Index.

The melt flow index is determined according to the test method detailed in ASTM D1238-13 Standard Test Method for Melt Flow Rates of Thermoplastics by Extrusion Plastometer, using Procedure A described therein. Briefly, the melt flow index measures the weight of a thermoplastic extruded through an orifice at a prescribed temperature and load (test weight). In the test method, approximately 7 grams of the material is loaded into the barrel of the melt flow apparatus, which has been heated to a temperature specified for the material. A weight specified for the material is applied to a plunger and the molten material is forced through the die. A timed extrudate is collected and weighed. Melt flow index values are calculated in g/10 min based on the temperature and load used.

Method to Determine the Modulus (Plaque).

The modulus for a thermoformed plaque of material is determined according to the test method detailed in ASTM D412-98 Standard Test Methods for Vulcanized Rubber and Thermoplastic Rubbers and Thermoplastic Elastomers-Tension, with the following modifications. The sample dimension is the ASTM D412-98 Die C, and the sample thickness used is 2.0 millimeters±0.5 millimeters. The grip type used is a pneumatic grip with a metal serrated grip face. The grip distance used is 75 millimeters. The loading rate used is 500 millimeters/minute. The modulus (initial) is calculated by taking the slope of the stress (MPa) versus the strain in the initial linear region.

Water Uptake Capacity Test Protocol

This test measures the water uptake capacity of the layered material after a predetermined soaking duration for a sample (e.g., taken with the above-discussed Footwear Sampling Procedure). The sample is initially dried at 60 degrees Celsius until there is no weight change for consecutive measurement intervals of at least 30 minutes apart (e.g., a 24-hour drying period at 60 degrees Celsius is typically a suitable duration). The total weight of the dried sample ($Wt,_{sample\ dry}$) is then measured in grams. The dried sample is allowed to cool down to 25 degrees Celsius, and is fully immersed in a deionized water bath maintained at 25 degrees Celsius. After a given soaking duration, the sample is removed from the deionized water bath, blotted with a cloth to remove surface water, and the total weight of the soaked sample ($Wt,_{sample\ wet}$) is measured in grams.

Any suitable soaking duration can be used, where a 24-hour soaking duration is believed to simulate saturation conditions for the layered material of the present disclosure (i.e., the hydrophilic resin will be in its saturated state). Accordingly, as used herein, the expression "having a water uptake capacity at 5 minutes" refers to a soaking duration of 5 minutes, the expression "having a water uptake capacity at 1 hour" refers to a soaking duration of 1 hour, the expression "having a water uptake capacity at 24 hours" refers to a soaking duration of 24 hours, and the like. If no time duration is indicated after a water uptake capacity value, the soaking duration corresponds to a period of 24 hours.

As can be appreciated, the total weight of a sample taken pursuant to the Footwear Sampling Procedure includes the weight of the material as dried or soaked ($Wt,_{sample\ dry}$ or $Wt,_{sample\ wet}$) and the weight of the substrate ($Wt,_{substrate}$) needs to be subtracted from the sample measurements.

The weight of the substrate ($Wt,_{substrate}$) is calculated using the sample surface area (e.g., 4.0 $cm^2$), an average measured thickness of the layered material, and the average density of the layered material. Alternatively, if the density of the material for the substrate is not known or obtainable, the weight of the substrate ($Wt,_{substrate}$) is determined by taking a second sample using the same sampling procedure as used for the primary sample, and having the same dimensions (surface area and film/substrate thicknesses) as the primary sample. The material of the second sample is then cut apart from the substrate of the second sample with a blade to provide an isolated substrate. The isolated substrate is then dried at 60 degrees Celsius for 24 hours, which can be performed at the same time as the primary sample drying. The weight of the isolated substrate ($Wt,_{substrate}$) is then measured in grams.

The resulting substrate weight ($Wt,_{substrate}$) is then subtracted from the weights of the dried and soaked primary sample ($Wt,,_{sample\ dry}$ dry or $Wt,_{sample\ wet}$) to provide the weights of the material as dried and soaked t ($Wt,,_{component\ dry}$ or $Wt,_{component\ wet}$) as depicted by Equations 1 and 2.

$$Wt._{component\ dry}=Wt,,_{sample\ dry}-Wt,_{substrate} \quad \text{(Eq. 1)}$$

$$Wt_{component\ wet}=Wt,,_{sample\ wet}-Wt,_{substrate} \quad \text{(Eq. 2)}$$

The weight of the dried component t ($Wt._{component\ dry}$) is then subtracted from the weight of the soaked component ($Wt_{component\ wet}$) to provide the weight of water that was taken up by the component, which is then divided by the weight of the dried component t ($Wt._{component\ dry}$) to provide the water uptake capacity for the given soaking duration as a percentage, as depicted below by Equation 3.

$$\text{Water Uptake Capacity} = \frac{Wt_{component\ wet} - Wt._{component\ dry}}{Wt._{component\ dry}}(100\%) \quad \text{(Eq. 3)}$$

For example, a water uptake capacity of 50 percent at 1 hour means that the soaked component weighed 1.5 times more than its dry-state weight after soaking for 1 hour. Similarly, a water uptake capacity of 500 percent at 24 hours means that the soaked component weighed 5 times more than its dry-state weight after soaking for 24 hours.

Water Uptake Rate Test Protocol

This test measures the water uptake rate of the layered material by modeling weight gain as a function of soaking time for a sample with a one-dimensional diffusion model. The sample can be taken with any of the above-discussed sampling procedures, including the Footwear Sampling Procedure. The sample is dried at 60 degrees Celsius until there is no weight change for consecutive measurement intervals of at least 30 minutes apart (a 24-hour drying period at 60 degrees Celsius is typically a suitable duration). The total weight of the dried sample ($Wt,,_{sample\ dry}$) is then measured in grams. Additionally, the average thickness of the component for the dried sample is measured for use in calculating the water uptake rate, as explained below.

The dried sample is allowed to cool down to 25 degrees Celsius, and is fully immersed in a deionized water bath maintained at 25 degrees Celsius. Between soaking durations of 1, 2, 4, 9, 16, and 25 minutes, the sample is removed from the deionized water bath, blotted with a cloth to remove surface water, and the total weight of the soaked sample ($Wt,,_{sample\ wet}$) is measured, where "t" refers to the particular soaking-duration data point (e.g., 1, 2, 4, 9, 16, or 25 minutes).

The exposed surface area of the soaked sample is also measured with calipers for determining the specific weight gain, as explained below. The exposed surface area refers to the surface area that comes into contact with the deionized water when fully immersed in the bath. For samples obtained using the Footwear Sampling Procedure, the samples only have one major surface exposed. For convenience, the surface areas of the peripheral edges of the sample are ignored due to their relatively small dimensions.

The measured sample is fully immersed back in the deionized water bath between measurements. The 1, 2, 4, 9, 16, and 25 minute durations refer to cumulative soaking durations while the sample is fully immersed in the deionized water bath (i.e., after the first minute of soaking and first measurement, the sample is returned to the bath for one more minute of soaking before measuring at the 2-minute mark).

As discussed above in the Water Uptake Capacity Test, the total weight of a sample taken pursuant to the Footwear Sampling Procedure includes the weight of the material as dried or soaked ($Wt_{component\ wet}$ or $Wt._{component\ dry}$) and the weight of the article or backing substrate ($Wt,_{substrate}$). In order to determine a weight change of the material due to water uptake, the weight of the substrate ($Wt,_{substrate}$) needs to be subtracted from the sample weight measurements. This can be accomplished using the same steps discussed above in the Water Uptake Capacity Test to provide the resulting material weights $Wt,_{component\ wet}$ and $Wt_{component\ dry}$ for each soaking-duration measurement.

The specific weight gain ($Ws_t$) from water uptake for each soaked sample is then calculated as the difference between the weight of the soaked sample ($Wt_{component\ wet}$) and the weight of the initial dried sample t ($Wt_{\cdot component\ dry}$) where the resulting difference is then divided by the exposed surface area of the soaked sample ($A_t$) as depicted in Equation 4.

$$(Ws_t) = \frac{(Wt_{component\ wet} - Wt_{\cdot component\ dry})}{(A_t)} \quad \text{(Eq. 4)}$$

where t refers to the particular soaking-duration data point (e.g., 1, 2, 4, 9, 16, or 25 minutes), as mentioned above.

The water uptake rate for the elastomeric material is then determined as the slope of the specific weight gains ($Ws_t$) versus the square root of time (in minutes), as determined by a least squares linear regression of the data points. For the elastomeric material of the present disclosure, the plot of the specific weight gains ($Ws_t$) versus the square root of time (in minutes) provides an initial slope that is substantially linear (to provide the water uptake rate by the linear regression analysis). However, after a period of time depending on the thickness of the component, the specific weight gains will slow down, indicating a reduction in the water uptake rate, until the saturated state is reached. This is believed to be due to the water being sufficiently diffused throughout the elastomeric material as the water uptake approaches saturation, and will vary depending on component thickness.

As such, for the component having an average thickness (as measured above) less than 0.3 millimeters, only the specific weight gain data points at 1, 2, 4, and 9 minutes are used in the linear regression analysis. In these cases, the data points at 16 and 25 minutes can begin to significantly diverge from the linear slope due to the water uptake approaching saturation, and are omitted from the linear regression analysis. In comparison, for the component having an average dried thickness (as measured above) of 0.3 millimeters or more, the specific weight gain data points at 1, 2, 4, 9, 16, and 25 minutes are used in the linear regression analysis. The resulting slope defining the water uptake rate for the sample has units of weight/(surface area-square root of time), such as grams/(meter$^2$– minutes$^{1/2}$) or g/m$^2$/√min.

Furthermore, some component surfaces can create surface phenomenon that quickly attract and retain water molecules (e.g., via surface hydrogen bonding or capillary action) without actually drawing the water molecules into the film or substrate. Thus, samples of these films or substrates can show rapid specific weight gains for the 1-minute sample, and possibly for the 2-minute sample. After that, however, further weight gain is negligible. As such, the linear regression analysis is only applied if the specific weight gain in data points at 1, 2, and 4 minutes continue to show an increase in water uptake. If not, the water uptake rate under this test methodology is considered to be about zero g/m$^2$/√min.

Swelling Capacity Test Protocol

This test measures the swelling capacity of the component in terms of increases in thickness and volume after a given soaking duration for a sample (e.g., taken with the above-discussed Footwear Sampling Procedure). The sample is initially dried at 60 degrees Celsius until there is no weight change for consecutive measurement intervals of at least 30 minutes apart (a 24-hour drying period is typically a suitable duration). The dimensions of the dried sample are then measured (e.g., thickness, length, and width for a rectangular sample; thickness and diameter for a circular sample, etc.). The dried sample is then fully immersed in a deionized water bath maintained at 25 degrees Celsius. After a given soaking duration, the sample is removed from the deionized water bath, blotted with a cloth to remove surface water, and the same dimensions for the soaked sample are re-measured.

Any suitable soaking duration can be used. Accordingly, as used herein, the expression "having a swelling thickness (or volume) increase at 5 minutes of" refers to a soaking duration of 5 minutes, the expression "having a swelling thickness (or volume) increase at 1 hour of" refers to a test duration of 1 hour, the expression "having a swelling thickness (or volume) increase at 24 hours of" refers to a test duration of 24 hours, and the like.

The swelling of the component is determined by (1) an increase in the thickness between the dried and soaked component, by (2) an increase in the volume between the dried and soaked component, or (3) both. The increase in thickness between the dried and soaked components is calculated by subtracting the measured thickness of the initial dried component from the measured thickness of the soaked component. Similarly, the increase in volume between the dried and soaked components is calculated by subtracting the measured volume of the initial dried component from the measured volume of the soaked component. The increases in the thickness and volume can also be represented as percentage increases relative to the dry thickness or volume, respectively.

Contact Angle Test

This test measures the contact angle of the layered material based on a static sessile drop contact angle measurement for a sample (e.g., taken with the above-discussed Footwear Sampling Procedure or Co-extruded Film Sampling Procedure). The contact angle refers to the angle at which a liquid interface meets a solid surface, and is an indicator of how hydrophilic the surface is.

For a dry test (i.e., to determine a dry-state contact angle), the sample is initially equilibrated at 25 degrees Celsius and 20 percent humidity for 24 hours. For a wet test (i.e., to determine a wet-state contact angle), the sample is fully immersed in a deionized water bath maintained at 25 degrees Celsius for 24 hours. After that, the sample is removed from the bath and blotted with a cloth to remove surface water, and clipped to a glass slide if needed to prevent curling.

The dry or wet sample is then placed on a moveable stage of a contact angle goniometer commercially available under the tradename "RAME-HART F290" from Rame-Hart Instrument Co., Succasunna, N.J. A 10-microliter droplet of deionized water is then placed on the sample using a syringe and automated pump. An image is then immediately taken of the droplet (before film can take up the droplet), and the contact angle of both edges of the water droplet are measured from the image. The decrease in contact angle between the dried and wet samples is calculated by subtracting the measured contact angle of the wet layered material from the measured contact angle of the dry layered material.

Coefficient of Friction Test

This test measures the coefficient of friction of the Coefficient of Friction Test for a sample (e.g., taken with the above-discussed Footwear Sampling Procedure, Co-extruded Film Sampling Procedure, or the Neat Film Sampling Procedure). For a dry test (i.e., to determine a dry-state coefficient of friction), the sample is initially equilibrated at 25 degrees Celsius and 20 percent humidity for 24 hours. For a wet test (i.e., to determine a wet-state coefficient of friction), the sample is fully immersed in a deionized water bath maintained at 25 degrees Celsius for 24 hours. After that, the sample is removed from the bath and blotted with a cloth to remove surface water.

The measurement is performed with an aluminum sled mounted on an aluminum test track, which is used to perform a sliding friction test for test sample on an aluminum surface of the test track. The test track measures 127 millimeters wide by 610 millimeters long. The aluminum sled measures 76.2 millimeters.times.76.2 millimeters, with a 9.5 millimeter radius cut into the leading edge. The contact area of the aluminum sled with the track is 76.2 millimeters× 66.6 millimeters, or 5,100 square millimeters).

The dry or wet sample is attached to the bottom of the sled using a room temperature-curing two-part epoxy adhesive commercially available under the tradename "LOCTITE 608" from Henkel, Dusseldorf, Germany. The adhesive is used to maintain the planarity of the wet sample, which can curl when saturated. A polystyrene foam having a thickness of about 25.4 millimeters is attached to the top surface of the sled (opposite of the test sample) for structural support.

The sliding friction test is conducted using a screw-driven load frame. A tow cable is attached to the sled with a mount supported in the polystyrene foam structural support, and is wrapped around a pulley to drag the sled across the aluminum test track. The sliding or frictional force is measured using a load transducer with a capacity of 2,000 Newtons. The normal force is controlled by placing weights on top of the aluminum sled, supported by the polystyrene foam structural support, for a total sled weight of 20.9 kilograms (205 Newtons). The crosshead of the test frame is increased at a rate of 5 millimeters/second, and the total test displacement is 250 millimeters. The coefficient of friction is calculated based on the steady-state force parallel to the direction of movement required to pull the sled at constant velocity. The coefficient of friction itself is found by dividing the steady-state pull force by the applied normal force. Any transient value relating static coefficient of friction at the start of the test is ignored.

Storage Modulus Test

This test measures the resistance of the layered material to being deformed (ratio of stress to strain) when a vibratory or oscillating force is applied to it, and is a good indicator of film compliance in the dry and wet states. For this test, a sample is provided in neat form using the Neat Film Sampling Procedure, which is modified such that the surface area of the test sample is rectangular with dimensions of 5.35 millimeters wide and 10 millimeters long. The layered material thickness can range from 0.1 millimeters to 2 millimeters, and the specific range is not optionally limited as the end modulus result is normalized according to layered material thickness.

The storage modulus (E') with units of megaPascals (MPa) of the sample is determined by dynamic mechanical analysis (DMA) using a DMA analyzer commercially available under the tradename "Q800 DMA ANALYZER" from TA Instruments, New Castle, Del., which is equipped with a relative humidity accessory to maintain the sample at constant temperature and relative humidity during the analysis.

Initially, the thickness of the test sample is measured using calipers (for use in the modulus calculations). The test sample is then clamped into the DMA analyzer, which is operated at the following stress/strain conditions during the analysis: isothermal temperature of 25 degrees Celsius, frequency of 1 Hertz, strain amplitude of 10 micrometers, preload of 1 Newton, and force track of 125 percent. The DMA analysis is performed at a constant 25 degrees Celsius temperature according to the following time/relative humidity (RH) profile: (i) 0 percent RH for 300 minutes (representing the dry state for storage modulus determination), (ii) 50 percent RH for 600 minutes, (iii) 90 percent RH for 600 minutes (representing the wet state for storage modulus determination), and (iv) 0 percent RH for 600 minutes.

The E' value (in MPa) is determined from the DMA curve according to standard DMA techniques at the end of each time segment with a constant RH value. Namely, the E' value at 0 percent RH (i.e., the dry-state storage modulus) is the value at the end of step (i), the E' value at 50 percent RH is the value at the end of step (ii), and the E' value at 90 percent RH (i.e., the wet-state storage modulus) is the value at the end of step (iii) in the specified time/relative humidity profile.

The layered material can be characterized by its dry-state storage modulus, its wet-state storage modulus, or the reduction in storage modulus between the dry-state and wet-state layered materials, where wet-state storage modulus is less than the dry-state storage modulus. This reduction in storage modulus can be listed as a difference between the dry-state storage modulus and the wet-state storage modulus, or as a percentage change relative to the dry-state storage modulus.

Sampling Procedures

Various properties of the resin compositions (e.g., polyolefin-based resin compositions and second resin compositions), including sole structures, plates and other articles formed therefrom can be characterized using samples prepared with the following sampling procedures:

Material Sampling Procedure

A material sampling procedure can be used to obtain a neat sample of a resin composition or, in some instances, a sample of a material used to form a resin composition. The material is provided in media form, such as flakes, granules, powders, pellets, and the like. If a source of the resin composition is not available in a neat form, the sample can be cut from a plate or other component containing the resin composition, thereby isolating a sample of the material.

Plaque Sampling Procedure

The polymeric and non-polymeric ingredients of a resin composition such as a polyolefin-based resin composition or a second resin composition or a comparator resin composition, are combined to form the resin composition. A portion of the resin composition is then be molded into a plaque sized to fit inside the Ross flexing tester used, the plaque having dimensions of about 15 centimeters (cm) by 2.5 centimeters (cm) and a thickness of about 1 millimeter (mm) to about 4 millimeter (mm) by thermoforming the resin composition in a mold. The sample is prepared by mixing the components of the resin composition together, melting the components, pouring, extruding, or injecting the molten resin composition into the mold cavity, cooling the molten resin composition to solidify it in the mold cavity to form the plaque, and then removing the solid plaque from the mold cavity.

Definitions

Unless defined otherwise, all technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

All publications, patents, and patent applications cited in this specification are cited to disclose and describe the methods and/or materials in connection with which the publications are cited. All such publications, patents, and patent applications are herein incorporated by references as if each individual publication or patent were specifically and individually indicated to be incorporated by reference. Such incorporation by reference is expressly limited to the methods and/or materials described in the cited publications, patents, and patent applications and does not extend to any lexicographical definitions from the cited publications, patents, and patent applications. Any lexicographical definition in the publications, patents, and patent applications cited that is not also expressly repeated in the instant specification should not be treated as such and should not be read as defining any terms appearing in the accompanying claims.

Although any methods and materials similar or equivalent to those described herein can also be used in the practice or testing of the present disclosure, the preferred methods and materials are now described. Functions or constructions well-known in the art may not be described in detail for brevity and/or clarity. Aspects of the present disclosure will employ, unless otherwise indicated, techniques of nanotechnology, organic chemistry, material science and engineering and the like, which are within the skill of the art. Such techniques are explained fully in the literature.

It should be noted that ratios, concentrations, amounts, and other numerical data can be expressed herein in a range format. Where the stated range includes one or both of the limits, ranges excluding either or both of those included limits are also included in the disclosure, e.g. the phrase "x to y" includes the range from 'x' to 'y' as well as the range greater than 'x' and less than 'y.' The range can also be expressed as an upper limit, e.g. 'about x, y, z, or less' and should be interpreted to include the specific ranges of 'about x,' 'about y,' and 'about z' as well as the ranges of 'less than x,' less than y,' and 'less than z.' Likewise, the phrase 'about x, y, z, or greater' should be interpreted to include the specific ranges of 'about x,' 'about y,' and 'about z' as well as the ranges of 'greater than x,' greater than y,' and 'greater than z.' In addition, the phrase "about 'x' to 'y'", where 'x' and 'y' are numerical values, includes "about 'x' to about 'y'". It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1 percent to 5 percent" should be interpreted to include not only the explicitly recited values of about 0.1 percent to about 5 percent, but also include individual values (e.g., 1 percent, 2 percent, 3 percent, and 4 percent) and the sub-ranges (e.g., 0.5 percent, 1.1 percent, 2.4 percent, 3.2 percent, and 4.4 percent) within the indicated range.

The term "providing," as used herein and as recited in the claims, is not intended to require any particular delivery or receipt of the provided item. Rather, the term "providing" is merely used to recite items that will be referred to in subsequent elements of the claim(s), for purposes of clarity and ease of readability. The terms "Material Sampling Procedure," "Plaque Sampling Procedure," "Cold Ross Flex Test," "ASTM D 5963-97a", and "Differential Scanning calorimeter (DSC) Test to Determine Percent Crystallinity" as used herein refer to the respective sampling procedures and test methodologies described in the Property Analysis And Characterization Procedure section. These sampling procedures and test methodologies characterize the properties of the recited materials, films, articles and components, and the like, and are not required to be performed as active steps in the claims.

The term "about," as used herein, can include traditional rounding according to significant figures of the numerical value. In some aspects, the term about is used herein to mean a deviation of 10 percent, 5 percent, 2.5 percent, 1 percent, 0.5 percent, 0.1 percent, 0.01 percent, or less from the specified value.

The articles "a" and "an," as used herein, mean one or more when applied to any feature in aspects of the present disclosure described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

The term "isotactic," as used herein, with respect to polypropylene homopolymer or copolymer, is defined as at least three methyl groups (a triad) aligned in the same direction. In one aspect, the polypropylene homopolymer or copolymer has at least about 10 percent isotactic triads, at least about 20 percent isotactic triads, at least about 30 percent isotactic triads, at least about 40 percent isotactic triads, at least about 50 percent isotactic triads, at least about 60 percent isotactic triads, at least about 70 percent isotactic triads, or at least about 80 percent isotactic triads as determined by $^{13}C$ NMR spectroscopy.

A random copolymer of propylene with about 2.2 percent by weight (wt percent) ethylene is commercially available under the tradename "PP9054" from ExxonMobil Chemical Company, Houston, Tex. It has a MFR (ASTM-1238D, 2.16 kilograms, 230 degrees Celsius.) of about 12 grams/10 minutes and a density of 0.90 grams/cubic centimeter ($g/cm^3$).

PP9074 is a random copolymer of propylene with about 2.8 percent by weight (wt percent) ethylene and is commercially available under the tradename "PP9074" from ExxonMobil Chemical Company, Houston, Tex. It has a MFR (ASTM-1238D, 2.16 kilograms, 230 degrees Celsius.) of about 24 grams/10 minutes and a density of 0.90 grams/cubic centimeter ($g/cm^3$).

PP1024E4 is a propylene homopolymer commercially available under the tradename "PP1024E4" from ExxonMobil Chemical Company, Houston, Tex. It has an MFR (ASTM-1238D, 2.16 kilograms, 230 degrees Celsius.) of about 13 grams/10 minutes and a density of 0.90 grams/cubic centimeter ($g/cm^3$).

VISTAMAXX 6202 is a copolymer primarily composed of isotactic propylene repeat units with about 15 percent by weight (wt percent) of ethylene repeat units randomly distributed along the copolymer. It is a metallocene catalyzed copolymer available under the tradename "VISTAMAXX 6202" from ExxonMobil Chemical Company, Houston, Tex. and has an MFR (ASTM-1238D, 2.16 kilograms, 230 degrees Celsius.) of about 20 grams/10 minutes, a density of 0.862 grams/cubic centimeter ($g/cm^3$), and a Durometer Hardness of about 64 (Shore A).

VISTAMAXX 3000 is a copolymer primarily composed of isotactic propylene repeat units with about 11 percent by weight (wt percent) of ethylene repeat units randomly distributed along the copolymer. It is a metallocene catalyzed copolymer available from ExxonMobil Chemical Company and has an MFR (ASTM-1238D, 2.16 kilograms, 230 degrees Celsius) of about 8 grams/10 minutes, a density of 0.873 grams/cubic centimeter (g/cm$^3$), and a Durometer Hardness of about 27 (Shore D).

VISTAMAXX 6502 is a copolymer primarily composed of isotactic propylene repeat units with about 13 percent by weight of ethylene repeat units randomly distributed along the copolymer. It is a metallocene catalyzed copolymer available from ExxonMobil Chemical Company and has an MFR (ASTM-1238D, 2.16 kilograms, 230 degrees Celsius) of about 45 grams/10 minutes, a density of 0.865 grams/cubic centimeter (g/cm$^3$), and a Durometer Hardness of about 71 (Shore A).

EXAMPLES

Now having described the aspects of the present disclosure, in general, the following Examples describe some additional aspects of the present disclosure. While aspects of the present disclosure are described in connection with the following examples and the corresponding text and figures, there is no intent to limit aspects of the present disclosure to this description. On the contrary, the intent is to cover all alternatives, modifications, and equivalents included within the spirit and scope of the present disclosure.

Preparation of Polyolefin-Based Resin Composition and Plates

The base resin pellets are composed of 80 weight percent Exxon PP9054 (propylene random copolymer) and 20 weight resin modifier Exxon VISTAMAXX 6202. The base resin (80 weight percent) was melt-blended with 20 weight percent TPV (SANTOPRENE 203-50) during the extrusion process.

Results

Drop tower tension experiments were conducted on the plates produced above. A Veryst drop tower was used in the experiments. The tower is capable measuring stress-strain behavior of polymers at strain rates in the range of 50 to 200 strain per second. The plate specimen is loaded in the tower by a falling mass from as high as 2 meters. Force is measured using an impact load cell. A high speed camera captures specimen deformation. Strain is calculated using digital image correlation.

Figure 9A:
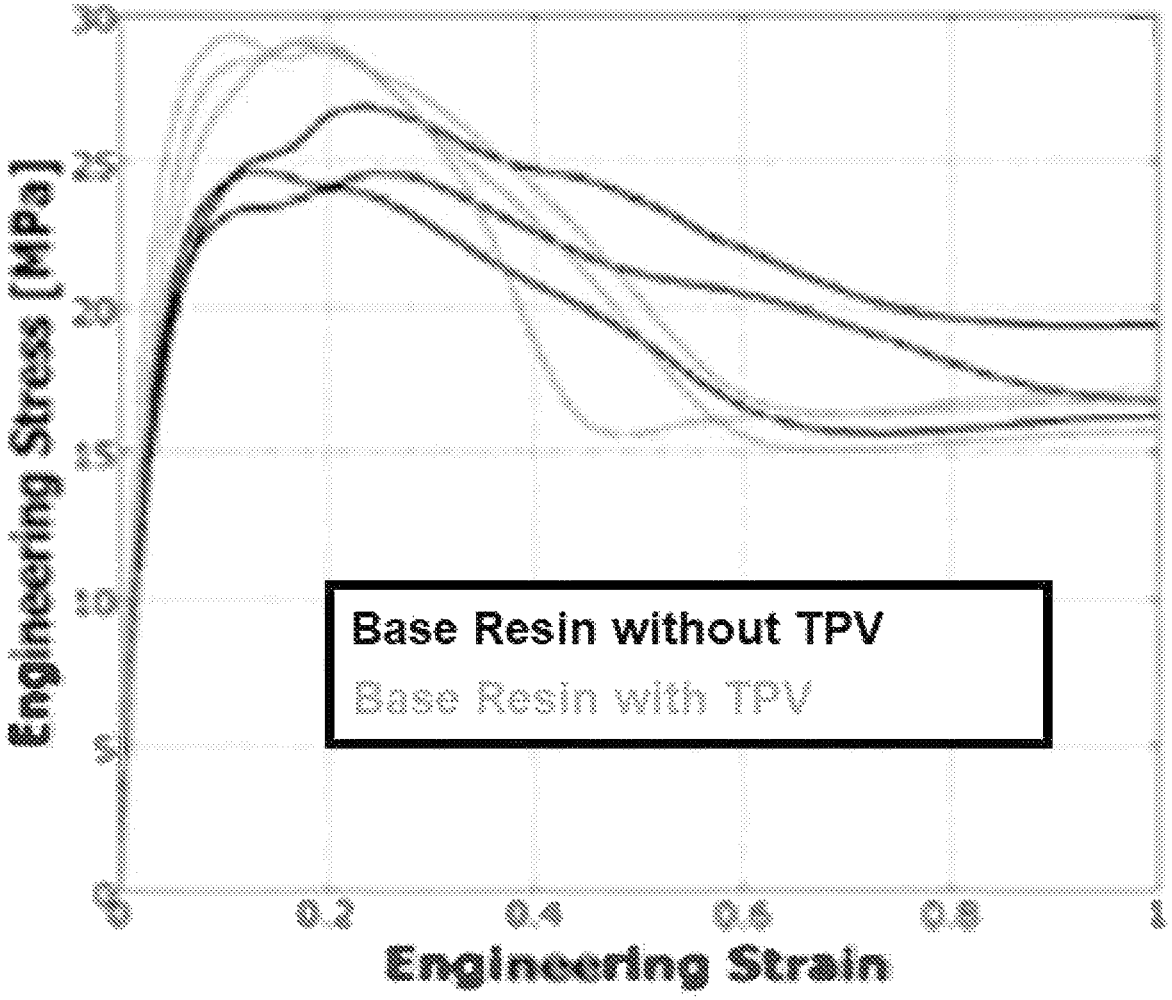
FIGS. 9A-9B provide elongation results of a polyolefin-based resin composition (three samples) with and without a thermoplastic vulcanizate (TPV).
Figure 9B:
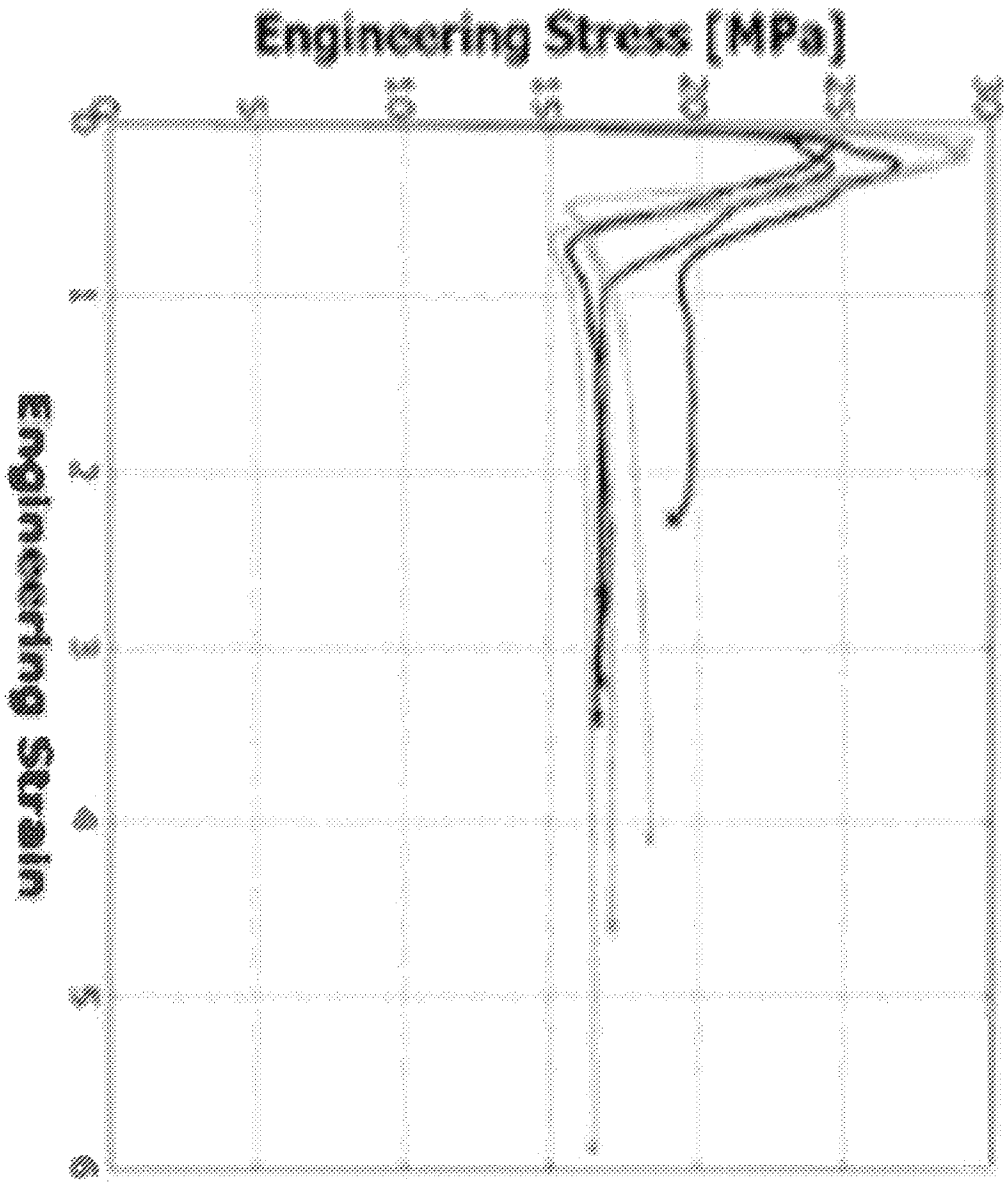

The results of the experiments are provided in FIGS. 9A-9B. FIGS. 9A-9B provide elongation results of the base (three samples) with and without TPV (SANTOPRENE 203-50). The stress-strain plots in FIGS. 9A-9B of the samples show that the addition of the TPV to the base polyolefin composition resulted in the resin composition including the TPV having higher ultimate strength and greater elongation when compared to the base resin composition without the TPV. The higher strength and greater elongation of the plate material significantly reduced the level of "chunking" (i.e., where the edges of the plate fractures and bits of the plate fall off during use in game play) seen in plates made from the base composition.

It should be emphasized that the above-described aspects of the present disclosure are merely possible examples of implementations, and are set forth only for a clear understanding of the principles of the disclosure. Many variations and modifications may be made to the above-described aspects of the disclosure without departing substantially from the spirit and principles of the disclosure. All such modifications and variations are intended to be included herein within the scope of this disclosure.

We claim:

1. A sole structure for an article of footwear, the sole structure comprising:

a plate having a first side and a second side, wherein the first side is configured to be ground-facing when the plate is a component of an article of footwear, and a plurality of traction elements disposed on the first side of the plate, wherein the plate comprises a polyolefin-based resin composition including a polyolefin copolymer, a polymeric resin modifier, and a thermoplastic vulcanizate (TPV); and wherein the polyolefin-based resin composition comprises about 5 percent to about 30 percent by weight of the TPV based upon a total weight of the polyolefin-based resin composition; and wherein the TPV comprises a crosslinked polyolefin elastomer dispersed in a thermoplastic phase comprising a polyolefin.

2. The sole structure according to claim 1, wherein the polyolefin copolymer is a random copolymer of propylene and ethylene.

3. The sole structure according to claim 1, wherein all the polymers in the polyolefin-based resin composition consist essentially of propylene homopolymers or propylene copolymers.

4. The sole structure according to claim 1, wherein the polymeric resin modifier is a copolymer comprising isotactic propylene repeat units and ethylene repeat units.

5. The sole structure according to claim 1, wherein the polymeric resin modifier comprises about 25 percent or less by weight of the polyolefin-based resin composition based upon a total weight of the polyolefin-based resin composition.

6. The sole structure according to claim 1, wherein the TPV comprises an ethylene propylene diene monomer (EPDM) rubber dispersed in a thermoplastic phase comprising polypropylene.

7. The sole structure according to claim 1, wherein the polyolefin-based resin composition has a melt flow index of about 10 grams per 10 minutes to about 30 grams per 10 minutes, as determined by ASTM D1238 at 230 degrees Celsius using a 2.16 kilogram weight.

8. The sole structure according to claim 1, wherein the polyolefin-based resin composition is a thermoplastic polyolefin-based resin composition comprising a thermoplastic polyolefin copolymer, a thermoplastic polymeric resin modifier, and a TPV.

9. The sole structure according to claim 8, wherein the thermoplastic polyolefin copolymer is or includes an olefin copolymer elastomer.

10. The sole structure according to claim 1, wherein one or more of the plurality of traction elements further comprise a second resin composition forming a tip region of the one or more of the plurality of traction elements, and the second resin composition is thermally bonded, or is mechanically bonded, or is both thermally and mechanically bonded to the polyolefin-based resin composition of the plate.

11. The sole structure according to claim 10, wherein the second resin composition comprises a copolymer of styrene and one or both of ethylene and butylene, or comprises a thermoplastic polyurethane (TPU).

12. The sole structure according to claim 1, wherein the plate further comprises a toe bumper integrally formed in the plate, and the toe bumper comprises the polyolefin-based resin composition of the plate, or comprises a second resin composition.

* * * * *